US009208656B2

(12) United States Patent
Inamura et al.

(10) Patent No.: US 9,208,656 B2
(45) Date of Patent: Dec. 8, 2015

(54) SLOT MACHINE INCLUDING A PLURALITY OF VIDEO REEL STRIPS

(71) Applicants: Universal Entertainment Corporation, Tokyo (JP); Aruze Gaming America, Inc., Las Vegas, NV (US)

(72) Inventors: Yukinori Inamura, Tokyo (JP); Yoichi Kato, Tokyo (JP); Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 123 days.

(21) Appl. No.: 14/018,633

(22) Filed: Sep. 5, 2013

(65) Prior Publication Data

US 2014/0094250 A1 Apr. 3, 2014

(30) Foreign Application Priority Data

Oct. 1, 2012 (JP) ..... 2012-219781

(51) Int. Cl.
*G07F 17/34* (2006.01)

(52) U.S. Cl.
CPC ..... *G07F 17/34* (2013.01)

(58) Field of Classification Search
USPC ..... 463/20, 21
See application file for complete search history.

(56) References Cited

U.S. PATENT DOCUMENTS

2006/0030390 A1 2/2006 Okada
2008/0051188 A1* 2/2008 Inamura ..... G07F 17/3244 463/20
2008/0113739 A1 5/2008 Visser
2008/0113757 A1* 5/2008 Sakuma ..... G07F 17/3202 463/20
2008/0200235 A1* 8/2008 Yoshizawa ..... G07F 17/34 463/20
2011/0117993 A1 5/2011 Carlson
2011/0312405 A1 12/2011 Saito
2012/0172106 A1 7/2012 Caputo et al.
2013/0296018 A1* 11/2013 Aida ..... G07F 17/34 463/20
2013/0296019 A1* 11/2013 Aida ..... G07F 17/34 463/20
2013/0324217 A1* 12/2013 Gilbertson ..... G07F 17/34 463/20
2014/0106848 A1* 4/2014 Tam ..... G07F 17/3211 463/20

FOREIGN PATENT DOCUMENTS

CN 1733344 2/2006
CN 101061523 10/2007

OTHER PUBLICATIONS

Macau Office Action for MO Patent Application No. I/ 001242, Dated Jan. 21, 2015.

* cited by examiner

*Primary Examiner* — Pierre E Elisca
(74) *Attorney, Agent, or Firm* — Lex IP Meister, PLLC

(57) ABSTRACT

On the slot machine, a slot game including a base game and free games is caused to proceed on a display. On the base game reel strips, on all of a plurality of reels, symbols whose each kind is the same, other than feature symbols and wild symbols, are arranged in succession. On the free game reel strips, on all of a plurality of reels, symbols whose each kind is the same, other than the feature symbols and the wild symbols, are arranged in succession and in addition thereto, only in a case of top symbols whose payout multiplying factor is the highest, the top symbols whose number is larger than a number of top symbols displayed on the base game reel strips are arranged in succession.

5 Claims, 78 Drawing Sheets

FIG. 5

BASE GAME REEL STRIPS

| CODE NO. | REEL 1 | REEL 2 | REEL 3 | REEL 4 | REEL 5 |
|---|---|---|---|---|---|
| 0 | GOLD | BLUE | RED | WHITE | BLACK |
| 1 | GOLD | BLUE | RED | WHITE | BLACK |
| 2 | GOLD | BLUE | RED | WHITE | BLACK |
| 3 | GOLD | BLUE | RED | WHITE | BLACK |
| 4 | BLACK | WILD | BLUE | RED | WHITE |
| 5 | BLACK | GOLD | BLUE | RED | WHITE |
| 6 | BLACK | GOLD | BLUE | RED | WHITE |
| 7 | BLACK | GOLD | BLUE | RED | WHITE |
| 8 | WHITE | GOLD | WILD | BLUE | RED |
| 9 | WHITE | GOLD | GOLD | BLUE | RED |
| 10 | WHITE | GOLD | GOLD | BLUE | RED |
| 11 | WHITE | GOLD | GOLD | BLUE | RED |
| 12 | RED | GOLD | GOLD | WILD | BLUE |
| 13 | RED | FEATURE | GOLD | GOLD | BLUE |
| 14 | RED | QUEEN | GOLD | GOLD | BLUE |
| 15 | RED | QUEEN | GOLD | GOLD | BLUE |
| 16 | BLUE | QUEEN | GOLD | GOLD | WILD |
| 17 | BLUE | QUEEN | WILD | GOLD | GOLD |
| 18 | BLUE | WILD | QUEEN | GOLD | GOLD |
| 19 | BLUE | BLUE | QUEEN | GOLD | GOLD |
| 20 | GOLD | BLUE | QUEEN | GOLD | GOLD |
| 21 | GOLD | BLUE | QUEEN | WILD | GOLD |
| 22 | GOLD | BLUE | RED | BLUE | GOLD |
| 23 | GOLD | FEATURE | RED | BLUE | GOLD |
| 24 | GOLD | JACK | RED | BLUE | GOLD |
| 25 | GOLD | JACK | RED | BLUE | WILD |
| 26 | GOLD | JACK | FEATURE | ACE | WHITE |
| 27 | GOLD | JACK | JACK | ACE | WHITE |
| 28 | ACE | WILD | JACK | ACE | WHITE |
| 29 | ACE | RED | JACK | ACE | WHITE |
| 30 | ACE | RED | JACK | RED | QUEEN |
| 31 | ACE | RED | WILD | RED | QUEEN |
| 32 | WHITE | RED | BLUE | RED | QUEEN |
| 33 | WHITE | NINE | BLUE | RED | QUEEN |
| 34 | WHITE | NINE | BLUE | FEATURE | WILD |
| 35 | WHITE | NINE | BLUE | KING | BLUE |
| 36 | WHITE | NINE | NINE | KING | BLUE |
| 37 | WHITE | WILD | NINE | KING | BLUE |
| 38 | WHITE | WHITE | NINE | KING | BLUE |
| 39 | WHITE | WHITE | NINE | FEATURE | NINE |
| 40 | TEN | WHITE | WILD | JACK | NINE |

FIG. 6

BASE GAME REEL STRIPS

| CODE NO. | REEL 1 | REEL 2 | REEL 3 | REEL 4 | REEL 5 |
|---|---|---|---|---|---|
| 41 | TEN | WHITE | WHITE | JACK | NINE |
| 42 | TEN | WHITE | WHITE | JACK | NINE |
| 43 | TEN | TEN | WHITE | JACK | WILD |
| 44 | BLACK | TEN | WHITE | RED | RED |
| 45 | BLACK | TEN | WHITE | RED | RED |
| 46 | BLACK | TEN | TEN | RED | RED |
| 47 | BLACK | FEATURE | TEN | RED | RED |
| 48 | JACK | KING | TEN | TEN | ACE |
| 49 | JACK | KING | TEN | TEN | ACE |
| 50 | JACK | KING | FEATURE | TEN | ACE |
| 51 | JACK | KING | KING | TEN | ACE |
| 52 | RED | WILD | KING | WILD | WILD |
| 53 | RED | BLACK | KING | WHITE | RED |
| 54 | RED | BLACK | KING | WHITE | RED |
| 55 | RED | BLACK | FEATURE | WHITE | RED |
| 56 | RED | BLACK | ACE | WHITE | RED |
| 57 | RED | BLACK | ACE | NINE | KING |
| 58 | RED | ACE | ACE | NINE | KING |
| 59 | RED | ACE | ACE | NINE | KING |
| 60 | QUEEN | ACE | WHITE | NINE | KING |
| 61 | QUEEN | ACE | WHITE | WILD | WILD |
| 62 | QUEEN | WILD | WHITE | BLACK | BLUE |
| 63 | QUEEN | RED | WHITE | BLACK | BLUE |
| 64 | BLACK | RED | WILD | BLACK | BLUE |
| 65 | BLACK | RED | BLUE | BLACK | BLUE |
| 66 | BLACK | RED | BLUE | FEATURE | KING |
| 67 | BLACK | RED | BLUE | KING | KING |
| 68 | NINE | NINE | BLUE | KING | KING |
| 69 | NINE | NINE | NINE | KING | KING |
| 70 | NINE | NINE | NINE | KING | WILD |
| 71 | NINE | NINE | NINE | FEATURE | WHITE |
| 72 | BLUE | FEATURE | NINE | QUEEN | WHITE |
| 73 | BLUE | KING | FEATURE | QUEEN | WHITE |
| 74 | BLUE | KING | KING | QUEEN | WHITE |
| 75 | BLUE | KING | KING | QUEEN | QUEEN |
| 76 | BLUE | KING | KING | BLUE | QUEEN |
| 77 | BLUE | WILD | KING | BLUE | QUEEN |
| 78 | BLUE | BLACK | WILD | BLUE | QUEEN |
| 79 | BLUE | BLACK | BLACK | BLUE | WILD |
| 80 | KING | BLACK | BLACK | WILD | BLACK |

FIG. 7

BASE GAME REEL STRIPS

| CODE NO. | REEL 1 | REEL 2 | REEL 3 | REEL 4 | REEL 5 |
|---|---|---|---|---|---|
| 81 | KING | BLACK | BLACK | BLACK | BLACK |
| 82 | KING | BLACK | BLACK | BLACK | BLACK |
| 83 | KING | TEN | BLACK | BLACK | BLACK |
| 84 | | TEN | FEATURE | BLACK | TEN |
| 85 | | TEN | TEN | NINE | TEN |
| 86 | | TEN | TEN | NINE | TEN |
| 87 | | WILD | TEN | NINE | TEN |
| 88 | | WHITE | TEN | NINE | WILD |
| 89 | | WHITE | WILD | WILD | WHITE |
| 90 | | WHITE | BLACK | WHITE | WHITE |
| 91 | | WHITE | BLACK | WHITE | WHITE |
| 92 | | FEATURE | BLACK | WHITE | WHITE |
| 93 | | JACK | BLACK | WHITE | JACK |
| 94 | | JACK | BLACK | ACE | JACK |
| 95 | | JACK | FEATURE | ACE | JACK |
| 96 | | JACK | JACK | ACE | JACK |
| 97 | | FEATURE | JACK | ACE | BLUE |
| 98 | | QUEEN | JACK | WILD | BLUE |
| 99 | | QUEEN | JACK | BLACK | BLUE |
| 100 | | QUEEN | FEATURE | BLACK | BLUE |
| 101 | | QUEEN | QUEEN | BLACK | WILD |
| 102 | | FEATURE | QUEEN | BLACK | ACE |
| 103 | | ACE | QUEEN | TEN | ACE |
| 104 | | ACE | QUEEN | TEN | ACE |
| 105 | | ACE | FEATURE | TEN | ACE |
| 106 | | ACE | ACE | TEN | RED |
| 107 | | BLUE | ACE | FEATURE | RED |
| 108 | | BLUE | ACE | QUEEN | RED |
| 109 | | BLUE | ACE | QUEEN | RED |
| 110 | | BLUE | RED | QUEEN | WILD |
| 111 | | WILD | RED | QUEEN | JACK |
| 112 | | WILD | RED | FEATURE | JACK |
| 113 | | WILD | RED | JACK | JACK |
| 114 | | WILD | WILD | JACK | JACK |
| 115 | | GOLD | WILD | JACK | BLACK |
| 116 | | GOLD | WILD | JACK | BLACK |
| 117 | | GOLD | WILD | WHITE | BLACK |
| 118 | | GOLD | GOLD | WHITE | BLACK |
| 119 | | BLACK | GOLD | WHITE | WILD |
| 120 | | BLACK | GOLD | WHITE | WILD |

FIG. 8

BASE GAME REEL STRIPS

| CODE NO. | REEL 1 | REEL 2 | REEL 3 | REEL 4 | REEL 5 |
|---|---|---|---|---|---|
| 121 | | BLACK | GOLD | WILD | WILD |
| 122 | | BLACK | BLACK | WILD | WILD |
| 123 | | WHITE | BLACK | WILD | GOLD |
| 124 | | WHITE | BLACK | WILD | GOLD |
| 125 | | WHITE | BLACK | GOLD | GOLD |
| 126 | | WHITE | WHITE | GOLD | GOLD |
| 127 | | RED | WHITE | GOLD | |
| 128 | | RED | WHITE | GOLD | |
| 129 | | RED | WHITE | BLACK | |
| 130 | | RED | | BLACK | |
| 131 | | | | BLACK | |
| 132 | | | | BLACK | |
| 133 | | | | | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 9

FREE GAME REEL STRIPS

| CODE NO. | REEL 1 | REEL 2 | REEL 3 | REEL 4 | REEL 5 |
|---|---|---|---|---|---|
| 0 | GOLD | GOLD | GOLD | GOLD | GOLD |
| 1 | GOLD | GOLD | GOLD | GOLD | GOLD |
| 2 | GOLD | GOLD | GOLD | GOLD | GOLD |
| 3 | GOLD | GOLD | GOLD | GOLD | GOLD |
| 4 | GOLD | WILD | GOLD | GOLD | GOLD |
| 5 | GOLD | GOLD | GOLD | GOLD | GOLD |
| 6 | GOLD | GOLD | GOLD | GOLD | GOLD |
| 7 | GOLD | GOLD | GOLD | GOLD | GOLD |
| 8 | GOLD | GOLD | WILD | GOLD | GOLD |
| 9 | GOLD | GOLD | GOLD | GOLD | GOLD |
| 10 | GOLD | GOLD | GOLD | GOLD | GOLD |
| 11 | GOLD | GOLD | GOLD | GOLD | GOLD |
| 12 | GOLD | GOLD | GOLD | WILD | GOLD |
| 13 | GOLD | FEATURE | GOLD | GOLD | GOLD |
| 14 | GOLD | QUEEN | GOLD | GOLD | GOLD |
| 15 | GOLD | QUEEN | GOLD | GOLD | GOLD |
| 16 | GOLD | QUEEN | GOLD | GOLD | WILD |
| 17 | GOLD | QUEEN | WILD | GOLD | GOLD |
| 18 | GOLD | WILD | QUEEN | GOLD | GOLD |
| 19 | GOLD | BLUE | QUEEN | GOLD | GOLD |
| 20 | GOLD | BLUE | QUEEN | GOLD | GOLD |
| 21 | GOLD | BLUE | QUEEN | WILD | GOLD |
| 22 | GOLD | BLUE | RED | BLUE | GOLD |
| 23 | GOLD | FEATURE | RED | BLUE | GOLD |
| 24 | GOLD | JACK | RED | BLUE | GOLD |
| 25 | GOLD | JACK | RED | BLUE | WILD |
| 26 | GOLD | JACK | FEATURE | ACE | WHITE |
| 27 | GOLD | JACK | JACK | ACE | WHITE |
| 28 | ACE | WILD | JACK | ACE | WHITE |
| 29 | ACE | RED | JACK | ACE | WHITE |
| 30 | ACE | RED | JACK | RED | QUEEN |
| 31 | ACE | RED | WILD | RED | QUEEN |
| 32 | WHITE | RED | BLUE | RED | QUEEN |
| 33 | WHITE | NINE | BLUE | RED | QUEEN |
| 34 | WHITE | NINE | BLUE | FEATURE | WILD |
| 35 | WHITE | NINE | BLUE | KING | BLUE |
| 36 | WHITE | NINE | NINE | KING | BLUE |
| 37 | WHITE | WILD | NINE | KING | BLUE |
| 38 | WHITE | WHITE | NINE | KING | BLUE |
| 39 | WHITE | WHITE | NINE | FEATURE | NINE |
| 40 | TEN | WHITE | WILD | JACK | NINE |

FIG. 10

FREE GAME REEL STRIPS

| CODE NO. | REEL 1 | REEL 2 | REEL 3 | REEL 4 | REEL 5 |
|---|---|---|---|---|---|
| 41 | TEN | WHITE | WHITE | JACK | NINE |
| 42 | TEN | WHITE | WHITE | JACK | NINE |
| 43 | TEN | TEN | WHITE | JACK | WILD |
| 44 | BLACK | TEN | WHITE | RED | RED |
| 45 | BLACK | TEN | WHITE | RED | RED |
| 46 | BLACK | TEN | TEN | RED | RED |
| 47 | BLACK | FEATURE | TEN | RED | RED |
| 48 | JACK | KING | TEN | TEN | ACE |
| 49 | JACK | KING | TEN | TEN | ACE |
| 50 | JACK | KING | FEATURE | TEN | ACE |
| 51 | JACK | KING | KING | TEN | ACE |
| 52 | RED | WILD | KING | WILD | WILD |
| 53 | RED | BLACK | KING | WHITE | RED |
| 54 | RED | BLACK | KING | WHITE | RED |
| 55 | RED | BLACK | FEATURE | WHITE | RED |
| 56 | RED | BLACK | ACE | WHITE | RED |
| 57 | RED | BLACK | ACE | NINE | KING |
| 58 | RED | ACE | ACE | NINE | KING |
| 59 | RED | ACE | ACE | NINE | KING |
| 60 | QUEEN | ACE | WHITE | NINE | KING |
| 61 | QUEEN | ACE | WHITE | WILD | WILD |
| 62 | QUEEN | WILD | WHITE | BLACK | BLUE |
| 63 | QUEEN | RED | WHITE | BLACK | BLUE |
| 64 | BLACK | RED | WILD | BLACK | BLUE |
| 65 | BLACK | RED | BLUE | BLACK | BLUE |
| 66 | BLACK | RED | BLUE | FEATURE | KING |
| 67 | BLACK | RED | BLUE | KING | KING |
| 68 | NINE | NINE | BLUE | KING | KING |
| 69 | NINE | NINE | NINE | KING | KING |
| 70 | NINE | NINE | NINE | KING | WILD |
| 71 | NINE | NINE | NINE | FEATURE | WHITE |
| 72 | BLUE | FEATURE | NINE | QUEEN | WHITE |
| 73 | BLUE | KING | FEATURE | QUEEN | WHITE |
| 74 | BLUE | KING | KING | QUEEN | WHITE |
| 75 | BLUE | KING | KING | QUEEN | QUEEN |
| 76 | BLUE | KING | KING | BLUE | QUEEN |
| 77 | BLUE | WILD | KING | BLUE | QUEEN |
| 78 | BLUE | BLACK | WILD | BLUE | QUEEN |
| 79 | BLUE | BLACK | BLACK | BLUE | WILD |
| 80 | KING | BLACK | BLACK | WILD | BLACK |

FIG. 11

FREE GAME REEL STRIPS

| CODE NO. | REEL 1 | REEL 2 | REEL 3 | REEL 4 | REEL 5 |
|---|---|---|---|---|---|
| 81 | KING | BLACK | BLACK | BLACK | BLACK |
| 82 | KING | BLACK | BLACK | BLACK | BLACK |
| 83 | KING | TEN | BLACK | BLACK | BLACK |
| 84 | GOLD | TEN | FEATURE | BLACK | TEN |
| 85 | GOLD | TEN | TEN | NINE | TEN |
| 86 | GOLD | TEN | TEN | NINE | TEN |
| 87 | GOLD | WILD | TEN | NINE | TEN |
| 88 | GOLD | WHITE | TEN | NINE | WILD |
| 89 | GOLD | WHITE | WILD | WILD | WHITE |
| 90 | GOLD | WHITE | BLACK | WHITE | WHITE |
| 91 | GOLD | WHITE | BLACK | WHITE | WHITE |
| 92 | | FEATURE | BLACK | WHITE | WHITE |
| 93 | | JACK | BLACK | WHITE | JACK |
| 94 | | JACK | BLACK | ACE | JACK |
| 95 | | JACK | FEATURE | ACE | JACK |
| 96 | | JACK | JACK | ACE | JACK |
| 97 | | FEATURE | JACK | ACE | BLUE |
| 98 | | QUEEN | JACK | WILD | BLUE |
| 99 | | QUEEN | JACK | BLACK | BLUE |
| 100 | | QUEEN | FEATURE | BLACK | BLUE |
| 101 | | QUEEN | QUEEN | BLACK | WILD |
| 102 | | FEATURE | QUEEN | BLACK | ACE |
| 103 | | ACE | QUEEN | TEN | ACE |
| 104 | | ACE | QUEEN | TEN | ACE |
| 105 | | ACE | FEATURE | TEN | ACE |
| 106 | | ACE | ACE | TEN | RED |
| 107 | | BLUE | ACE | FEATURE | RED |
| 108 | | BLUE | ACE | QUEEN | RED |
| 109 | | BLUE | ACE | QUEEN | RED |
| 110 | | BLUE | RED | QUEEN | WILD |
| 111 | | WILD | RED | QUEEN | JACK |
| 112 | | WILD | RED | FEATURE | JACK |
| 113 | | WILD | RED | JACK | JACK |
| 114 | | WILD | WILD | JACK | JACK |
| 115 | | GOLD | WILD | JACK | BLACK |
| 116 | | GOLD | WILD | JACK | BLACK |
| 117 | | GOLD | WILD | WHITE | BLACK |
| 118 | | GOLD | GOLD | WHITE | BLACK |
| 119 | | GOLD | GOLD | WHITE | WILD |
| 120 | | GOLD | GOLD | WHITE | WILD |

FIG. 12

FREE GAME REEL STRIPS

| CODE NO. | REEL 1 | REEL 2 | REEL 3 | REEL 4 | REEL 5 |
|---|---|---|---|---|---|
| 121 | | GOLD | GOLD | WILD | WILD |
| 122 | | GOLD | GOLD | WILD | WILD |
| 123 | | GOLD | GOLD | WILD | GOLD |
| 124 | | GOLD | GOLD | WILD | GOLD |
| 125 | | GOLD | GOLD | GOLD | GOLD |
| 126 | | GOLD | GOLD | GOLD | GOLD |
| 127 | | GOLD | GOLD | GOLD | GOLD |
| 128 | | GOLD | GOLD | GOLD | GOLD |
| 129 | | GOLD | GOLD | GOLD | GOLD |
| 130 | | GOLD | GOLD | GOLD | GOLD |
| 131 | | GOLD | GOLD | GOLD | GOLD |
| 132 | | GOLD | GOLD | GOLD | GOLD |
| 133 | | GOLD | GOLD | GOLD | GOLD |
| 134 | | GOLD | GOLD | GOLD | GOLD |
| 135 | | GOLD | GOLD | GOLD | |
| 136 | | GOLD | GOLD | GOLD | |
| 137 | | GOLD | GOLD | GOLD | |
| 138 | | GOLD | | GOLD | |
| 139 | | | | GOLD | |
| 140 | | | | GOLD | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |
| 150 | | | | | |
| 151 | | | | | |
| 152 | | | | | |
| 153 | | | | | |
| 154 | | | | | |
| 155 | | | | | |
| 156 | | | | | |
| 157 | | | | | |
| 158 | | | | | |
| 159 | | | | | |
| 160 | | | | | |

FIG. 14

BASE GAME

| SYMBOL | 1 | 2 | 3 | 4 | 5 |
|---|---|---|---|---|---|
| WILD | 0 | 0 | 0 | 0 | 0 |
| GOLD | 0 | 2 | 25 | 50 | 100 |
| BLUE | 0 | 1 | 20 | 40 | 80 |
| RED | 0 | 1 | 20 | 40 | 80 |
| WHITE | 0 | 1 | 10 | 20 | 40 |
| BLACK | 0 | 1 | 10 | 20 | 40 |
| ACE | 0 | 0 | 5 | 10 | 15 |
| KING | 0 | 0 | 4 | 9 | 14 |
| QUEEN | 0 | 0 | 3 | 8 | 13 |
| JACK | 0 | 0 | 2 | 7 | 12 |
| TEN | 0 | 0 | 1 | 6 | 11 |
| NINE | 0 | 0 | 1 | 6 | 11 |
| FEATURE | 0 | 0 | 2 | 0 | 0 |

* EXCEPT SCATTER.

LINE PAYOUT

* SCATTER PAY.

※SYMBOLS OTHER THAN SCATTER SYMBOLS ARE SUBSTITUTED FOR WILD SYMBOLS.

FIG. 15

FREE GAME

| SYMBOL | 1 | 2 | 3 | 4 | 5 |
|---|---|---|---|---|---|
| WILD | 0 | 0 | 0 | 0 | 0 |
| GOLD | 0 | 2 | 25 | 50 | 100 |
| BLUE | 0 | 1 | 20 | 40 | 80 |
| RED | 0 | 1 | 20 | 40 | 80 |
| WHITE | 0 | 1 | 10 | 20 | 40 |
| BLACK | 0 | 1 | 10 | 20 | 40 |
| ACE | 0 | 0 | 5 | 10 | 15 |
| KING | 0 | 0 | 4 | 9 | 14 |
| QUEEN | 0 | 0 | 3 | 8 | 13 |
| JACK | 0 | 0 | 2 | 7 | 12 |
| TEN | 0 | 0 | 1 | 6 | 11 |
| NINE | 0 | 0 | 1 | 6 | 11 |
| FEATURE | 0 | 0 | 2 | 0 | 0 |

* EXCEPT SCATTER.

LINE PAYOUT

* SCATTER PAY.

※SYMBOLS OTHER THAN SCATTER SYMBOLS ARE SUBSTITUTED FOR WILD SYMBOLS.

FIG. 53

| CODE NO. | REEL 1 | REEL 2 | REEL 3 | REEL 4 | REEL 5 |
|---|---|---|---|---|---|
| 10 | GOLD | GOLD | GOLD | GOLD | GOLD |
| 11 | GOLD | GOLD | GOLD | GOLD | GOLD |
| 12 | GOLD | GOLD | GOLD | WILD | GOLD |
| 13 | GOLD | FEATURE | GOLD | GOLD | GOLD |
| 14 | GOLD | QUEEN | GOLD | GOLD | GOLD |
| 15 | GOLD | QUEEN | GOLD | GOLD | GOLD |
| 16 | GOLD | QUEEN | GOLD | GOLD | WILD |
| 17 | GOLD | QUEEN | WILD | GOLD | GOLD |
| 18 | GOLD | WILD | QUEEN | GOLD | GOLD |
| 19 | GOLD | BLUE | QUEEN | GOLD | GOLD |
| 20 | GOLD | BLUE | QUEEN | GOLD | GOLD |
| 21 | GOLD | BLUE | QUEEN | WILD | GOLD |
| 22 | GOLD | BLUE | RED | BLUE | GOLD |
| 23 | GOLD | FEATURE | RED | BLUE | GOLD |
| 24 | GOLD | JACK | RED | BLUE | GOLD |
| 25 | GOLD | JACK | RED | BLUE | WILD |
| 26 | GOLD | JACK | FEATURE | ACE | WHITE |
| 27 | GOLD | JACK | JACK | ACE | WHITE |
| 28 | ACE | WILD | JACK | ACE | WHITE |
| 29 | ACE | RED | JACK | ACE | WHITE |
| 30 | ACE | RED | JACK | RED | QUEEN |
| 31 | ACE | RED | WILD | RED | QUEEN |
| 32 | WHITE | RED | BLUE | RED | QUEEN |

FIG. 54

| REEL 1 | REEL 2 | REEL 3 | REEL 4 | REEL 5 | WEIGHT | PROBABILITY |
|---|---|---|---|---|---|---|
| FROM 27 | FROM 13 | FROM 17 | FROM 21 | FROM 25 | 1 | 11.11% |
| FROM 29 | FROM 15 | FROM 19 | FROM 23 | FROM 27 | 1 | 11.11% |
| FROM 31 | FROM 17 | FROM 21 | FROM 25 | FROM 29 | 1 | 11.11% |
| NO REWRITING | NO REWRITING | NO REWRITING | NO REWRITING | NO REWRITING | 6 | 66.67% |
| | | | | | 9 | 100.00% |

FIG. 66

| | GAMBLE ON | GAMBLE OFF |
|---|---|---|
| CASH OUT | TAKE WIN | TAKE WIN |
| GAMBLE | GAMBLE START | — |
| MAX BET | INACTIVE | GAMBLE START |
| SPIN | TO BASE GAME | TO BASE GAME |

FIG. 70

| No | SCREEN | CONTROL PANEL | OPERATION |
|---|---|---|---|
| ① | EXIT | HELP | SHIFT TO A BASE GAME SCREEN |
| ② | PREV. | BET ×1 | SHIFT TO A PREVIOUS PAGE |
| ③ | NEXT | BET ×2 | SHIFT TO THE NEXT PAGE |

FIG. 73

| KIND OF BUTTON | DURING IDLING | DURING A GAME | DURING AN ERROR | DURING AUDITING | TAKE WIN OR GAMBLE |
|---|---|---|---|---|---|
| HELP | LIGHTING-UP | LIGHTING-DOWN | LIGHTING-DOWN | LIGHTING-DOWN | LIGHTING-UP |
| LANGUAGE SWITCH | LIGHTING-UP | LIGHTING-DOWN | LIGHTING-DOWN | LIGHTING-DOWN | LIGHTING-DOWN |
| VOLUME | LIGHTING-UP | LIGHTING-UP | LIGHTING-DOWN | LIGHTING-DOWN | LIGHTING-UP |
| LINE NUMBER | LIGHTING-UP (WHEN POSSIBLE) | LIGHTING-DOWN | LIGHTING-DOWN | LIGHTING-DOWN | LIGHTING-DOWN |
| BET NUMBER | LIGHTING-UP | LIGHTING-DOWN | LIGHTING-DOWN | LIGHTING-DOWN | LIGHTING-DOWN |
| PAY TABLE | LIGHTING-UP | LIGHTING-DOWN | LIGHTING-DOWN | LIGHTING-DOWN | LIGHTING-UP |

SLOT MACHINE INCLUDING A PLURALITY OF VIDEO REEL STRIPS

CROSS REFERENCE TO RELATED APPLICATIONS

This application claims priority of Japanese Patent Application No. 2012-219781 filed on Oct. 1, 2012. The contents of this application are incorporated herein by reference in their entirety.

BACKGROUND OF THE INVENTION

1. Field of the Invention

The present invention relates to a slot machine which includes a plurality of video reel strips.

2. Description of the Background Art

Conventionally, as a slot machine including a plurality of video reel strips, for example, there is a model which has the below-mentioned technology. In the technology which such a model has, since a game is subsequently initiated by the occurrence of triggering, the plurality of video reel strips are upgraded. When the plurality of video reel strips are upgraded, it becomes easy for a player to obtain a winning combination (for example, refer to US patent application publication 2012/0172106).

However, as a method of upgrading the plurality of video reel strips, for example, a method in which the number of wild symbols which can be substituted with any symbols is increased is adopted. Then, since it is easy for a player to recognize the increase in the number of the wild symbols, a player can soon perceive that the plurality of video reel strips have been upgraded.

Accordingly, a new design for upgrading the plurality of video reel strips has been desired by players.

Therefore, in view of the above-described respect, the present invention was made. An object of the present invention is to provide a slot machine which realizes a new design for upgrading the plurality of video reel strips.

SUMMARY OF THE INVENTION

The invention according to claim 1 to solve the above-mentioned problem is a slot machine including: a display for displaying a part of a plurality of video reel strips having different kinds of symbols arranged thereon; and a processor for causing a slot game including a base game and free games to proceed on the display, the processor being programmed to execute processes (A) to (B) described below.

(A) A process in which upon causing the base game to proceed, used are base game reel strips on which on all of the plurality of video reel strips, symbols whose each kind is the same are arranged in succession.

(B) A process in which upon causing the free games to proceed, used are free game reel strips on which on all of the plurality of video reel strips, the symbols whose each kind is the same are arranged in succession and only in a case of top symbols whose payout is the highest under the same condition, the top symbols whose number is larger than the number of top symbols displayed on the base game reel strips are arranged in succession. In other words, when an award is obtained, only in the case of the top symbols by which a larger award (for example, a payout multiplying factor is the highest) than that obtained by the other symbols can be obtained, the free game reel strips on which the top symbols whose number is larger than the number of the top symbols displayed on the base game reel strips are arranged in succession are used.

The slot machine according to claim 1 includes the above-described configuration, thereby causing the slot game including the base game and the free games to proceed on the display. Upon causing the base game to proceed, the base game reel strips are used. On the base game reel strips, on all of the plurality of video reel strips, symbols whose each kind is the same are arranged in succession. Upon causing the free games to proceed, the free game reel strips are used. On the free game reel strips, on all of the plurality of video reel strips, the symbols whose each kind is the same are arranged in succession and when the award is obtained, only in the case of the top symbols by which the larger award (for example, the payout multiplying factor is the highest) than that obtained by the other symbols can be obtained, the top symbols whose number is larger than the number of the top symbols displayed on the base game reel strips are arranged in succession.

In other words, on the base game reel strips and the free game reel strips, a mode in which on all of the plurality of video reel strips, symbols whose each kind is the same are arranged in succession is common to each other. In addition, by the mode in which on the free game reel strips, on the video reel strips, symbols whose each kind is the same are arranged in succession and in addition thereto, only in the case of the top symbols whose payout multiplying factor is the highest, the top symbols whose number is larger than the number of the top symbols displayed on the base game reel strips are arranged in succession, the plurality of video reel strips are upgraded.

In addition, as the invention according to claim 2, a slot machine below described is provided. In the invention according thereto is characterized in that all of the symbols other than wild symbols or special symbols which do not simply directly determine any payout are configured such that on all of the video reel strips, the symbols whose each kind is the same are arranged in succession. The wild symbols generate a winning combination on a payline below described through the replacement with other symbols, however do not directly generate any award with themselves solely. The feature symbols trigger a feature game, which is composed of a set of the plurality of free games (for example, eight free games) and is more advantageous for a player than base game.

More specifically, the slot machine includes: a display for displaying a part of a plurality of video reel strips on which a plurality of kinds of symbols including wild symbols, feature symbols, and top symbols enabling a larger award to be obtained than an award obtained by a combination of other symbols when the award is obtained; and a processor for causing a slot game to proceed on the display, the slot game including a base game and free games triggered when in the base game, a predetermined combination of the feature symbols is displayed on the display, the processor being programmed to execute processes (A) to (B) described below.

(A) A process in which upon causing the base game to proceed, used are base game reel strips on which the wild symbols and the feature symbols are arranged and other symbols than the feature symbols are arranged in succession, so as to avoid an award occurring by replacing the wild symbols with the feature symbols or avoid an award occurring by the feature symbols on all of the plurality of video reel strips.

(B) A process in which upon causing the free games to proceeds, used are free game reel strips on which symbols whose each kind is the same are arranged in succession and only in a case of top symbols whose payout is the highest under the same condition, the top symbols whose number is larger than the number of top symbols displayed on the base game reel strips are arranged in succession.

As in this configuration, only the symbols contributing to only the payout, whose each kind is the same, are arranged in succession on all of the video reel strips, whereby it is likely that a player recognizes, when seeing the arrangement of the symbols whose each kind is the same in succession, that an award will be easily obtained, as compared with the conventional configuration in which the symbols whose kind is the same are not arranged in succession and are scattered. Moreover, even when a scrolling speed of the video reel strips is increased, it becomes easy to see kinds of scrolled symbols on the display. In addition, regarding the special symbols such as the wild symbols and the feature symbols other than the symbols contributing to only the payout, it is configured that the special symbols whose kind is the same are not arranged in succession on any of the video reel strips. Therefore, it is likely to avoid a display in which while the respective plurality of video reel strips are sequentially stopped on the display, only the wild symbols not simply directly generating any award are arranged in all the areas of the display (if it is configured that four or more wild symbols are arranged in succession, since in the present embodiment, the display has the 4×5 areas, all of the symbols on the display become the wild symbols) and to avoid a confusing display which misleads a player into thinking that a plurality of feature games would be concurrently triggered by seeing a plurality of the feature symbols displayed on the display.

Firstly, the present invention is characterized in that by taking advantage of characteristics of the video reels, the reel strips are changed in the base game and the feature game and on the changed reel strips, the number of the plurality of the symbols which enable the high payout to be obtained and are arranged in succession is increased so as to allow a player to visually recognize an increase in a winning probability.

As the generally known slot machine, known is a slot machine which has: a first prize triggering a feature game which allows a payout to be obtained with a higher probability than in a base game by configuring that a number of feature symbols displayed in symbol arrangement areas on a display which is formed in a matrix-like manner is a predetermined number or more; and a second prize providing a payout when in the base game, a predetermined winning combination is displayed on a line among a plurality of winning lines set over a plurality of reel strips. Secondly, the present invention is characterized in that on the above-mentioned slot machine, even when a number of symbols displayed in the symbol display areas of the plurality of reel strips, while the plurality of reel strips are sequentially stopped and displayed on the display, is the predetermined number or more, in the situation where one of the reel strips is stopped and displayed and the remaining reel strips are still being varied and displayed, a layout of symbols arranged in succession whose number allows neither of the first prize nor the second prize to be determinately displayed is adopted.

The same condition is, for example, that the processor (C) extracts the same payout table in the base game and the feature games based on a display result of a plurality of video reel strips displayed on the display. In addition, (D) upon executing the process of determining the payout based on a value which is predetermined by the payout table and by which an amount of one bet is multiplied and based on an amount of bets actually placed, a value, which is predetermined by the payout table and by which an amount of one bet is multiplied, associated with the top symbols is set to the highest, as compared with values associated with the other symbols.

In addition, in the above-mentioned slot machine, the processor (E) causes a prize enabling shifting to a feature game to occur when a number of feature symbols displayed on the display reaches a predetermined number or more or when a total of the number of said feature symbols and a number of the wild symbols reaches a predetermined number or more, and (F) causes a prize, when predetermined symbols other than the feature symbols are arranged, on the display, on a winning line which is set over a plurality of reels, based on a number of the arranged symbols to occur, on the base game reel strips defined to be used as the respective plurality of video reel strips, the wild symbols and the feature symbols, included in symbols arranged on a single reel of the base game reel strips and displayed on the display, are arranged such that each of a total of the number of the feature symbols and a number of newly resulting feature symbols with which the wild symbols are replaced and the number of only the feature symbols not including the wild symbols is less than a predetermined set succession number of other symbols whose kind is one kind and which are arranged in succession, and on the base game reel strips, symbols which differ from the feature symbols triggering the feature game and cause a prize to occur based on a kind of a combination of the symbols displayed on the winning line and whose number is the predetermined set succession number or more are arranged in succession.

Furthermore, in the slot machine, when the single reel of the base game reel strips has been stopped, the wild symbols and the feature symbols are arranged on the single reel of the base game reel strips such that when symbols displayed on the display include the wild symbols and the feature symbols, the total of the feature symbols and the newly resulting feature symbols with which the wild symbols are replaced is less than the predetermined set succession number, and when the symbols displayed on the display do not include the wild symbols, a number of the feature symbols displayed on the display is less than the predetermined set succession number.

In the present specification, the feature game and the bonus game are the same in meaning. In general, in some countries and manufactures, the feature game is referred to as the bonus game or vice versa.

Hence, according to the present invention, provided is a slot machine which realizes a new design for upgrading a plurality of video reel strips.

BRIEF DESCRIPTION OF THE DRAWINGS

FIG. 5 shows arrangements of symbols depicted on peripheries of base game reel strips in the slot machine according to the embodiment of the present invention;

FIG. 6 shows arrangements of symbols depicted on the peripheries of the base game reel strips in the slot machine according to the embodiment of the present invention;

FIG. 7 shows arrangements of symbols depicted on the peripheries of the base game reel strips in the slot machine according to the embodiment of the present invention;

FIG. 8 shows arrangements of symbols depicted on the peripheries of the base game reel strips in the slot machine according to the embodiment of the present invention;

FIG. 9 shows arrangements of symbols depicted on peripheries of free game reel strips in the slot machine according to the embodiment of the present invention;

FIG. 10 shows arrangements of symbols depicted on the peripheries of the free game reel strips in the slot machine according to the embodiment of the present invention;

FIG. 11 shows arrangements of symbols depicted on the peripheries of the free game reel strips in the slot machine according to the embodiment of the present invention;

FIG. 12 shows arrangements of symbols depicted on the peripheries of the free game reel strips in the slot machine according to the embodiment of the present invention;

FIG. 14 shows a symbol combination table of the slot machine according to the embodiment of the present invention;

FIG. 15 shows a symbol combination table of the slot machine according to the embodiment of the present invention;

FIG. 53 is a diagram explaining the appeal rewriting upon starting the spinning during the free games in the slot machine according to the embodiment of the present invention;

FIG. 54 is a diagram explaining the appeal rewriting upon starting the spinning during the free games in the slot machine according to the embodiment of the present invention;

FIG. 66 is a diagram explaining the RESIDUAL GAMBLE in the slot machine according to the embodiment of the present invention;

FIG. 70 is a diagram explaining the HELP specification in the slot machine according to the embodiment of the present invention;

FIG. 73 is a diagram explaining the placement of the screen touch buttons in the slot machine according to the embodiment of the present invention;

DESCRIPTION OF THE PREFERRED EMBODIMENTS

[Outline of the Present Invention]

Figure 1:
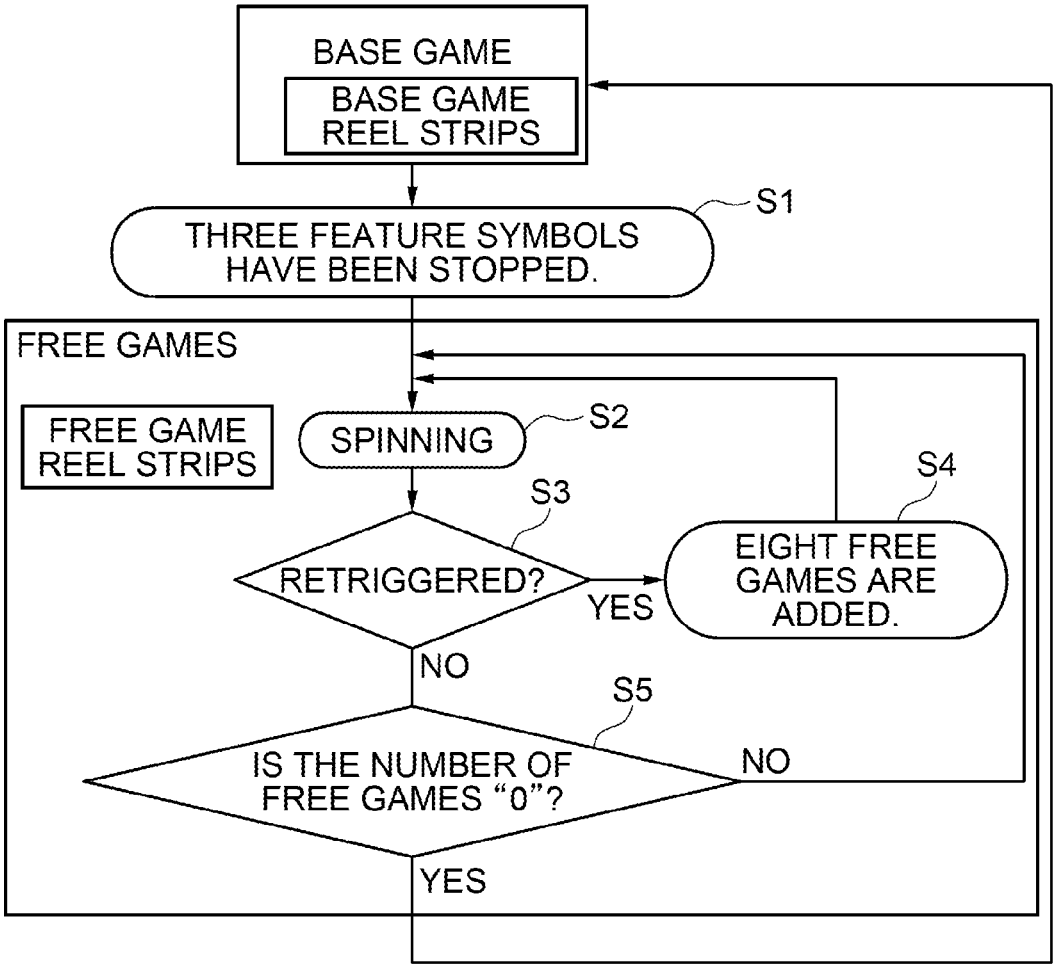
FIG. 1 is a diagram showing an outline of a game flow of a slot machine according to an embodiment of the present invention.

Hereinafter, an embodiment of the present invention will be described with reference to the accompanying drawings. FIG. 1 is a diagram showing an outline of a game flow of a slot machine according to the embodiment of the present invention. As shown in FIG. 1, in the slot machine according to the embodiment of the present invention, a slot game including a base game and free games proceeds.

The slot game is of a line-type. On a display, 50 paylines are set on a screen having a configuration consisting of 4 columns×5 rows. Further, in the slot game, video reels are used. The video reels are composed of five reels. In other words, a first reel, a second reel, a third reel, a fourth reel, and a fifth reel constitute the video reels.

Feature symbols are present on the second reel, the third reel, and the fourth reel. Wild symbols are present on the second reel, the third reel, the fourth reel, and the fifth reel. Top symbols and the other symbols are present on all of the reels. The top symbols and the other symbols are arranged in succession. The top symbols are symbols, whose multiplying factor used for determining a payout is the highest.

During the base game, base game reel strips are used on the respective video reels. During the free games, free game reel strips are used on the respective video reels. On the free game reel strips, the larger number of top symbols are arranged in succession on the respective reels, than in the base game.

In the base game, when three feature symbols have appeared (step S1), eight free games can be obtained.

During the free games, after spinning (step S2), when three feature symbols have appeared again (step S3: YES), retriggering is conducted. Upon the occurrence of the retriggering, eight free games are added (step S4). Thereafter, the game returns to the above-mentioned step S2 and the spinning is conducted again. The number of times at which the retriggering is conducted has no limit. Accordingly, each time the retriggering occurs, eight free games are added (step S4).

In contrast to this, when the three feature symbols have not appeared again (step S3: NO), it is determined whether or not the remaining number of times at which the free game is conducted is zero (step S5). When the remaining number of times at which the free game is conducted is not zero (step S5: NO), the game returns to the above-mentioned step S2 and the free games are continued. On the other hand, when the remaining number of times at which the free game is conducted is zero (step S5: YES), the game returns to the base game.

The slot machine has the above-described configuration, thereby causing the slot game including the base game and the free games to proceed on the display. While the base game is proceeding, the base game reel strips are used. On the base game reel strips, on all of the five reels, symbols whose each kind is the same, other than the feature symbols and the wild symbols, are arranged in succession.

While each of the free games is proceeding, the free game reel strips are used. On the free game reel strips, on all of the five reels, symbols whose each kind is the same, other than the feature symbols and the wild symbols, are arranged in succession and in addition thereto, only in the case of the top symbols whose payout multiplying factor is the highest, the top symbols whose number is larger than the number of top symbols displayed on the base game reel strips are arranged in succession.

In other words, in the base game reel strips and the free game reel strips, the mode in which on all of the five reels, symbols whose each kind is the same, other than the feature symbols and the wild symbols, are arranged in succession is common to each other. In addition, by the mode in which on the free game reel strips, on all of the five reels, symbols whose each kind is the same, other than the feature symbols and the wild symbols, are arranged in succession and in addition thereto, only in the case of the top symbols whose payout multiplying factor is the highest, the top symbols whose number is larger than that of those displayed on the base game reel strips are arranged in succession, the plurality of video reel strips are upgraded.

[Explanation of a Function Flow]

Figure 2:
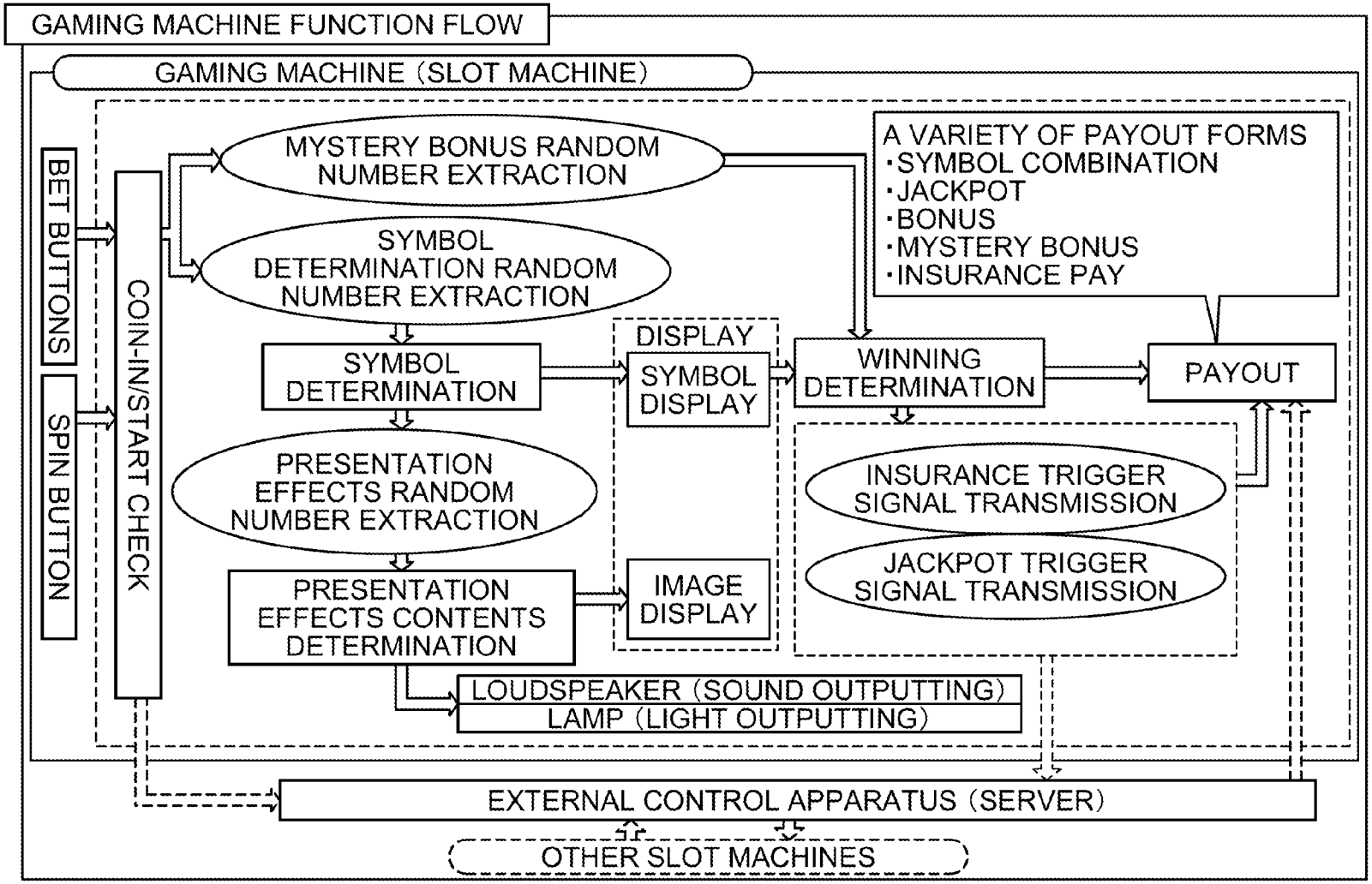
FIG. 2 is a diagram showing a function flow of the slot machine according to the embodiment of the present invention.

With reference to FIG. 2, a basic function of the slot machine according to the embodiment of the present invention will be described. FIG. 2 is a diagram showing a function flow of the slot machine according to the embodiment of the present invention.

<Coin-in/Start-Check>

First, the slot machine checks whether or not any BET button is pressed by a player and subsequently checks whether or not a SPIN button is pressed by a player.

<Determination of Symbols>

Next, when the SPIN button is pressed by a player, the slot machine extracts random number values for determining symbols and determines symbols to be displayed to a player upon stopping of scrolling of symbol columns in accordance with the plurality of video reels displayed on the display.

<Display of Symbols>

Next, the slot machine starts the scrolling of the symbol columns of the respective video reels and stops the scrolling so as to display the determined symbols to a player.

<Winning Determination>

Next, upon stopping the scrolling of the symbol columns of the respective video reels, the slot machine determines whether or not a combination of the symbols displayed to a player is associated with a winning combination.

<Paying-Out>

Next, when the combination of the symbols displayed to a player is the winning combination, the slot machine awards a benefit in accordance with a kind of the combination of these symbols to a player. For example, when a combination of symbols related to a payout of coins is displayed, the slot machine pays out, to a player, coins whose number is in accordance with the combination of the symbols.

In addition, when a combination of symbols related to triggering of a bonus game is displayed, the slot machine initiates the bonus game. In the embodiment of the present invention, as the bonus game, a game (free games) in which a drawing for determining the above-mentioned symbols to be stopped is conducted without consuming coins at a predetermined number of times is conducted.

In addition, when a combination of symbols related to triggering of a jackpot is displayed, the slot machine pays out coins corresponding to a jackpot amount to a player. The jackpot functions such that portions of coins consumed by a player on respective slot machines are accumulated as jackpot amounts and, when the triggering of a jackpot has been achieved on any slot machine, coins corresponding to the accumulated jackpot amounts are paid out to such a slot machine. The slot machine calculates an amount to be accumulated as the jackpot amount each time one game is played (cumulative amount) and transmits the calculated amount to an external control apparatus. The external control apparatus accumulates cumulative amounts transmitted from the respective slot machines as the jackpot amounts.

In addition, in the slot machine, besides the above-mentioned benefit, benefits such as a mystery bonus and insurance are provided. The mystery bonus is to pay out coins corresponding to a predetermined amount upon the occurrence of winning in a dedicated drawing. When the SPIN button is pressed, the slot machine extracts random number values for the mystery bonus and determines, through the drawing, whether or not the triggering of the mystery bonus is to be achieved.

The insurance is a function provided for the purpose of helping a player who is in the situation where any bonus game is not conducted for a long period of time. In the embodiment of the present invention, whether or not the insurance is made active can be arbitrarily selected by a player. In exchange for a predetermined insurance purchase amount, the insurance is made active. When the insurance is made active, the slot machine starts counting of the number of times of games played. When without a large amount being paid out by the bonus game and the like, the counted number of times of the games played reaches a predetermined number of times, the slot machine pays out coins corresponding to an amount which has been set for the insurance.

<Determination of Presentation Effects>

The slot machine performs presentation effects through displaying of images using the display, outputting of light using a lamp, and outputting of sound using a loudspeaker. The slot machine extracts random number values for the presentation effects and based on symbols, determined through a drawing, and the like, determines contents of the presentation effects.

[The Whole of Game System]

Figure 3:
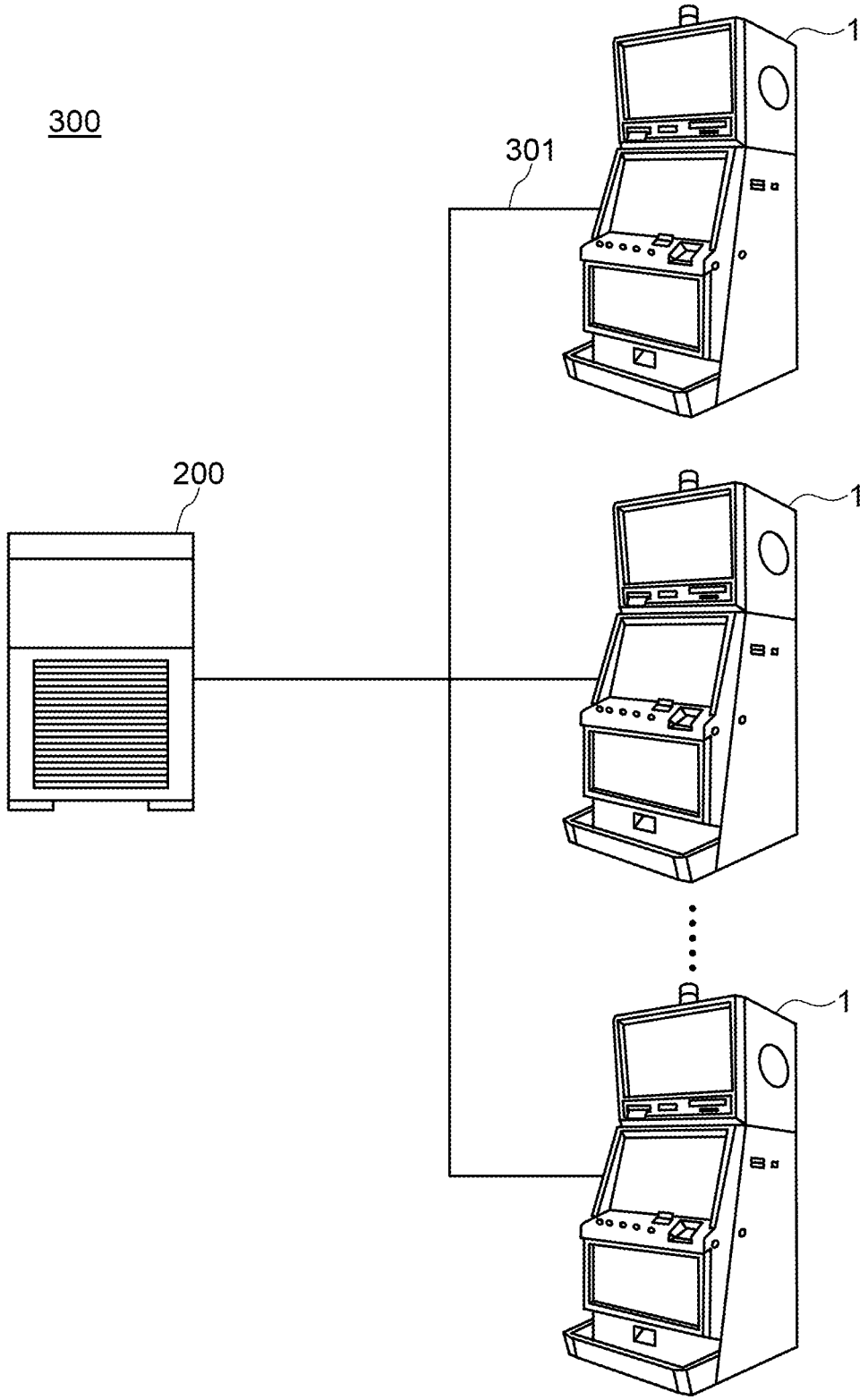
FIG. 3 is a diagram illustrating the game system including the slot machine according to the embodiment of the present invention.

The basic function of the slot machine is as described above. Next, with reference to FIG. 3, a game system including the slot machines will be described. FIG. 3 is a diagram illustrating the game system including the slot machines according to the embodiment of the present invention.

The game system 300 includes: a plurality of slot machines 1 and an external control apparatus 200 connected to the respective slot machines 1 via a communication line 301.

The external control apparatus 200 controls the plurality of slot machines 1. In the embodiment of the present invention, the external control apparatus 200 is the so-called hall server installed in a gaming house having the plurality of slot machines 1. Each of the slot machines 1 is provided with a unique identification number, and the external control apparatus 200 identifies a source of data transmitted from each of the slot machines 1 using each of the identification numbers. In addition, also when data is transmitted from the external control apparatus 200 to each of the slot machines 1, each of the identification numbers is used to designate a destination.

The game system 300 may be structured in one gaming house such as a casino or may be structured among a plurality of gaming houses. In addition, when the game system 300 is structured in one gaming house, the game system 300 may be structured in each floor or section of the gaming house. The communication line 301 may be either wired or wireless, and a dedicated line, a switched line, or the like can be employed as the communication line.

[Overall Structure of Slot Machine]

Figure 4:
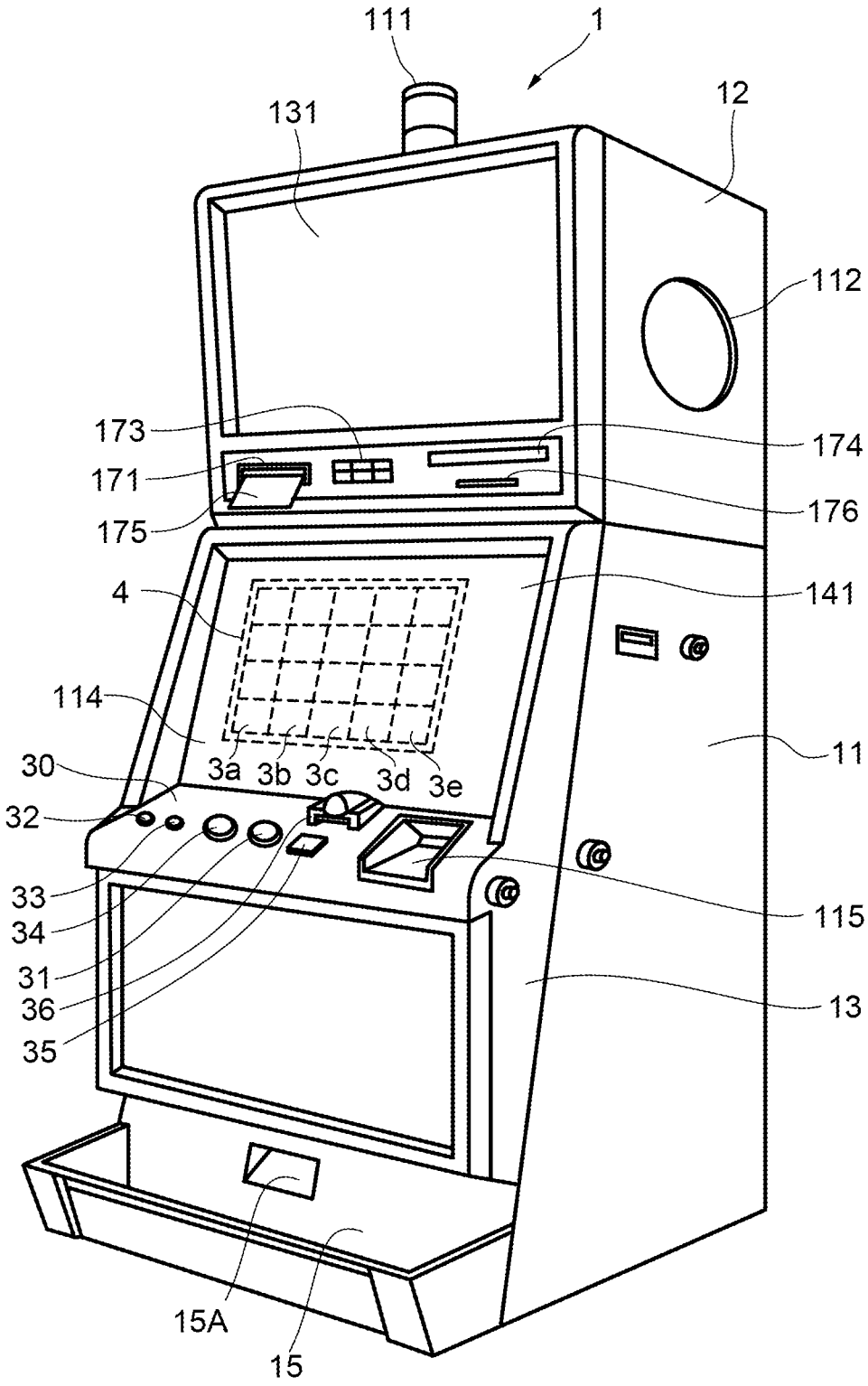
FIG. 4 is a diagram illustrating an overall structure of the slot machine according to the embodiment of the present invention

The game system according to the embodiment of the present invention is as described above. Next, with reference to FIG. 4, an overall structure of the slot machine 1 will be described. FIG. 4 is a drawing illustrating the overall structure of the slot machine according to the embodiment of the present invention.

On the slot machine 1, as gaming media, coins, bills, or electronic valuable information corresponding the coins or the bills is used. In addition, in the embodiment of the present invention, the later-described ticket having a bar code is also used. The gaming media are not limited thereto, and for example, medals, tokens, and electronic money may be adopted.

The slot machine 1 includes: a cabinet 11; a top box 12 installed on an upper side of the cabinet 11; and a main door 13 provided on a front face of the cabinet 11.

In the central portion of the main door 13, a lower side image display panel 141 is provided. The lower side image display panel 141 is formed of a liquid crystal panel, constituting the display. The lower side image display panel 141 has a symbol display area 4. In the symbol display area 4, five video reels 3 (3*a*, 3*b*, 3*c*, 3*d*, and 3*e*) are displayed. In the embodiment of the present invention, the video reels are to represent, with images, motions of rotation and stoppage of mechanical reels whose peripheries have a plurality of symbols depicted thereon. Each of respective symbol columns composed of a predetermined plurality of symbols is assigned to each of the video reels 3 (refer to FIG. 5 later described).

In the symbol display area 4, the respective symbol columns assigned to the respective video reels 3 are each scrolled and after a predetermined lapse of time, are stopped. As a result, a part of each of the respective symbol columns (in the embodiment of the present invention, four symbols) are displayed to a player. In the symbol display area 4, on each of the video reels 3, each one symbol is displayed in each of four areas in an upper row, a middle upper row, a middle lower row, and a lower row. In other words, in the symbol display area 4, 20 symbols, 4 symbols/column×5 symbols/row, are displayed.

In the embodiment of the present invention, any of the above-mentioned four areas is selected in accordance with each of the respective video reels 3, and the respective selected areas are connected to form a line, which is defined as a payline. A specific form of the payline can be arbitrarily adopted. However, for example, besides a linear line formed by connecting the respective areas in the middle upper row in accordance with the respective video reels 3, a V-shaped line, a bent-shape line, and the like can be adopted. In addition, as to the number of paylines, although in the embodiment of the present invention, the number of paylines are 50, as the number of paylines, for example, 30 and the like can be arbitrarily adopted.

In addition, in the lower side image display panel 141, a touch panel 114 is built-in. A player can input a variety of instructions by touching the lower side image display panel 141.

Below the lower side image display panel 141, a variety of buttons placed on a control panel 30 and a variety of devices to be operated by a player are located.

A SPIN button 31 is used upon starting the scrolling of the symbol columns of the respective video reels 3. A CHANGE button 32 is used upon requesting exchange from a gaming house employee. A CASHOUT button 33 is used upon paying out coins deposited inside the slot machine 1 to a coin tray 15.

A 1-BET button 34 and a MAX BET button 35 are to determine the number of coins (hereinafter, referred to as the number of BETs) used in gaming from coins deposited inside the slot machine 1. The 1-BET button 34 is used upon determining the above-mentioned number of BETs in a unit of one coin. The MAX BET button 35 is used upon selecting a predefined upper limit number as the above-mentioned number of BETs.

A coin receiving slot 36 is provided to receive coins. A bill validator 115 is provided to receive bills. A bill validator 115 identifies whether or not each bill is legitimate and receives legitimate bills into the cabinet 11. The bill validator 115 may be configured to be capable of reading the later-described ticket having a bar code 175.

On a front face of the top box 12, an upper side image display panel 131 is provided. The upper side image display panel 131 is composed of a liquid crystal panel, constituting the display. On the upper side image display panel 131, images related to the presentation effects and images which indicate introduction of contents of games and explanation of rules of the games are displayed. In addition, on the top box 12, a loudspeaker 112 and a lamp 111 are provided. On the slot machine 1, the presentation effects are conducted by displaying images, outputting sound, and outputting light.

Below the upper side image display panel 131, a ticket printer 171, a card slot 176, a data indicator 174, and a keypad 173 are provided.

The ticket printer 171 is to print onto a ticket a bar code in which data such as the number of credit, time and date, and an identification number of a slot machine 1 is coded and output the ticket as a ticket having a bar code 175. A player can cause the slot machine to read out the ticket having a bar code 175 to play a game and can exchange the ticket having a bar code 175 for bills and the like at a predetermined place of a gaming house (for example, a cashier within a casino), The card slot 176 is to insert a card having predetermined data stored thereon thereinto. For example, a card has stored thereon data for identifying a player and data related to a history of games played by a player. On the card inserted into the card slot 176, data reading and data writing are conducted by the later-described card reader 172. The card may have data corresponding to coins, bills, or a credit stored thereon.

The data indicator 174 is composed of a fluorescent display, an LED, or the like and is to display, for example, data read by the card reader 172 and data inputted by a player via the keypad 173. The keypad 173 is to input instructions and data related to issuance of a ticket and the like.

[Symbol Columns of Video Reels]

The overall structure of the slot machine 1 is as described above. Next, with reference to FIG. 5 to FIG. 12, a configuration of the symbol columns which the video reels 3 of the slot machine 1 have will be described. Each of FIG. 5 to FIG. 8 shows arrangements of symbols depicted on the peripheries of the base game reel strips in the slot machine according to the embodiment of the present invention. Each of FIG. 9 to FIG. 12 shows arrangements of symbols depicted on the peripheries of the free game reel strips in the slot machine according to the embodiment of the present invention.

As shown in FIG. 5 to FIG. 8, to a first video reel ("Reel 1") 3*a* of the base game reel strips, symbol columns composed of 84 symbols corresponding to code Nos. "00" to "83" are assigned. To a second video reel ("Reel 2") 3*b* of the base game reel strips, symbol columns composed of 131 symbols corresponding to code Nos. "00" to "130" are assigned. To a third video reel ("Reel 3") 3*c* of the base game reel strips, symbol columns composed of 130 symbols corresponding to code Nos. "00" to "129" are assigned. To a fourth video reel ("Reel 4") 3*d* of the base game reel strips, symbol columns composed of 133 symbols corresponding to code Nos. "00" to "132" are assigned. To a fifth video reel ("Reel 5") 3*e* of the base game reel strips, symbol columns composed of 127 symbols corresponding to code Nos. "00" to "126" are assigned.

As shown in FIG. 9 to FIG. 12, to a first video reel ("Reel 1") 3*a* of the free game reel strips, symbol columns composed of 92 symbols corresponding to code Nos. "00" to "91" are assigned. To a second video reel ("Reel 2") 3*b* of the free game reel strips, symbol columns composed of 139 symbols corresponding to code Nos. "00" to "138" are assigned. To a third video reel ("Reel 3") 3*c* of the free game reel strips, symbol columns composed of 138 symbols corresponding to code Nos. "00" to "137" are assigned. To a fourth video reel ("Reel 4") 3*d* of the free game reel strips, symbol columns composed of 141 symbols corresponding to code Nos. "00" to "140" are assigned. To a fifth video reel ("Reel 5") 3*e* of the free game reel strips, symbol columns composed of 135 symbols corresponding to code Nos. "00" to "134" are assigned.

Among symbols, there are symbols of a first kind (the so-called scatter symbols) which may result in winning when a number of the symbols of the first kind displayed on the display is greater than or equal to a predetermined number; and symbols of a second kind which may result in winning when a combination of the symbols of the second kind arranged on an activated line is a predetermined combination. When the winning by the symbols of the first kind occurs, the game shifts to a feature game. In other words, at the time point when the symbols of the first kind whose number is greater than or equal to the predetermined number are displayed on the display, the winning is determined and the game shifts to the feature game (free games). When the winning by the symbols of the second kind occurs, a payout in accordance with a number of the arranged symbols is provided.

In a case where the symbols of the first kind whose number is greater than or equal to the number which results in the winning are arranged in succession on one of the reels, when the reels are stopped (when the symbols are rearranged), a portion where the symbols of the first kind are arranged in succession is displayed and the winning thereby occurs only on that one reel. Accordingly, when the winning is determined despite the other reels being scrolling, it is likely that a player loses interest in the game. Therefore, with respect to the symbols of the first kind, it is necessary to avoid the above-mentioned situation.

On the other hand, with respect of the symbols of the second kind, payouts are different from one another depending on the numbers of the displayed symbols. For example, when three symbols of the second kind are displayed, a payout corresponding to the three symbols is provided, and when five symbols of the second kind are displayed, a payout corresponding to the five symbols is provided. In this case, since a payout cannot be determined until the scrolling of all of the reels is finished, a player does not lose interest in the game.

Therefore, it is necessary to arrange the symbols of the first kind in succession so as to avoid the winning by the symbols of the first kind. For example, the symbols of the second kind are arranged such that a number of the symbols of the second kind arranged in succession on one of the reels is greater than or equal to a number of the symbols of the first kind arranged in succession on the one of the reels.

As kinds of symbols, "WILD", "GOLD", "BLUE", "RED", "WHITE", "BLACK", "ACE", "KING", "QUEEN", "JACK", "TEN", "NINE", and "FEATURE" are provided.

The symbol "FEATURE" is an example of the above described first kind symbol. Each of the symbols "GOLD", "BLUE", "RED", "WHITE", "BLACK", "ACE", "KING", "QUEEN", "JACK", "TEN", and "NINE" is an example of the above described second kind symbol.

The symbol "FEATURE" is present on the second video reel ("Reel 2") 3*b*, the third video reel ("Reel 3") 3*c*, and the fourth video reel ("Reel 4") 3*d*. The symbol "WILD" is present on the second video reel ("Reel 2") 3*b*, the third video reel ("Reel 3") 3*c*, the fourth video reel ("Reel 4") 3*d*, and the fifth video reel ("Reel 5") 3*e*. Each of the symbols "GOLD", "BLUE", "RED", "WHITE", "BLACK", "ACE", "KING", "QUEEN", "JACK", "TEN", and "NINE" is present on the first video reel ("Reel 1") 3*a*, the second video reel ("Reel 2") 3*b*, the third video reel ("Reel 3") 3*c*, the fourth video reel ("Reel 4") 3*d*, and the fifth video reel ("Reel 5") 3*e*. In other words, each of the symbols "GOLD", "BLUE", "RED", "WHITE", "BLACK", "ACE", "KING", "QUEEN", "JACK", "TEN", and "NINE" is present on all of the video reels 3 *a* to 3*e*. The symbols "GOLD", "BLUE", "RED", "WHITE", "BLACK", "ACE", "KING", "QUEEN", "JACK", "TEN", and "NINE" are arranged in succession. The symbols "GOLD" are the top symbols whose payout multiplying factor used for determining a payout is the highest, as described later. On the respective video reels, the symbols "FEATURE" are dispersed on a one-by-one basis and are allocated so as to be spaced at intervals of four symbols or more as a number of displayed symbols. In addition, on the respective video reels, the symbols "WILD" are dispersed on a one-by-one basis and are allocated so as to be spaced at intervals of four symbols or more as a number of displayed symbols. In this respect, the base game reel strips and the free game reel strips are the same as each other.

On the base game reel strips, the wild symbols and the feature symbols, included in symbols placed on a single reel of the base game reel strips and displayed on the display, are arranged such that each of a total of the number of the feature symbols and a number of newly resulting feature symbols with which the wild symbols are replaced and the number of only the feature symbols not including the wild symbols is less than a predetermined set succession number of other symbols whose kind is one kind and which are arranged in succession.

On the base game reel strips, symbols which differ from the feature symbols triggering a feature game and cause a prize to occur based on a combination of the symbols displayed on the winning line and whose number is the predetermined set succession number or more are arranged.

Further, as shown in FIG. 5 to FIG. 12, on the first video reel ("Reel 1") 3*a* of the free game reel strips, a large number of top symbols "GOLD" are arranged in succession, as compared with the first video reel ("Reel 1") 3*a* of the base game reel strips. This respect is the same as on the second video reel ("Reel 2") 3*b*, the third video reel ("Reel 3") 3*c*, the fourth video reel ("Reel 4") 3*d*, and the fifth video reel ("Reel 5") 3*e* of the free game reel strips.

[Configuration of Circuitry Included in Slot Machine]

Figure 13:
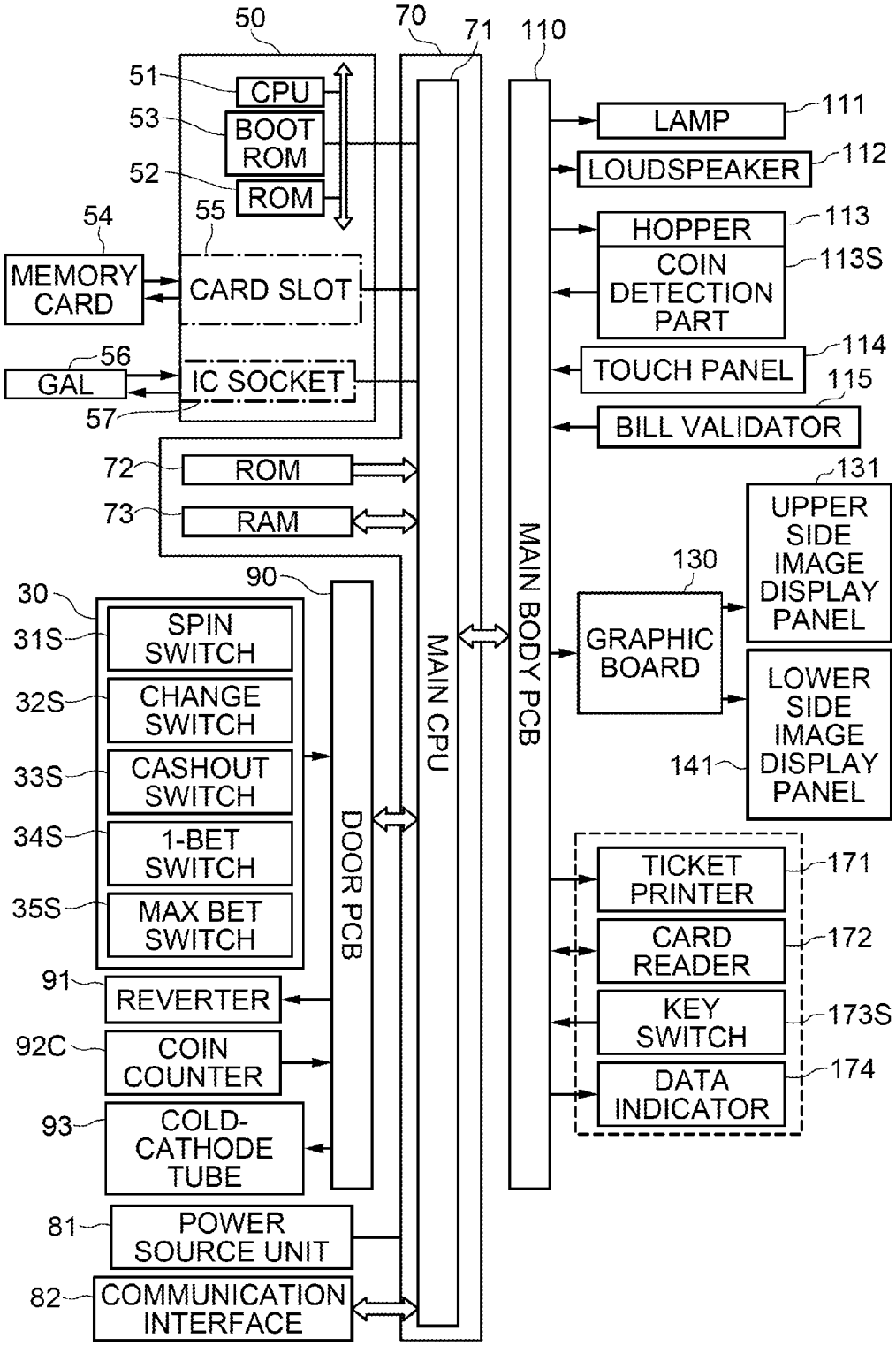
FIG. 13 is a block diagram illustrating an internal configuration of the slot machine according to the embodiment of the present invention.

The configuration of the symbol columns which the video reels 3 of the slot machine 1 have is as described above. Next, with reference to FIG. 13, a configuration of circuitry which the slot machine 1 includes will be described. FIG. 13 is a block diagram illustrating an internal configuration of the slot machine according to the embodiment of the present invention.

A gaming board 50 includes: a CPU 51, a ROM 52, and a boot ROM 53, which are connected to one another by an internal bus; a card slot 55 associated with a memory card 54; and an IC socket 57 associated with a GAL (Generic Array Logic) 56.

The memory card 54 is composed of a nonvolatile memory and has a game program and a game system program stored thereon. The game program includes a program related to game proceeding, a drawing program, and a program for executing presentation effects by images and sounds (for example, refer to FIG. 16 to FIG. 25 described later). In addition, the above-mentioned game program includes data (refer to FIG. 5 to FIG. 12) which defines the configuration of the symbol columns assigned to the respective video reels 3.

The drawing program is to determine symbols on the respective video reels 3, which are scheduled to be stopped, by a drawing. The data pertinent to the symbols scheduled to be stopped is data for determining four symbols displayed in the symbol display area 4 from the plurality of symbols constituting each of the symbol columns. The slot machine 1 according to the embodiment of the present invention determines symbols displayed in predetermined areas (for example, the areas in the upper row) among the four areas associated with each of the video reels 3 as the symbols scheduled to be stopped.

The above-mentioned drawing program includes symbol determination data. The symbol determination data is to define random number values in accordance with each of the video reels 3 such that each of the plurality of symbols constituting each of the symbol columns is determined with an equal probability. For example, in a case of the first video reel ("Reel 1") 3*a* of the base game reel strips, by using the symbol determination data, random number values are determined such that each of the 84 symbols (code Nos. "00" to "83") is determined with the equal probability (specifically, 1/84). However, since the numbers of the respective kinds of the symbols included in the 84 symbols are different, probabilities with which the respective kinds of the symbols are determined are different from one another (in other words, weights are yielded). For example, with reference to FIG. 5 to FIG. 8, the number of the symbols "GOLD" included in the symbol column of the first video reel ("Reel 1") 3*a* of the base game reel strips is 12 whereas the number of the symbols "ACE" included in the symbol column of the first video reel ("Reel 1") 3*a* of the base game reel strips is 4. Accordingly, the former is determined with a probability of "12/84" whereas the latter is determined with a probability of "4/84".

In the embodiment of the present invention, the data is defined such that the numbers of the kinds of the symbols constituting the respective symbol columns are different from one another in accordance with each of the video reels 3. However, the numbers of the kinds of the symbols constituting the respective symbol columns may be the same as one another. For example, each of all of the symbol columns of the video reels 3*a* to 3*e* of the base game reel strips and the free game reel strips may be configured so as to be formed of 22 symbols. Thus, a degree of freedom upon setting probabilities with which the respective kinds of symbols are determined in accordance with each of the video reels 3 is increased.

In addition, the card slot 55 is configured such that the memory card 54 can be inserted thereto and pulled out therefrom and is connected to a mother board 70 by an IDE bus.

The GAL 56 is a kind of a PLD (Programmable Logic Device) having a fixed OR array architecture. The GAL 56 includes a plurality of input ports and output ports and when each of the input ports has received a predetermined input, corresponding data is outputted from each of the output ports.

In addition, the IC socket 57 is configured such that the GAL 56 is detachable and is connected to the mother board 70 by a PCI bus. The memory card 54 is replaced with a memory card having another program written thereon or the program written on the memory card 54 is replaced with another program, thereby allowing the contents of a game played on each of the slot machines 1 to be changed.

The CPU 51, the ROM 52, and the boot ROM 53 connected to one another by the internal bus are connected to the mother board 70 by the PCI bus. The PCI bus transmits signals between the mother board 70 and the gaming board 50 and supplies power from the mother board 70 to the gaming board 50.

The ROM 52 has an authentication program stored thereon. The boot ROM 53 has stored thereon an auxiliary authentication program, a program (boot code) for allowing the CPU 51 to activate the auxiliary authentication program, and the like. The authentication program is a program (tampering check program) for authenticating the game program and the game system program. The auxiliary authentication program is a program for authenticating the above-mentioned authentication program. The authentication program and the auxiliary authentication program are written along a procedure (authentication procedure) for authenticating that a targeted program is not tampered.

The mother board 70 includes: a main CPU 71, a ROM 72, a RAM 73, and a communication interface 82.

The ROM 72 is composed of a memory device such as a flash memory and has stored thereon a program such as a BIOS (Basic Input/Output System) executed by the main CPU 71 and permanent data. When the BIOS is executed by the main CPU 71, an initialization process for predetermined peripheral devices is conducted. In addition, via the gaming board 50, a process for loading the game program and the game system program stored on the memory card 54 is started.

The RAM 73 has stored thereon data and programs used when the main CPU 71 operates. For example, when the process for loading the above-described game program and game system program and the authentication program is conducted, these can be stored thereon. In addition, the RAM 73 is provided with working areas for executing each of the above-mentioned programs. For example, provided are an area for storing the number of games, the number of BETs, the number of payouts, the number of credits, and the like and an area for storing symbols (code Nos.) determined by a drawing.

A communication interface 82 is to communicate with the external control apparatus 200 such as a server via the communication line 301. In addition, connected to the mother board 70 by USBs are the later-described door PCB (Printed Circuit Board) 90 and main body PCB 110. Further, connected to the mother board 70 is a power source unit 81. When power is supplied from the power source unit 81 to the mother board 70, the main CPU 71 of the mother board 70 is activated and the power is supplied to the gaming board 50 via the PCI bus, thereby activating the CPU 51.

Connected to the door PCB 90 and the main body PCB 110 are input devices such as switches and sensors; and peripheral devices whose operations are controlled by the main CPU 71. Connected to the door PCB 90 are a control panel 30, a reverter 91, a coin counter 92C, and a cold-cathode tube 93.

The control panel 30 is provided with a SPIN switch 31S, a CHANGE switch 32S, a CASHOUT switch 33S, a 1-BET switch 34S, and a MAX BET switch 35S so as to correspond to the above-described respective buttons. Each of the switches detects that each of the corresponding buttons is pressed by a player and outputs a signal to the main CPU 71.

A coin counter 92C makes a selection to determine whether or not a material, a shape, and the like of each of the coins inputted into the coin receiving slot 36 are appropriate. Upon detecting each appropriate coin, the coin counter 92C outputs a signal to the main CPU 71. In addition, inappropriate coins are discharged from a coin payout opening 15A.

The reverter 91 operates based on a control signal outputted from the main CPU 71 and distributes the appropriate coins selected by the coin counter 92C to a hopper 113 or a cashbox (not shown). When the hopper 113 is not filled with the coins, the appropriate coins are distributed to the hopper 113 and when the hopper 113 is filled with the coins, the appropriate coins are distributed to the cashbox.

A cold-cathode tube 93 functions as a backlight installed on a side of back surfaces of the upper side image display panel 131 and the lower side image display panel 141 and lights up based on a control signal outputted from the main CPU 71.

Connected to the main body PCB 110 are the lamp 111, the loudspeaker 112, the hopper 113, a coin detection part 113S, the touch panel 114, the bill validator 115, a graphic board 130, the ticket printer 171, the card reader 172, a key switch 173S, and the data indicator 174.

The lamp 111 lights up based on a control signal outputted from the main CPU 71. The loudspeaker 112 outputs sound such as BGM based on a control signal outputted from the main CPU 71.

The hopper 113 operates based on a control signal outputted from the main CPU 71 and pays out coins, whose payout number is designated, from the coin payout opening 15A to the coin tray 15. The coin detection part 113S detects the coins provided by the hopper 113 and outputs a signal to the main CPU 71.

The touch panel 114 detects a position touched by a finger or the like of a player on the lower side image display panel and outputs a signal corresponding to the detected position to the main CPU 71. The bill validator 115, upon accepting each legitimate bill, outputs a signal in accordance with an amount of the accepted bill to the main CPU 71.

The graphic board 130 controls a display of images, performed by each of the upper side image display panel 131 and the lower image display panel 141, based on a control signal outputted from the main CPU 71. In the symbol display area 4 of the lower side image display panel 141, the five video reels 3 are displayed, and motions of the scrolling and the stoppage of the symbol columns which the respective video reels 3 have are displayed. The graphic board 130 includes a VDP for generating image data, a video RAM for storing the image data generated by the VDP, and the like.

In addition, the graphic board 130 includes the VDP (Video Display Processor) for generating image data based on a control signal outputted from the main CPU 71, the video RAM for temporarily storing the image data generated by the VDP, and the like. The image data used when the image data is generated by the VDP is included in the game program read out from the memory card 54 and stored in the RAM 73.

The ticket printer 171 prints onto a ticket a bar code, in which data such as the number of credits stored on the RAM 73, time and date, and an identification number of a slot machine 1 is coded, based on a control signal outputted from the main CPU 71 and outputs the ticket as a ticket having a bar code 175.

The card reader 172 reads out data stored on a card inserted into the card slot 176, transmits the data to the main CPU 71, and writes the data based on a control signal from the main CPU 71.

The key switch 173S is provided on the keypad 173 and, when the keypad 173 is operated by a player, outputs a predetermined signal to the main CPU 71.

The data indicator 174 displays the data read out by the card reader 172 and the data inputted by a player via the keypad 173, based on a control signal outputted from the main CPU 71.

[Configuration of Symbol Combination Table]

The configuration of the circuitry of the slot machine 1 is as described above. Next, with reference to FIG. 14 and FIG. 15, symbol combination tables will be described. FIG. 14 and FIG. 15 show symbol combination tables of the slot machine according to the embodiment of the present invention.

The symbol combination tables define symbol combinations and the numbers of payouts associated with winning. On the slot machine 1, when the scrolling of the symbol columns of the respective video reels 3 is stopped and a combination of symbols displayed on a payline matches any combination of symbols defined in the symbol combination tables, winning occurs. In accordance with the winning, a player is provided with a benefit such as a payout of coins and initiation of a bonus game. When a combination of symbols displayed on a payline does not match any of the combinations of symbols defined in the symbol combination tables, no winning occurs (that is, losing occurs).

Basically, with respect to the respective kinds of the symbols "GOLD", "BLUE", "RED", "WHITE", "BLACK", "ACE", "KING", "QUEEN", "JACK", "TEN", and "NINE", also when three, four, or five symbols of one kind among the above-mentioned kinds are displayed on a payline by the video reels 3, winning occurs. In addition, with respect to the kinds of the symbols "GOLD", "BLUE", "RED", "WHITE", and "BLACK", two symbols of one kind among the above-mentioned kinds are displayed on a payline by the video reels 3, winning occurs. These wins are associated with LINE payouts, resulting in multiplication of BET PER LINE. The symbols "WILD" are substituted with the kinds of the symbols "GOLD", "BLUE", "RED", "WHITE", "BLACK", "ACE", "KING", "QUEEN", "JACK", "TEN", and "NINE".

For example, when in the base game and the free games, the symbols "GOLD" are displayed together on a payline by all of the video reels 3, "100" is determined as the number of a payout. This win is a LINE payout, and a value of BET PER LINE is multiplied by this "100". Coins whose number is based on the result of the multiplication are paid out. The paying-out of the coins is conducted by actually discharging the coins from the coin payout opening 15A, by adding a value of the result of the multiplication to the number of credits or by issuing a bar code ticket.

The number of a payout (payout multiplying factor) of the symbols "GOLD" is the largest under the same condition, as compared with that of each of the kinds of symbols "BLUE", "RED", "WHITE", "BLACK", "ACE", "KING", "QUEEN", "JACK", "TEN", and "NINE". Accordingly, the symbols "GOLD" are top symbols. For example, when the winning combination including the symbols "GOLD" occurs on an activated line, among the paylines, on which a player places a bet (upon the occurrence of the winning combination) and the number of the bet placed on the activated line is 5, a magnitude of a prize is determined by calculating "5 (the number of the bet)×100 (the multiplying factor)", and then, a credit of 500 is paid out.

The symbols "FEATURE" are symbols related to the triggering of a bonus game. When three symbols "FEATURE" are displayed by the second video reel ("Reel 2") 3*b*, the third video reel ("Reel 3") 3*c*, and the fourth video reel ("Reel 4") 3*d*, "2" is determined as the number of a payout of a scatter pay. A value of TOTAL BET is multiplied by a value of this SCATTER payout. Starting from the next game, the bonus game (free games) is initiated. Also when a total of the number of the displayed symbols "FEATURE" and the number of the displayed symbols "WILD" is a predetermined number (for example, 3), "2" is determined as the number of a payout of the scatter pay. Starting from the next game, the bonus game (free games) is initiated. However, when the three symbols "FEATURE" are displayed, this winning is not that of the LINE payout for which a value of BET PER LINE is multiplied by the number of a payout. No winning of the LINE payout occurs in association with the symbols "FEATURE". In addition, no winning of the LINE payout occurs by replacing the symbols "WILD" with the symbols "FEATURE".

When a predetermined combination composed of symbols of any of the kinds of symbols "GOLD", "BLUE", "RED", "WHITE", "BLACK", "ACE", "KING", "QUEEN", "JACK", "TEN", and "NINE" is displayed on a payline, a jackpot trigger occurs and a jackpot amount is determined as the number of a payout.

[Contents of Programs]

The symbol combination tables are as described above. Next, with reference to FIG. 16 to FIG. 25, programs executed by the slot machine 1 will be described.

<Main Control Processes>

Figure 16:
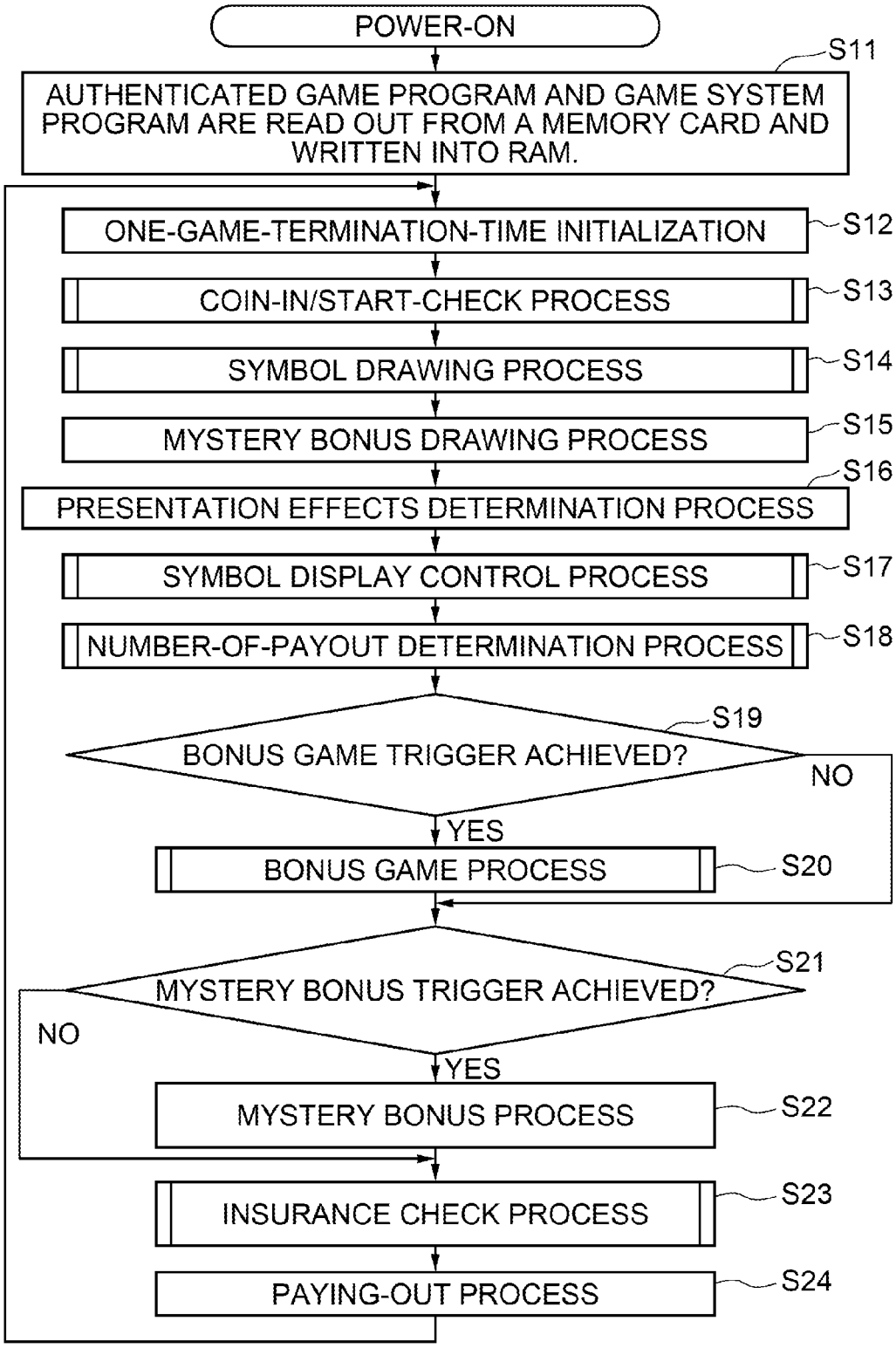
FIG. 16 shows a flowchart of a main control process in the slot machine according to the embodiment of the present invention.

First, with reference to FIG. 16, main control processes will be described. FIG. 16 shows a flowchart of the main control processes of the slot machine according to the embodiment of the present invention.

First, when the slot machine 1 is powered on, the main CPU 71 reads out an authenticated game program and an authenticated game system program from the memory card 54 via the gaming board 50 and writes the programs into the RAM 73 (step S11).

Next, the main CPU 71 conducts a one-game-termination-time initialization process (step S12). For example, data such as symbols determined by the number of BETs and a drawing, which becomes unnecessary in a work area of the RAM 73 upon the termination of each one game played, is cleared.

Figure 17:
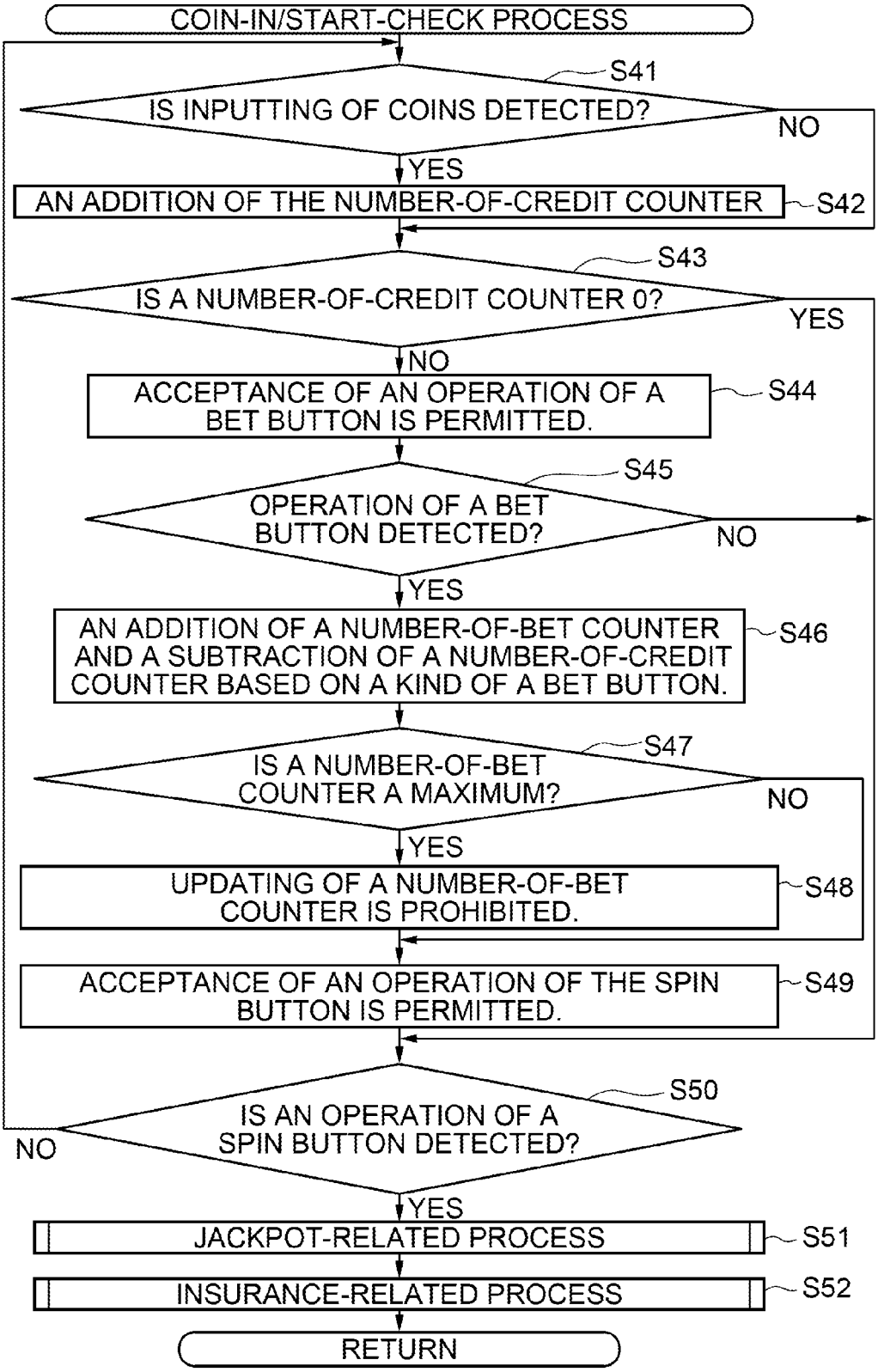
FIG. 17 shows a flowchart of a coin-in/start-check process in the slot machine according to the embodiment of the present invention.

Next, the main CPU 71 conducts a coin-in/start-check process described later with reference to FIG. 17 (step S13). In this process, inputting of the BET switch and the SPIN switch is checked.

Figure 20:
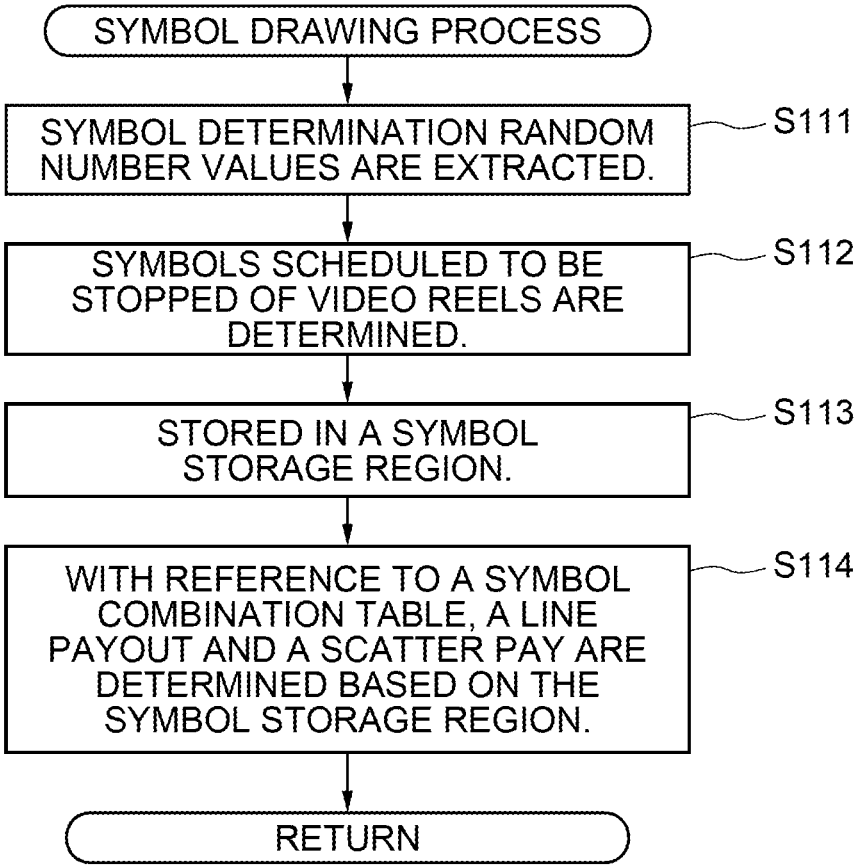
FIG. 20 shows a flowchart of a symbol drawing process in the slot machine according to the embodiment of the present invention.

Next, the main CPU 71 conducts a symbol drawing process described later with reference to FIG. 20 (step S14). In this process, based on symbol determination random number values, symbols scheduled to be stopped are determined.

Next, the main CPU 71 conducts a mystery bonus drawing process (step S15). In this process, a drawing to determine whether or not a mystery bonus trigger is achieved is conducted. For example, the main CPU 71 extracts a mystery bonus random number value from a range of "0 to 99" and, when the extracted random number value is "0", it is determined that the mystery bonus trigger is achieved.

Next, the main CPU 71 conducts a presentation effects contents determination process (step S16). The main CPU 71 extracts a presentation effects random number value and determines any of a predetermined plurality of presentation effects contents by a drawing.

Figure 21:
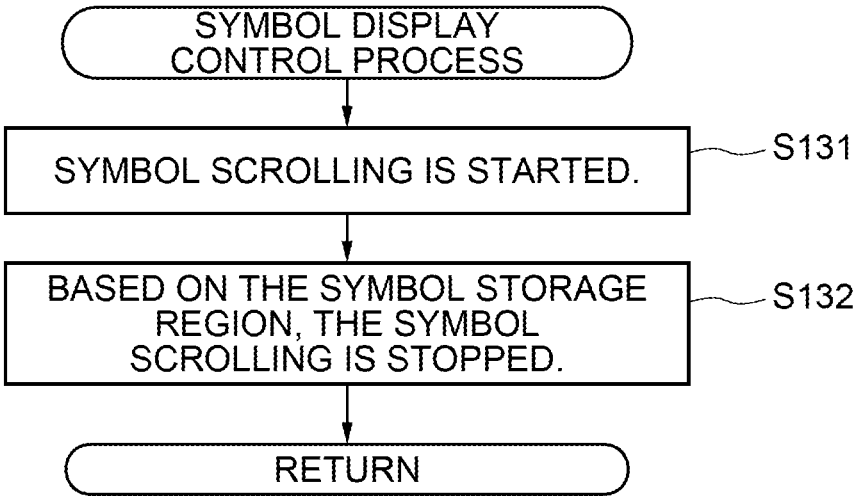
FIG. 21 shows a flowchart of a symbol display control process in the slot machine according to the embodiment of the present invention.

Next, the main CPU 71 conducts a symbol display control process described later with reference to FIG. 21 (step S17). In this process, the scrolling of the symbol columns of the respective video reels 3 is started and the symbols scheduled to be stopped, which are determined in the symbol drawing process at step S14, are stopped in predetermined positions (for example, areas in the upper row of the symbol display area 4). In other words, four symbols including the symbol scheduled to be stopped are displayed in the symbol display area 4. For example, when the symbol scheduled to be stopped is a symbol associated with a code number "10" and is to be displayed in the upper row, symbols associated with code Nos. "11", "12", and "13" are displayed in the middle upper row, the middle lower row, and the lower row in the symbol display area 4.

Figure 22:
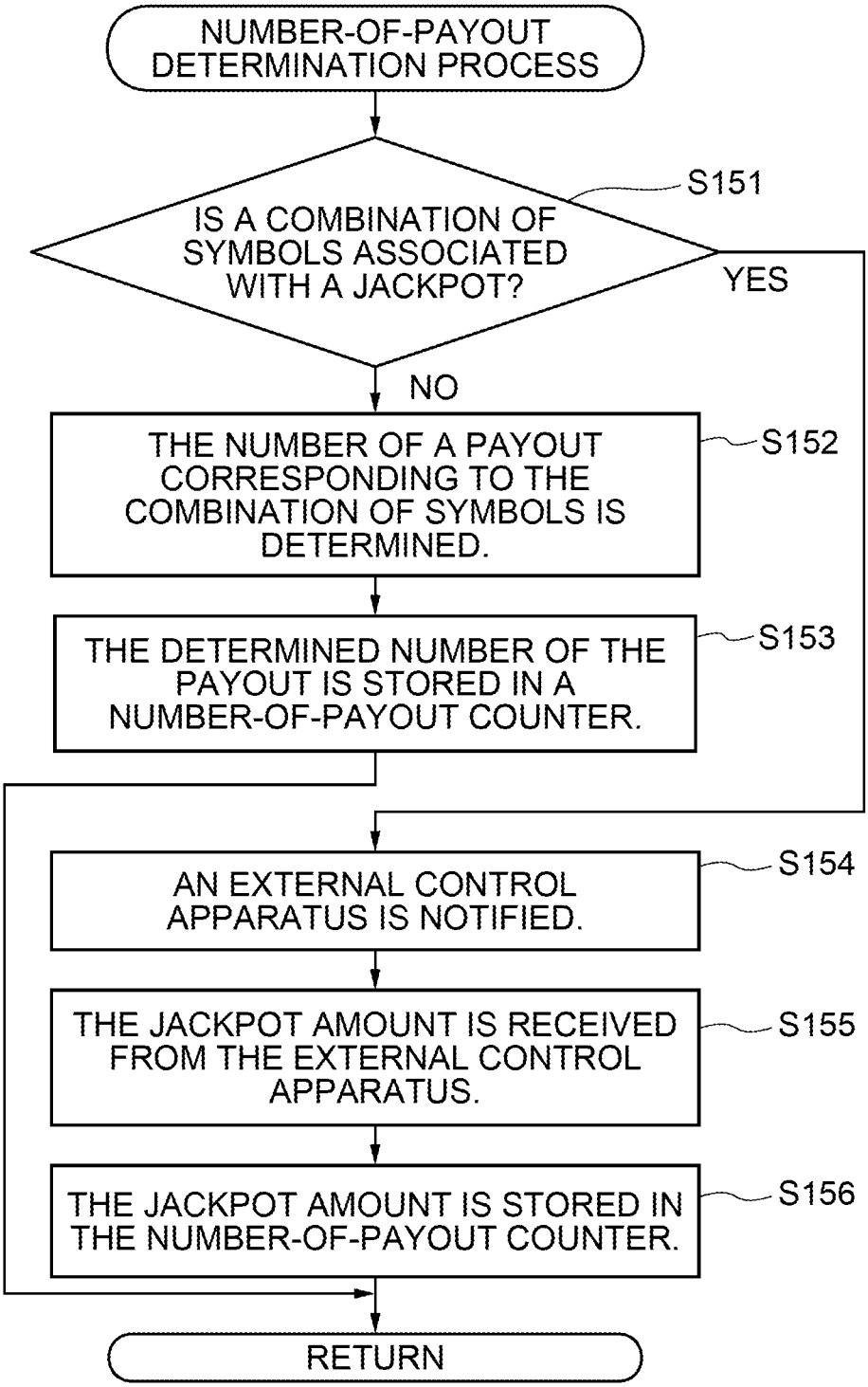
FIG. 22 shows a flowchart of a number-of-payout determination process in the slot machine according to the embodiment of the present invention.

Next, the main CPU 71 conducts a number-of-payout determination process described later with reference to FIG. 22 (step S18). In this process, based on a combination of symbols displayed on a payline, the number of a payout is determined and stored on a number-of-payout counter provided in the RAM 73.

Next, the main CPU 71 determines whether or not the bonus game trigger has been achieved (step S19). When determining that the bonus game trigger has been achieved, the main CPU 71 conducts a bonus game process described later with reference to FIG. 24 (step S20). In the embodiment of the present invention, the bonus game is the free games.

Next, after the process at step S20 or upon determining at step S19 that the bonus game trigger has not been achieved, the main CPU 71 determines whether or not a mystery bonus trigger has been achieved (step S21). When determining that the mystery bonus trigger has been achieved, the main CPU 71 conducts a mystery bonus process (step S22). In this process, the number of a payout (for example, 300) set for the mystery bonus is stored on the number-of-payout counter provided in the RAM 73.

Figure 23:
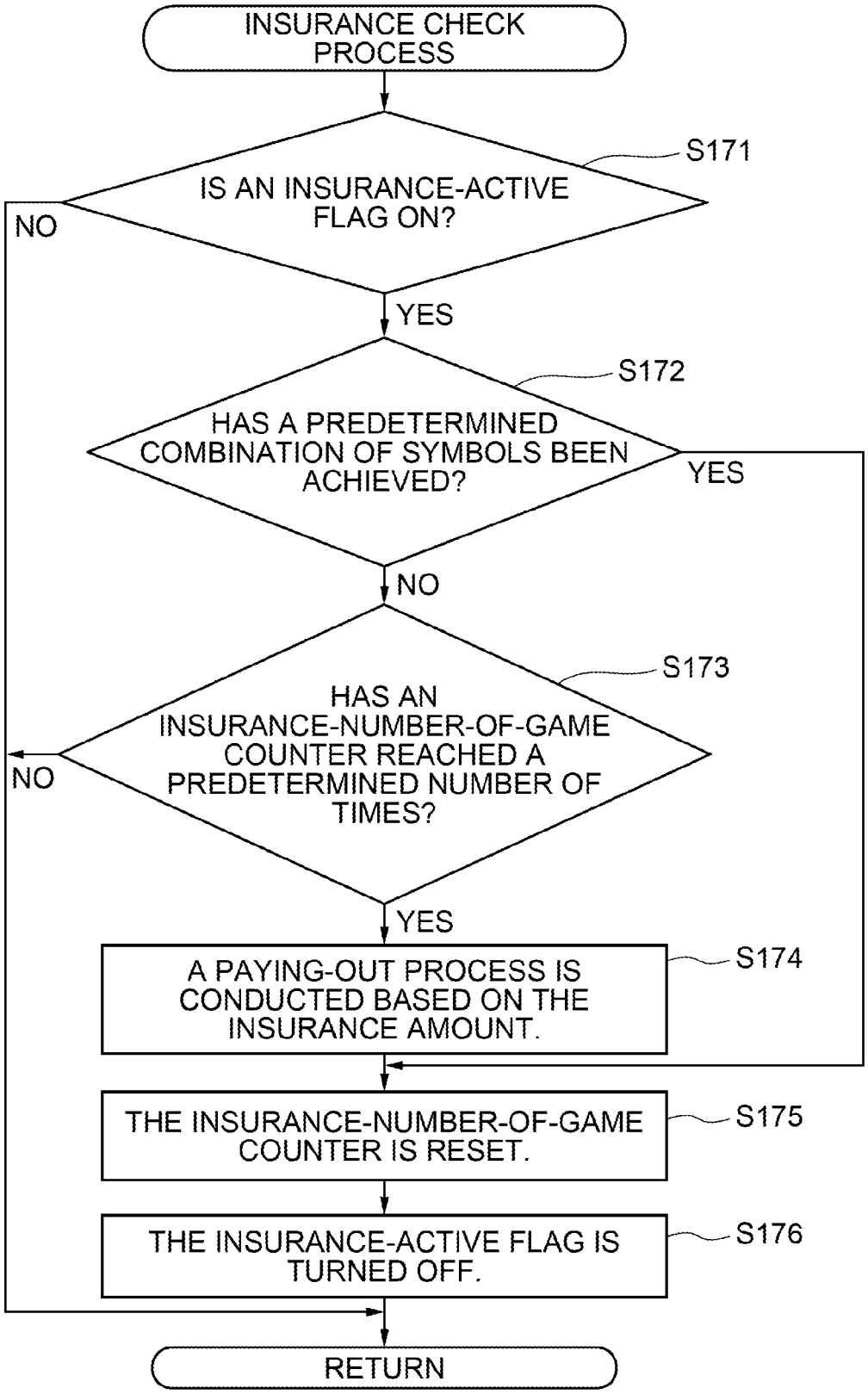
FIG. 23 shows a flowchart of an insurance check process in the slot machine according to the embodiment of the present invention.

After the process at step S22 or upon determining at step S21 that the mystery bonus trigger has not been achieved, the main CPU 71 conducts an insurance check process described later with reference to FIG. 23 (step S23). In this process, it is checked whether or not paying-out by the insurance is conducted.

Next, the main CPU 71 conducts a paying-out process (step S24). The main CPU 71 adds a value stored on the number-of-payout counter to a value stored on a number-of-credit counter provided in the RAM 73. Based on an input on the CASHOUT switch 33S, driving of the hopper 113 may be controlled, and coins in accordance with the value stored on the number-of-payout counter may be discharged from the coin payout opening 15A. In addition, driving of the ticket printer 171 may be controlled, and a ticket having a bar code having stored thereon the value stored on the number-of-payout counter may be issued. After having conducted this process, the main CPU 71 shifts to step S12.

<Coin-in/Start-Check Process>

Next, with reference to FIG. 17, the coin-in/start-check process will be described. FIG. 17 shows a flowchart of the coin-in/start-check process of the slot machine according to the embodiment of the present invention.

First, the main CPU 71 determines whether or not the coin counter 92C has detected inputting of coins (step S41). When determining that inputting of the coins has been detected, the main CPU 71 performs an addition of a value of the number-of-credit counter (step S42). The main CPU 71 may determine whether or not the bill validator 115 has detected inputting of bills in addition to the inputting of the coins, and when determining that the inputting of bills has been detected, a value in accordance with the bills may be added to the value stored on the number-of-credit counter.

After step S42 or upon determining at step S41 that the inputting of the coins has not been detected, the main CPU 71 determines whether or not the value stored in the number-of-credit counter is 0 (step S43). When determining that the value stored on the number-of-credit counter is not 0, the main CPU 71 permits acceptance of an operation of any of the BET buttons (step S44).

Next, the main CPU 71 determines whether or not the operation of any of the BET buttons has been detected (step S45). When any of the BET switches detects that any of the BET buttons has been pressed by a player, based on a kind of the pressed BET button, the main CPU 71 performs an addition of a value stored on a number-of-BET counter provided in the RAM 73 and a subtraction of a value stored on the number-of-credit counter (step S46).

Next, the main CPU 71 determines whether or not the value stored on the number-of-BET counter is a maximum (step S47). When determining that the value stored in the number-of-BET counter is the maximum, the main CPU 71 prohibits updating of the value stored in the number-of-BET counter (step S48). After step S48 or upon determining at step S47 that the value stored in the number-of-BET counter is not the maximum, the main CPU 71 permits acceptance of an operation of the SPIN button (step S49).

After step S49, when determining at step S45 that the operation of any of the BET buttons has not been detected or when determining at step S43 that the value stored in the number-of-credit counter is 0, the main CPU 71 determines whether or not the operation of the SPIN button has been detected (step S50). When determining that the operation of the SPIN button has not been detected, the main CPU 71 shifts to step S41.

Figure 18:
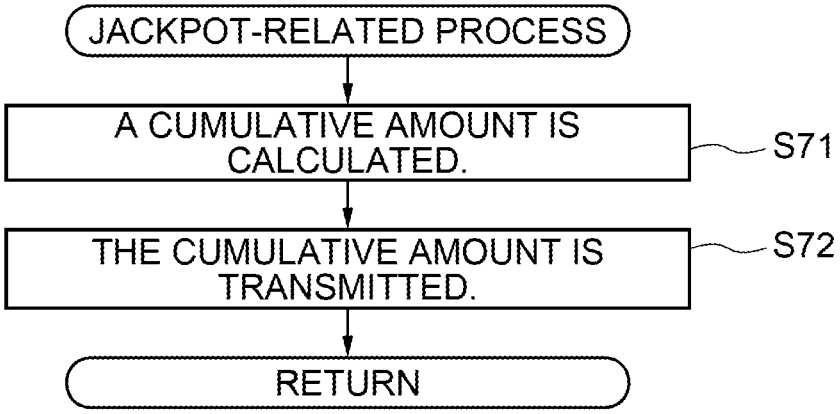
FIG. 18 shows a flowchart of a jackpot-related process in the slot machine according to the embodiment of the present invention.

When determining that the operation of the SPIN button has been detected, the main CPU 71 conducts a jackpot-related process described later with reference to FIG. 18 (step S51). In this process, an amount accumulated in the jackpot amount is calculated and the calculated amount is transmitted to the external control apparatus 200.

Figure 19:
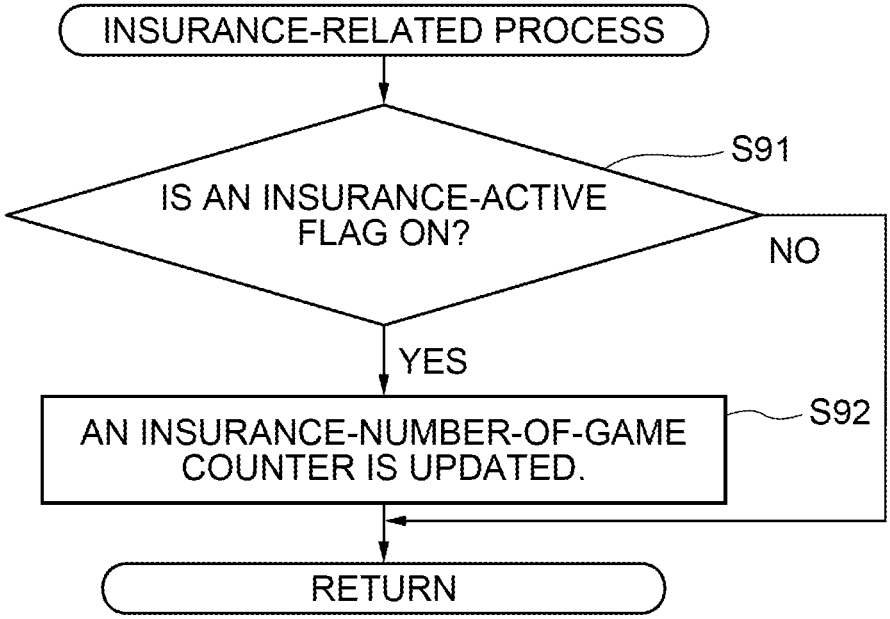
FIG. 19 is a flowchart of an insurance-related process in the slot machine according to the embodiment of the present invention.

Next, main CPU 71 conducts an insurance-related process described later with reference to FIG. 19 (step S52). In this process, counting of the number of games played, which leads to the paying-out by the insurance, is conducted. After conducting this process, the coin-in/start-check process is finished.

<Jackpot-Related Process>

Next, with reference to FIG. 18, the jackpot-related process will be described. FIG. 18 shows a flowchart of the jackpot-related process of the slot machine according to the embodiment of the present invention.

First, the main CPU 71 calculates a cumulative amount (step S71). The main CPU 71 calculates a product of a value stored in the number-of-BET counter and a cumulative rate, thereby obtaining the cumulative amount into the jackpot amount.

Next, the main CPU 71 transmits the calculated cumulative amount to the external control apparatus 200 (step S72). When receiving the cumulative amount, the external control apparatus 200 updates the jackpot amount. After conducting this process, the jackpot-related process is finished.

<Insurance-Related Process>

Next, with reference to FIG. 19, the insurance-related process will be described. FIG. 19 is a flowchart of the insurance-related process of the slot machine according to the embodiment of the present invention.

First, the main CPU 71 determines whether or not an insurance-active flag is on (step S91). The insurance-active flag is set to be on in an insurance selection process described later with reference to FIG. 25 when a player inputs an instruction which makes the insurance active.

When determining that the insurance-active flag is not on, the main CPU 71 finishes the insurance-related process. On the other hand, when determining that the insurance-active flag is on, the main CPU 71 updates a value stored on an insurance-number-of-game counter provided in the RAM 73 (step S92). The insurance-number-of-game counter is a region for storing the number of games played until the paying-out by the insurance is conducted. In the process at step S92, the main CPU 71 adds one to the value stored in the insurance-number-of-game counter. After conducting this process, the insurance-related process is finished.

<Symbol Drawing Process>

Next, with reference to FIG. 20, the symbol drawing process will be described. FIG. 20 shows a flowchart of the symbol drawing process of the slot machine according to the embodiment of the present invention.

First, the main CPU 71 extracts symbol determination random number values (step S111). Next, the main CPU 71 determines symbols scheduled to be stopped of the respective video reels 3 by drawings (step S112). The main CPU 71 conducts the drawings in accordance with the respective video reels 3 and determines any of pluralities of symbols as the symbols scheduled to be stopped. At this time, the respective pluralities of symbols are determined with probabilities which are equal to one another.

Next, the main CPU 71 stores the determined symbols scheduled to be stopped of the respective video reels 3 in a symbol storage region provided in the RAM 73 (step S113). Next, with reference to the symbol combination tables (in FIG. 14 and FIG. 15), the main CPU 71 determines a LINE payout and a scatter pay based on the symbol storage region (step S114). The main CPU 71 determines whether or not a combination of the symbols displayed on payline by the respective video reels 3 matches any combination of symbols of combinations defined in the symbol combination tables and determines the LINE payout. When three symbols "FEATURE" are displayed in the symbol display area 4, the main CPU 71 determines "2" as the number of a payout of the scatter pay. After conducting this process, the symbol drawing process is finished.

In a case of this embodiment, a LINE payout which is a multiplying factor per line for the base game and a LINE payout which is a multiplying factor per line for each of the free games are configured so as to be the LINE payouts which are the same as each other. Among gaming machines being present in the world, each of which includes this kind of slot machine, there present are some of gaming machines, each of which is configured to set a LINE payout for a base game, achieved by the same symbols, and a LINE payout for each of the free games, achieved by the same symbols, such that the LINE payout for each of the free games (second games) evolving from said base game is higher than the LINE payout for the base game. In the present invention, however, in order to allow a player to easily recognize an amount of a payout and to avoid the complication of programs for executing arithmetic processing of payouts by using the processor of the slot machine, the table data of the payout tables shown in FIG. 14 and FIG. 15 is adopted so as to allow the payouts to be the same as each other. Of course, the table data of payouts for the base game and the table data of payouts for each of the free games shown in FIG. 14 and FIG. 15 may be made different from each other such that the LINE payout per line for each of the free games evolving from said base game, achieved by the same symbols, is higher than the LINE payout per line for the base game, achieved by the same symbols, thereby allowing a game to be set such that a player can obtain a larger payout in each of the free games. In the present embodiment, the reason for the same multiplying factors for the base game and each of the free games, obtained by the same symbols, is based on the above-described technical problems.

<Symbol Display Control Process>

Next, with reference to FIG. 21, the symbol display control process will be described. FIG. 21 shows a flowchart of the symbol display control process of the slot machine according to the embodiment of the present invention.

First, the main CPU 71 starts the scrolling of the symbol columns of the respective video reels 3 displayed in the symbol display area 4 of the lower side image display panel 141 (step S131). Next, the main CPU 71 stops the scrolling of the symbol columns of the respective video reels 3 based on the above-described symbol storage region (step S132). After conducting this process, the symbol display control process is finished.

<Number-of-Payout Determination Process>

Next, with reference to FIG. 22, the number-of-payout determination process will be described. FIG. 22 shows a flowchart of the number-of-payout determination process of the slot machine according to the embodiment of the present invention.

First, the main CPU 71 determines whether or not a combination of symbols is associated with a jackpot (step S151). When determining that the combination of symbols is not associated with the jackpot, the main CPU 71 determines the numbers of payouts corresponding to a LINE payout and a scatter pay (step S152). When losing occurs, "0" is determined as the number of a payout. Next, the main CPU 71 stores the determined numbers of payouts in the number-of-payout counter (step S153). After conducting this process, the number-of-payout determination process is finished.

When determining that the combination of symbols is associated with the jackpot, the main CPU 71 notifies the external control apparatus 200 that the jackpot has occurred (step S154). When having received the notification, the external control apparatus 200 transmits to the slot machine 1 the jackpot amount which has been updated until then. At this time, a portion of the jackpot amount (for example, 80%) may be targeted to be paid out, and the remaining thereof (for example, 20%) may be carried over in preparation for the achievement of the next jackpot trigger.

Next, the main CPU 71 receives the jackpot amount from the external control apparatus 200 (step S155). Next, the main CPU 71 stores the received jackpot amount on the number-of-payout counter (step S156). After conducting this process, the number-of-payout determination process is finished.

<Insurance Check Process>

Next, with reference to FIG. 23, the insurance check process will be described. FIG. 23 shows a flowchart of the insurance check process of the slot machine according to the embodiment of the present invention.

First, the main CPU 71 determines whether or not the insurance-active flag is on (step S171). When determining that the insurance-active flag is not on, the main CPU 71 finishes the insurance check process.

When determining that the insurance-active flag is on, the main CPU 71 determines whether or not a predetermined combination of symbols has been achieved (step S172). In the embodiment of the present invention, the predetermined combination of symbols is targeted for the "bonus game trigger", the "jackpot", and the "mystery bonus".

When determining that the predetermined combination of symbols has not been achieved, the main CPU 71 determines whether or not a value stored in the insurance-number-of-game counter has reached a predetermined number of times (for example, 300) (step S173). When determining that the value stored in the insurance-number-of-game counter has not reached the predetermined number of times, the main CPU 71 finishes the insurance check process.

When determining that the value stored in the insurance-number-of-game counter has reached the predetermined number of times, the main CPU 71 conducts the paying-out process based on the insurance amount (step S174). The main CPU 71 adds a predetermined amount (for example, 200) as the insurance amount to a value stored on the number-of-credit counter.

After step S174 or upon determining at step S172 that the predetermined combination of symbols has been achieved, the main CPU 71 resets the value stored on the insurance-number-of-game counter (step S175). Next, the main CPU 71 turns off the insurance-active flag (step S176). After conducting this process, the insurance check process is finished.

<Bonus Game Process>

Figure 24:
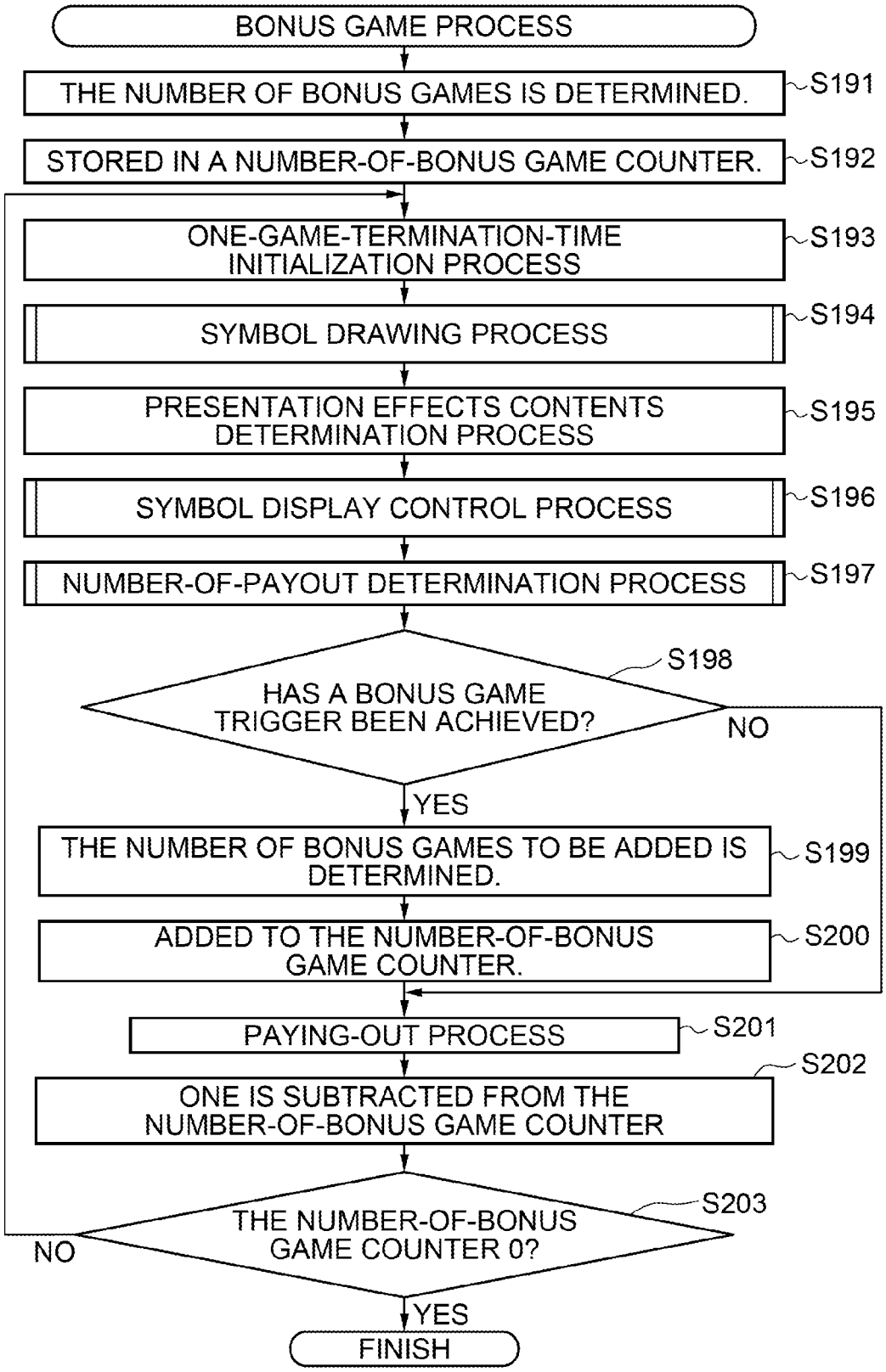
FIG. 24 shows a flowchart of a bonus game process in the slot machine according to the embodiment of the present invention.

Next, with reference to FIG. 24, the bonus game process will be described. FIG. 24 shows a flowchart of the bonus game process of the slot machine according to the embodiment of the present invention.

First, the main CPU 71 determines the number of bonus games (step S191).

The main CPU 71 uniformly determines "8" as the number of bonus games. However, the main CPU 71 may extract random number values for determining the number of bonus games, and determines any of a plurality of the numbers of bonus games, for example "50", "70", and "100", by a drawing.

Next, the main CPU 71 stores the determined number of bonus games on a number-of-bonus game counter provided in the RAM 73 (step S192).

Next, as in the process at step S12 described with reference to FIG. 16, the main CPU 71 conducts the one-game-termination-time initialization process (step S193). Next, the main CPU 71 conducts the symbol drawing process described with reference to FIG. 20 (step S194). Next, as in the process at step S16 described with reference to FIG. 16, the main CPU 71 conducts the presentation effects contents determination process (step S195). Next, the main CPU 71 conducts the symbol display control process described with reference to FIG. 21 (step S196). Next, the main CPU 71 conducts the number-of-payout determination process described with reference to FIG. 22 (step S197).

Next, the main CPU 71 determines whether or not a bonus game trigger has been achieved (step S198). When determining that the bonus game trigger has been achieved, the main CPU 71 determines the number of bonus games to be added (step S199). As in the above-described process at step S191, the number of bonus games is determined Next, the main CPU 71 adds the determined number of bonus games to a value stored on the number-of-bonus game counter (step S200).

After the process at step S200 or upon determining at step S198 that the bonus game trigger has not been achieved, the main CPU 71 conducts the paying-out process (step S201). In this paying-out process, the main CPU 71 adds the value stored on the number-of-payout counter in the above-described number-of-payout determination process at step S197 to a value stored on a bonus-number-of-payout counter. The bonus-number-of-payout counter is a region for storing the total of the number of payouts determined during the bonus games. Upon finishing the bonus game process, the main CPU 71 adds the value stored on the bonus-number-of-payout counter in the paying-out process, at step S24 described with reference to FIG. 16, to a value stored on the number-of-credit counter provided in the RAM 73. In other words, the total of the number of payouts determined in the bonus games is paid out. Coins may be discharged from the coin payout opening 15A and a ticket having a bar code may be issued.

Next, the main CPU 71 subtracts one from the value stored on the number-of-bonus game counter (step S202). Next, the main CPU 71 determines whether or not the value stored in the number-of-bonus game counter is zero (step S203). When determining that the value stored in the number-of-bonus game counter is not zero, the main CPU 71 shifts to the process at step S193. On the other hand, when determining that the value stored in the number-of-bonus game counter is zero, the main CPU 71 finishes the bonus game process. Upon finishing the bonus game process, the main CPU 71 shifts to the process at step S21 described with reference to FIG. 16.

<Insurance Selection Process>

Figure 25:
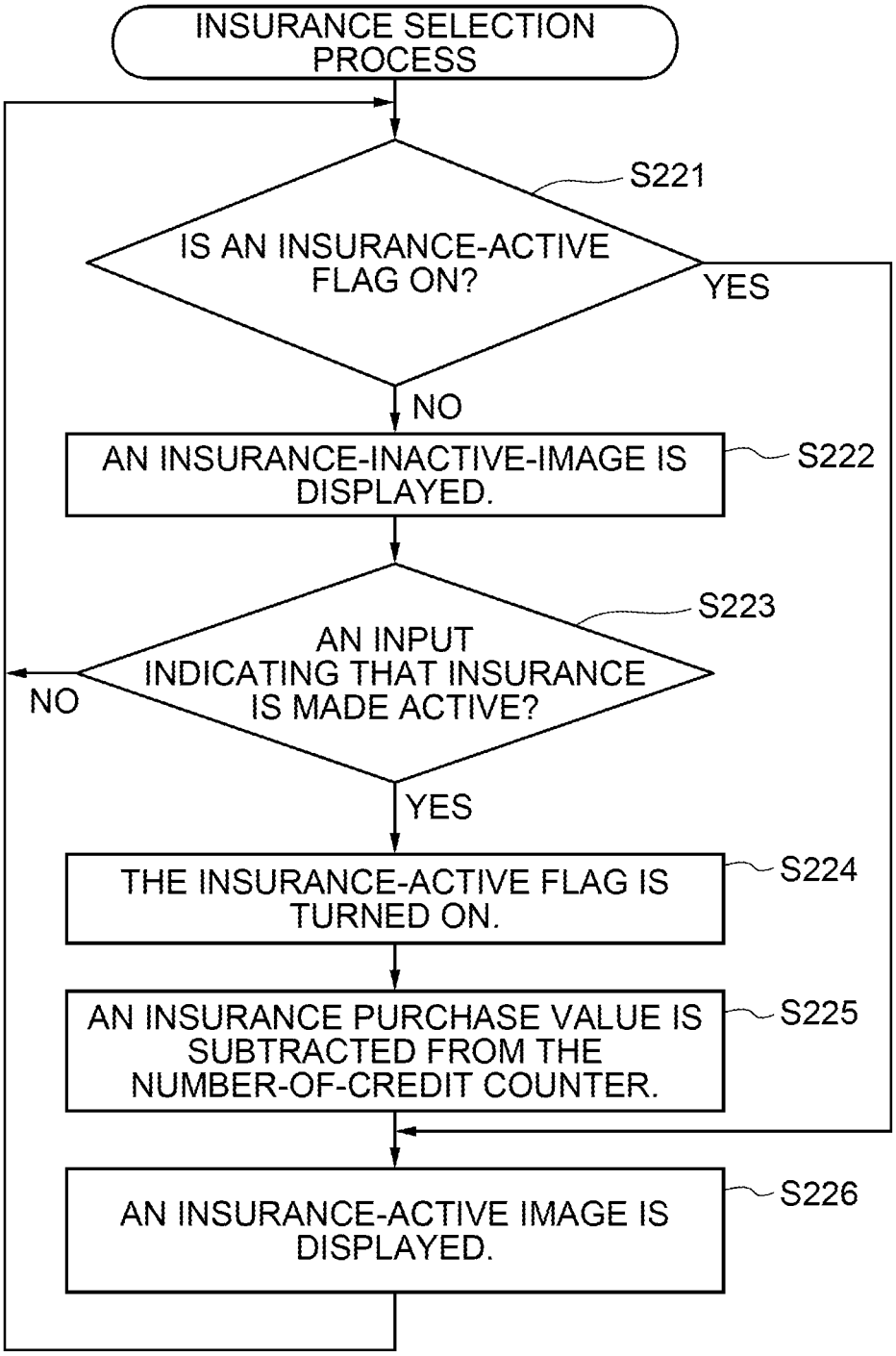
FIG. 25 shows a flowchart of an insurance selection process in the slot machine according to the embodiment of the present invention.

Next, with reference to FIG. 25, the insurance selection process will be described. FIG. 25 shows a flowchart of the insurance selection process of the slot machine according to the embodiment of the present invention.

First, the main CPU 71 determines whether or not the insurance-active flag is on (step S221). When determining that the insurance-active flag is not on, the main CPU 71 displays an insurance-inactive-image (step S222). The main CPU 71 transmits an instruction to display the insurance-inactive-image to the graphic board 130. Based on the instruction, the graphic board 130 generates the insurance-inactive-image and displays the insurance-inactive-image on the lower side image display panel 141. As the insurance-inactive-image, for example, an image indicating "INSURANCE BET $1.00 TOUCH TO BET" is displayed. This image is to prompt a player to make a selection on whether or not the insurance is made active and to notify a player of an amount required to make the insurance active. By touching a predetermined portion on the touch panel 114, a player can input an instruction indicating that the insurance is made active.

Subsequently, the main CPU 71 determines whether or not there is the input indicating that the insurance is made active (step S223). When determining that there is no input indicating that the insurance is made active, the main CPU 71, with the insurance-active flag being kept off, shifts to step S221. On the other hand, when determining that there is the input indicating that the insurance is made active, the main CPU 71 turns on the insurance-active flag (step S224).

Next, the main CPU 71 subtracts an insurance purchase value from a value stored on the number-of-credit counter (step S225). In the embodiment of the present invention, for example, a value corresponding to one dollar is subtracted from the value stored on the number-of-credit counter. After step S225 or upon determining at step S221 that the insurance-active flag is on, the main CPU 71 displays an insurance-active image (step S226). As the insurance-active image, for example, an image indicating "INSURANCE-CONTINUING WIN 200 CREDIT" is displayed. This image is to notify a player that the insurance is active and that upon satisfying an insurance condition, a value of "200" is added to a value stored on the number-of-credit counter. After conducting this process, the main CPU 71 shifts to step S221.

[ Screen Display Specification]

The programs executed by the slot machine 1 are as described above. Next, with reference to FIG. 26 and FIG. 27, a screen display specification will be described.

<Screen Display Specification During Base Game>

Figure 26:
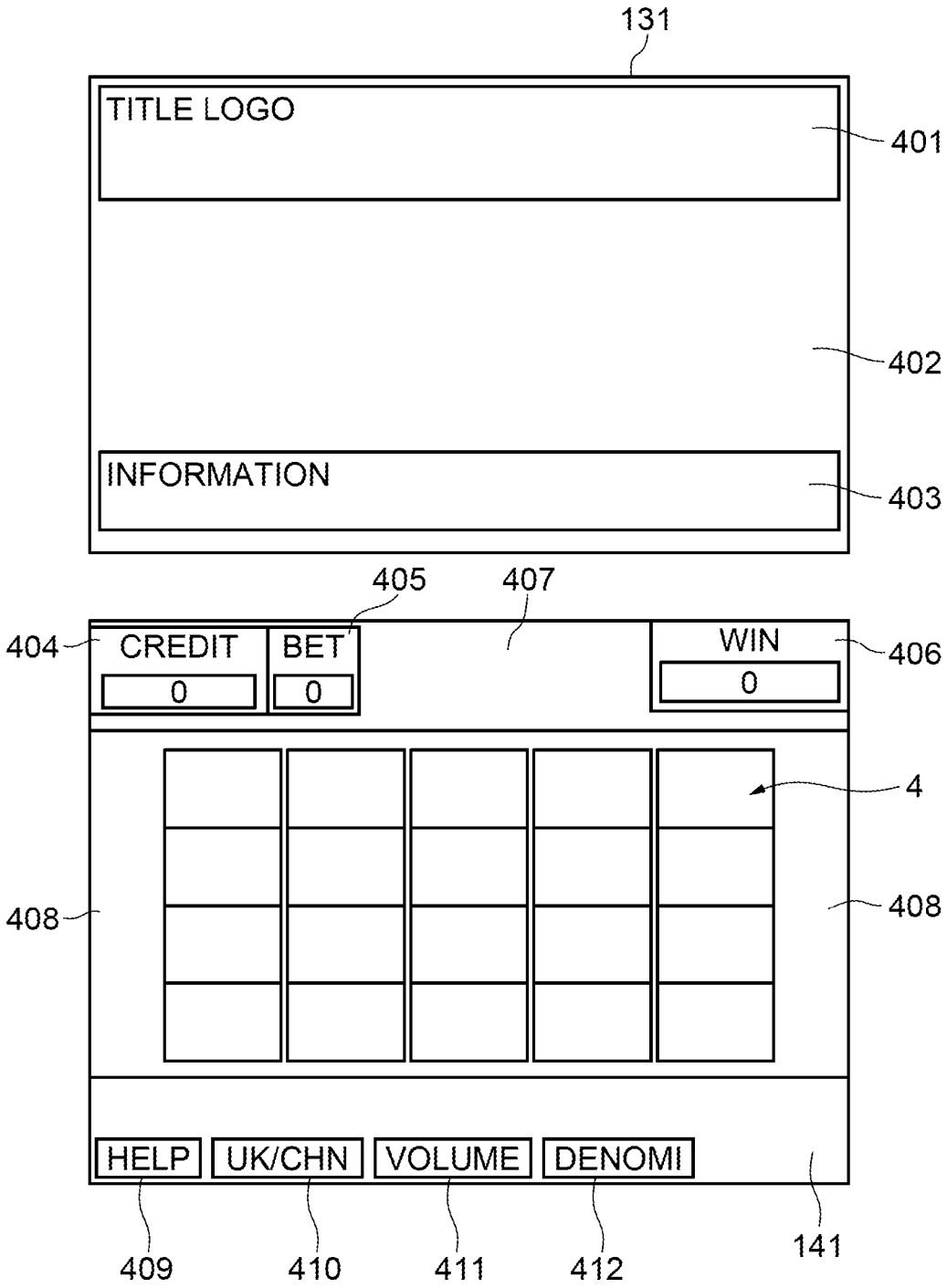
FIG. 26 is a diagram illustrating a screen display specification in the slot machine according to the embodiment of the present invention during a base game.

First, with reference to FIG. 26, a screen display specification during the base game will be described. FIG. 26 is a diagram illustrating the screen display specification of the slot machine according to the embodiment of the present invention during the base game.

As shown in FIG. 26, on the upper side image display panel 131 during the base game, a title logo area 401, an image 402, and an information area 403 are provided. In the title logo area 401, a game title logo is displayed. Accordingly, during each of the free games, the game tile log is switched to a display of a name of each of the free games. When a display language is switched to English or Chinese, a title in the switched language is displayed. In the image 402, a main image of a game is displayed. During the free games, a background is changed to be displayed. In the information area 403, a brief explanation of game rules is displayed. Accordingly, during the base game and the free games, display contents are changed. Loop-display of words and sentences of each of the display contents is conducted at 10-second intervals.

On the lower side image display panel 141 during the base game, in addition to the above-described symbol display area 4, a CREDIT meter 404, a BET meter 405, a WIN meter 406, a display area 407 for displaying BET information and a game state, a display area 408 for displaying LINE Nos., a HELP touch button 409, a language switch touch button 410, a sound volume switch touch button 411, and a DENOMI display area 412 are provided. In the CREDIT meter 404, the number of remaining credits is displayed. An initial value is "0". In other words, the number of credits stored in the RAM 73 is displayed. In the BET meter 405, the total BET number of a current game (or a final game) is displayed. In the WIN meter 406, the TOTAL credit number of WIN and a breakdown of WIN are displayed. As each of the WIN credit numbers displayed in the WIN meter 406, the number of credit which is actually obtained by the multiplication by the number of BET PER LINE is displayed.

In the display area 407 for displaying the BET information and the game state, the BET information pertinent to a current game (or a final game) is displayed. On the first line, the number of BET PER LINE is displayed. In this display, singular or plural words are displayed depending on the number of BET(s). For example, when the number of BET PER LINE is "1", "1 CREDIT PER LINE" is displayed with the singular word of "CREDIT". When the number of BET PER LINE is "2", "2 CREDITS PER LINE" is displayed with the plural word of "CREDITS". The plural word of "CREDITS" is displayed also when the number of BET PER LINE is "3" or more. Further, in the display area 407 for displaying the BET information and the game state, a state of the current game is displayed. When the current game is being played, no message is displayed. When the current game is over, "GAME OVER" is displayed. When the state of the current game is a state of GAMBLE waiting, "PLAY ON, GAMBLE or TAKE WIN" is displayed.

In the display area 408 for displaying the LINE Nos., the LINE Nos. of 50 paylines are displayed. In the embodiment of the present invention, because of a full-line-limited game, there is no mid-stage. The HELP touch button 409, when touched by a player, displays the first page of a HELP screen on the lower side image display panel 141. The HELP touch button 409 becomes dark while being deactivated, for example, while the video reels 3 are rotating.

The language switch touch button 410, when touched by a player, switches the display language to English or Chinese. The language switch touch button 410 is activated only during advertising and becomes dark while being deactivated, for example, while the video reels 3 are rotating. Further, the language switch touch button 410 changes a national flag display to be "UK/CHN" or "US/CHN" by making a setting on an AUDIT MENU. In addition, when the language switch is in a state of "DISABLE", the language switch touch button 410 becomes a PAYTABLE button, thereby being changed to be a button for displaying a payout table on the HELP screen.

The sound volume switch touch button 411 changes a game sound volume in three phases. Each time a player touches the sound volume switch touch button 411, the game sound volume is changed in the order of a small sound volume→a middle sound volume,→a large sound volume→a small sound volume→a middle sound volume . . . In the DENOMI display area 412, a current denomination is displayed.

<HELP Screen Display Specification in Normal Time>

Figure 27:
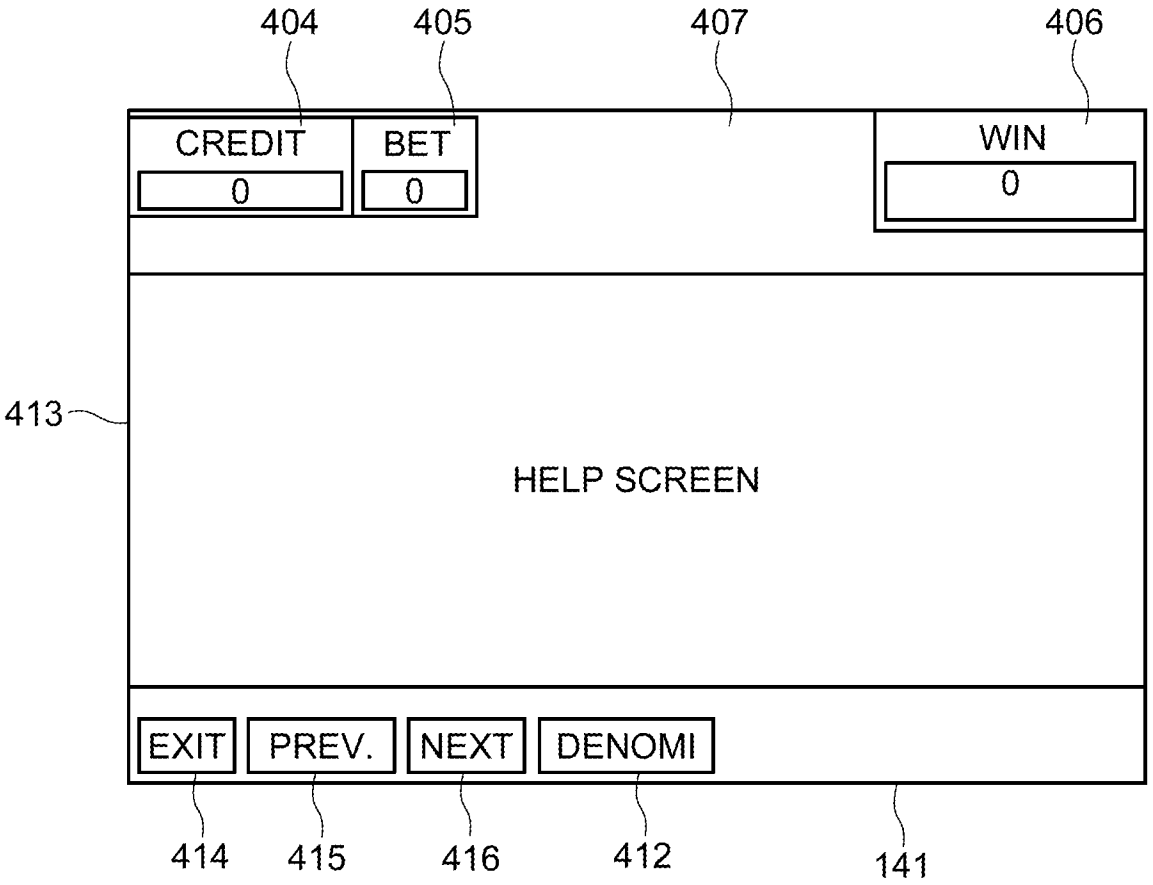
FIG. 27 is a diagram illustrating a HELP screen display specification in the slot machine according to the embodiment of the present invention during the base game.

Next, with reference to FIG. 27 a screen display specification during the base game will be described. FIG. 27 is a diagram illustrating the HELP screen display specification of the slot machine according to the embodiment of the present invention during the base game.

As shown on the lower side image display panel 141 shown in FIG. 27, in the HELP screen display specification during the base game, the above-described CREDIT meter 404, BET meter 405, WIN meter 406, BET information, display area 407 for displaying the game state, and DENOMI display area 412 are displayed. Further, on the lower side image display panel 141, a HELP screen 413 is allocated and an EXIT touch button 414, a PREV. touch button 415, and a NEXT touch button 416 are provided.

The EXIT touch button 414, when touched by a player, causes the lower side image display panel 141 to exit from the HELP screen 413 and to be returned to a base game screen (refer to FIG. 26). The PREV. touch button 415, when touched by a player, causes the HELP screen 413 to be retuned to a previous page by one page. The NEXT touch button 416, when touched by a player, causes the HELP screen 413 to proceed to the next page by one page.

[WIN Presentation Effects]

The screen display specification of the slot machine 1 is as described above. Next, with reference to FIG. 28 to FIG. 38C, WIN presentation effects of the slot machine 1 will be described.

WIN presentation effects are presentation effect performed when any WIN has occurred during the base game and the free games. In the embodiment of the present invention, unlike the conventional type of the free games, character animation on the upper side image display panel 131 and animation above the symbol display area 4 of the lower side image display panel 141 are not conducted. In the WIN presentation effects, only animation of symbols, WIN incrementing, a WIN signboard display on the upper side image display panel 131 are conducted.

<Flow of WIN Presentation Effects>

Here, with reference to FIG. 28 to FIG. 33, a flow of WIN presentation effects will be described. Each of FIG. 28 to FIG. 33 is a diagram illustrating the flow of the WIN presentation effects of the slot machine according to the embodiment of the present invention.

Figure 28:
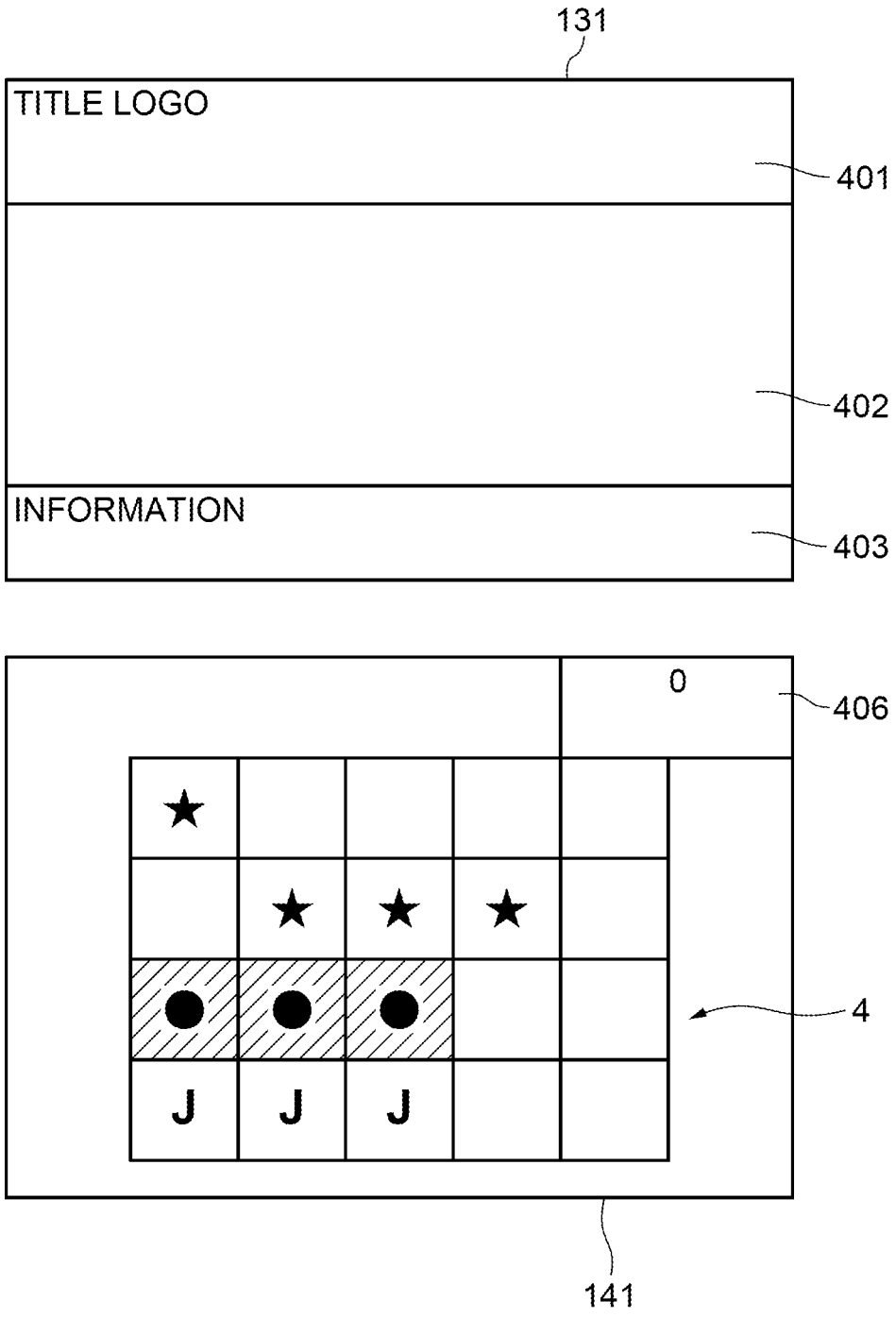
FIG. 28 is a diagram illustrating a flow of WIN presentation effects in the slot machine according to the embodiment of the present invention.
Figure 29:
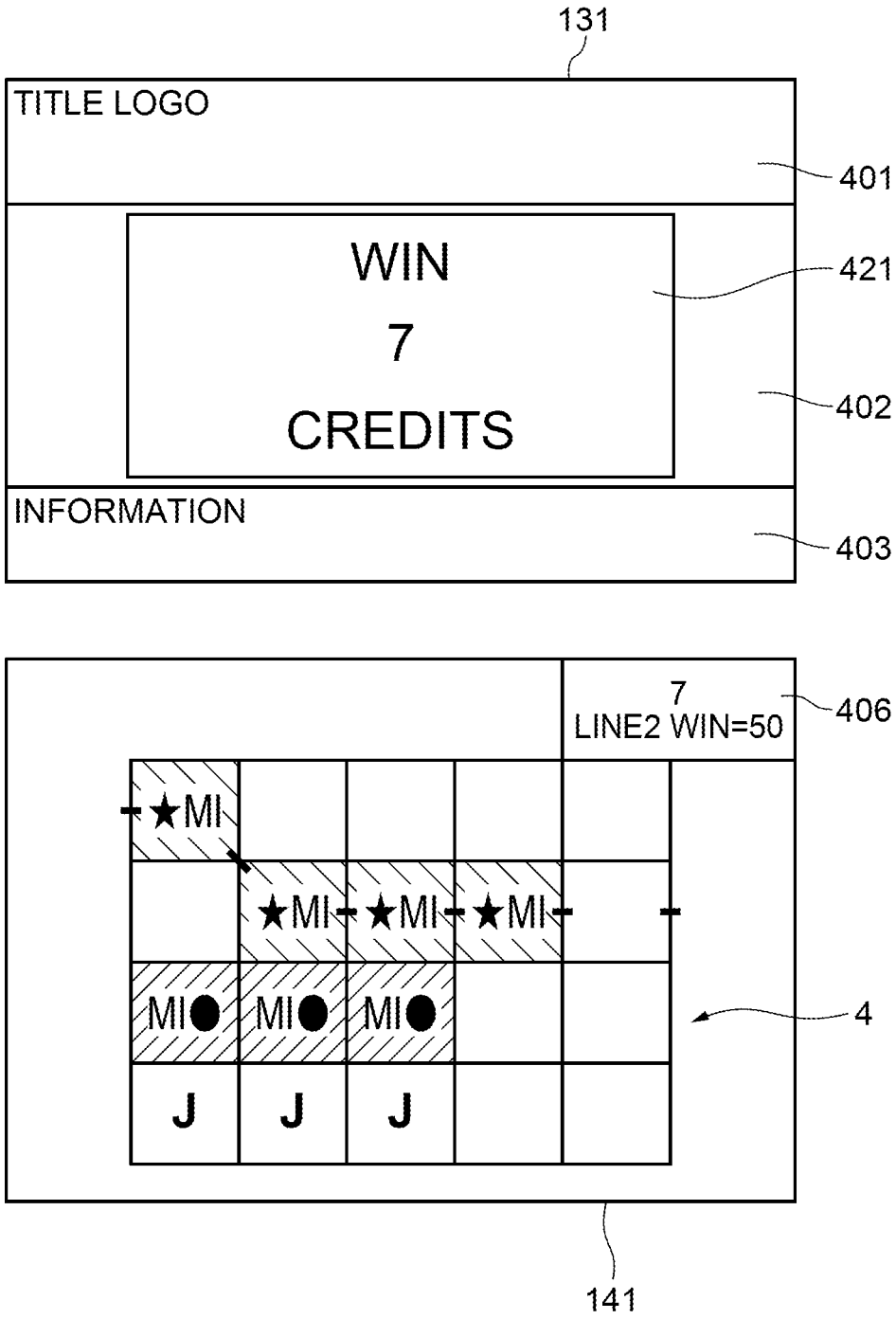
FIG. 29 is a diagram illustrating the flow of the WIN presentation effects in the slot machine according to the embodiment of the present invention.

First, as shown in FIG. 28, in the symbol display area 4 of the lower side image display panel 141, all of the reels are stopped. When all of the reels have been stopped, as shown in FIG. 29, in the image 402 on the upper side image display panel 131, a WIN signboard 421 is displayed. On the WIN signboard 421, a won credit is displayed in an incremented manner. The increment display of the won credit on the WIN signboard 421 is linked with the display in the WIN meter 406 on the lower side image display panel 141.

On the lower side image display panel 141, with respect to the achieved winning, WIN presentation effects are performed. First, with respect to a scatter pay, the WIN presentation effects are performed, and next, with respect to a LINE payout, the WIN presentation effects are performed. With respect to the LINE payout, the WIN presentation effects are performed in ascending order of the LINE Nos. At this time, with respect to symbols for which WIN animation is prepared, irrespective of the LINE Nos., presentation effects using the animation are performed. In contrast to this, with respect to symbols for which WIN animation is not prepared (symbols for which the WIN presentation effects blink), only when winning of a LINE payout to which the above-mentioned symbols correspond occurs, the WIN presentation effects blink.

In the WIN meter 406 on the lower side image display panel 141, a WIN gross amount upon starting the incrementing is displayed in an upper row. In a lower row in which a breakdown is displayed, a WIN LINE payout for which WIN LINE lights up (in FIG. 29, LINE 2 WIN=50) is displayed. "TOTAL WIN" is not displayed.

Figure 30:
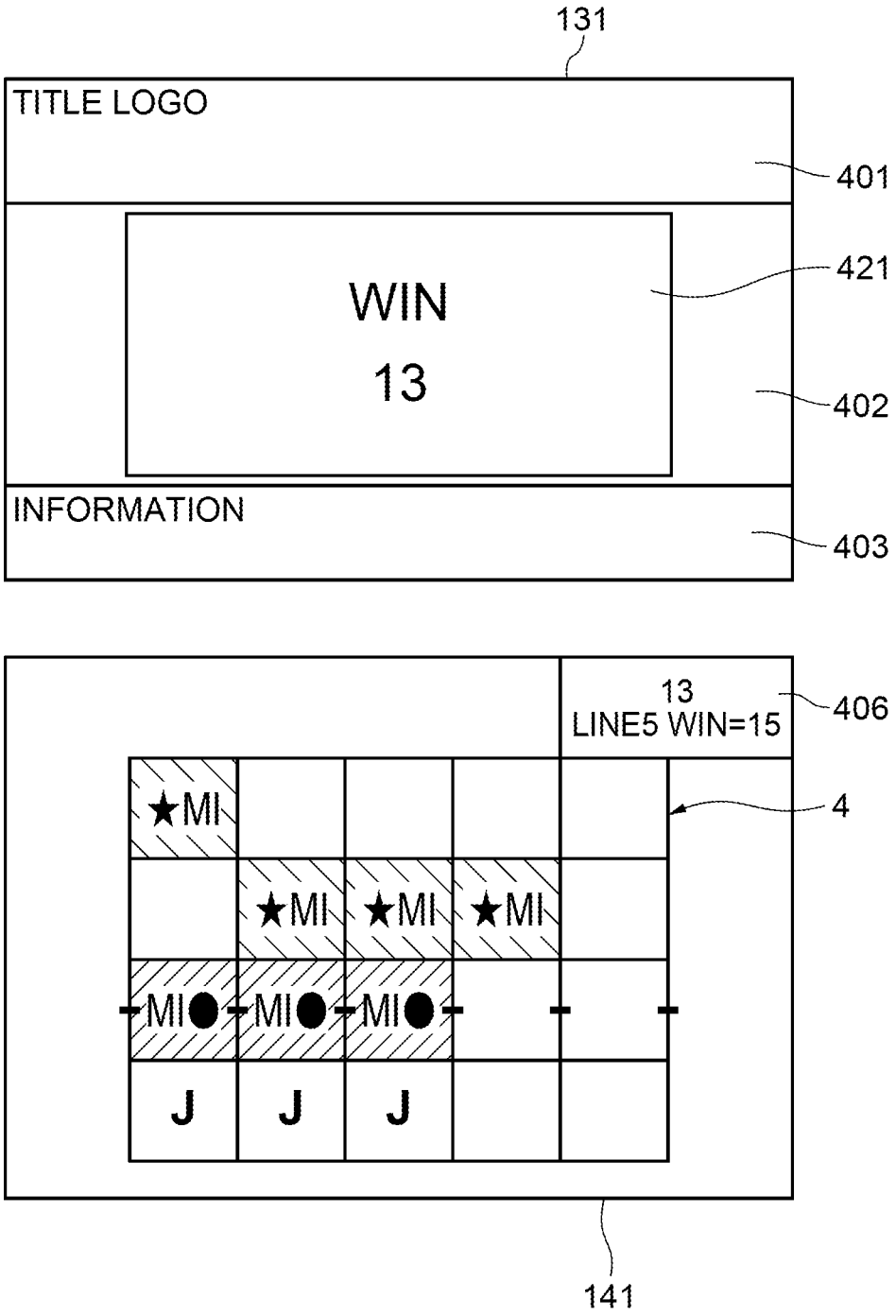
FIG. 30 is a diagram illustrating the flow of the WIN presentation effects in the slot machine according to the embodiment of the present invention.

Next, as shown in FIG. 30, on the WIN signboard 421 of the image 402 on the upper side image display panel 131, the increment display of the won credit is continued. On the lower side image display panel 141, the order of displaying the WIN LINE is caused to proceed. Here, the order of displaying the WIN LINE with respect to symbols marked with stars and black dots proceeds. In addition, with respect to both of the symbols marked with the stars and the symbols marked with black dots, since the WIN animation is prepared, irrespective of the LINE Nos., the presentation effects by using the animation are performed. In contrast to this, with respect to symbols marked with "J", since the order of displaying the WIN LINE does not proceed and the WIN animation is not prepared, these symbols remain stopped. With respect to the symbols marked with the starts in the order of displaying the WIN LINE (the second-smallest LINE No.), the WIN LINE lights up.

In the WIN meter 406 on the lower side image display panel 141, the increment display of the WIN gross amount is continued in the upper row. In the lower row in which the breakdown is displayed, a payout (in FIG. 30, LINE 5 WIN=15) of the WIN LINE for which the WIN LINE is currently lighting up is displayed. The TOTAL WIN is not displayed.

Figure 31:
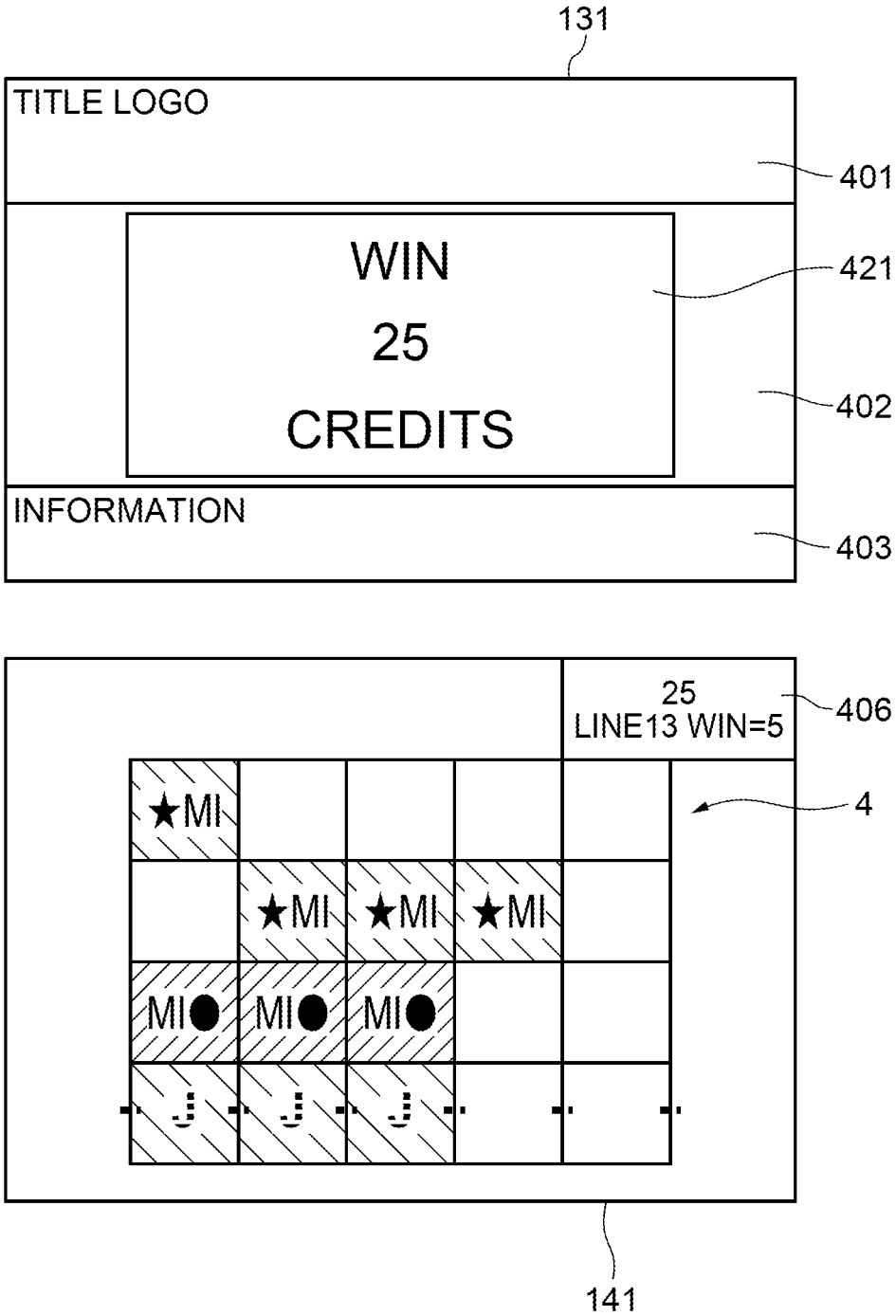
FIG. 31 is a diagram illustrating the flow of the WIN presentation effects in the slot machine according to the embodiment of the present invention.

Next, as shown in FIG. 31, in the image 402 on the upper side image display panel 131, the WIN signboard 421 is displayed. On the WIN signboard 421, the increment display of the won credit is continued. The increment display of the won credit on the WIN signboard 421 is linked with the display in the WIN meter 406 on the lower side image display panel 141.

On the lower side image display panel 141, the order of displaying the WIN LINE is caused to proceed. Here, with respect to the symbols marked with "J", starting from the symbols marked with the black dots, the order of displaying the WIN LINE proceeds. In addition, with respect to both of the symbols marked with the stars and the symbols marked with black dots, since the WIN animation is prepared, irrespective of the LINE Nos., the presentation effects by using the animation are performed. In contrast to this, symbols marked with "J", since the order of displaying the WIN LINE proceeds but the WIN animation is not prepared, the WIN LINE is caused to blink. With respect to the symbols marked with "J" in the order of displaying the WIN LINE (the third smallest LINE No.), the WIN LINE lights up.

In the WIN meter 406 on the lower side image display panel 141, the increment display of the WIN gross amount is continued in the upper row. In the lower row in which the breakdown is displayed, a payout (in FIG. 31, LINE 13 WIN=5) of the WIN LINE for which the WIN LINE is currently lighting up is displayed. The TOTAL WIN is not displayed.

Figure 32:
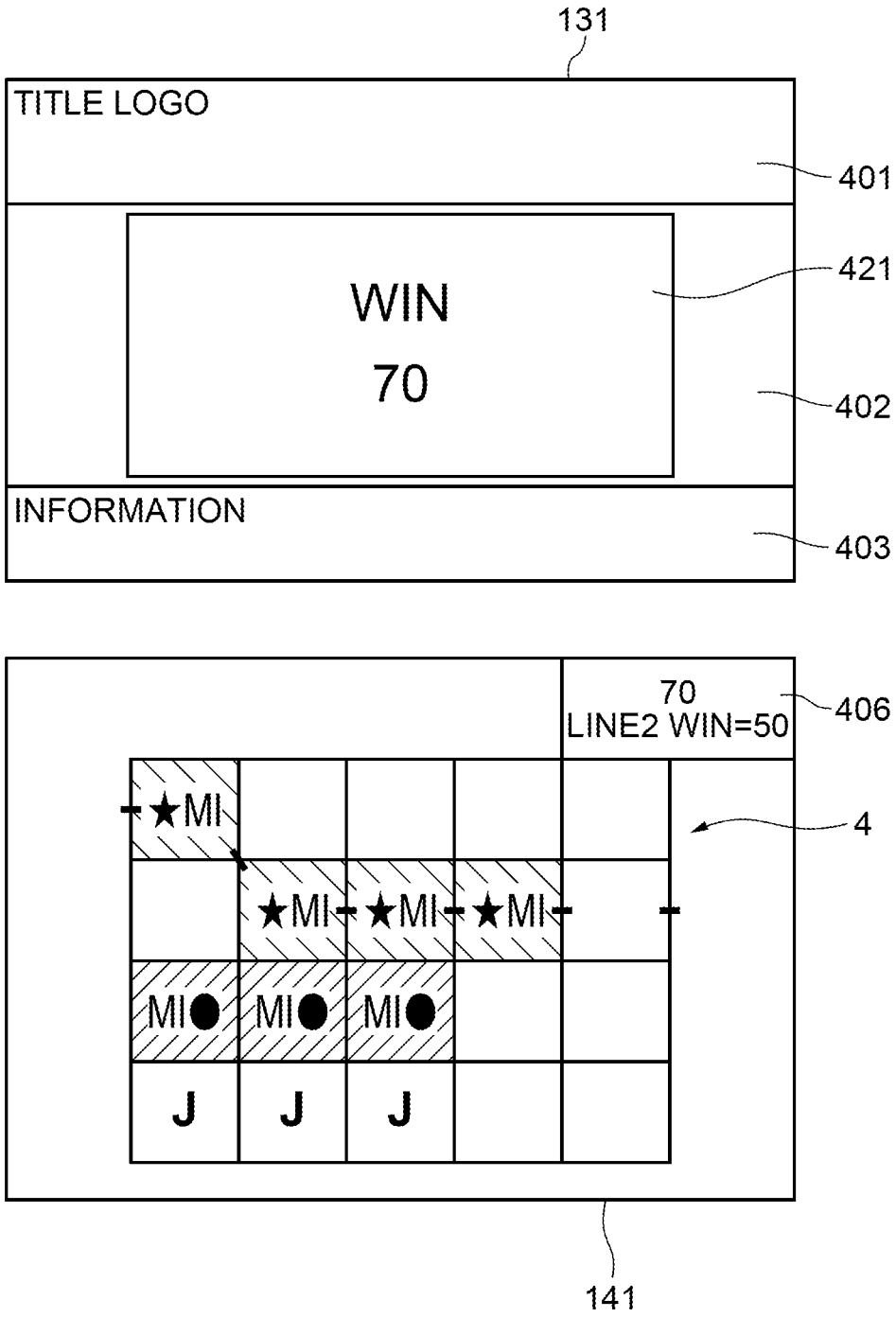
FIG. 32 is a diagram illustrating the flow of the WIN presentation effects in the slot machine according to the embodiment of the present invention.

Next, as shown in FIG. 32, on the WIN signboard 421 displayed in the image 402 on the upper side image display panel 131, a total WIN amount is displayed. The increment display of the won credit is finished. On the lower side image display panel 141, since one round of displaying won symbols have been finished, the loop display is conducted in ascending order of the LINE Nos.

In the WIN meter 406 on the lower side image display panel 141, the increment display of the WIN gross amount in the upper row is finished. Also in the upper row, the total WIN amount is displayed. In the lower row in which the breakdown is displayed, since one round of displaying won symbols have been finished, the loop display is conducted in ascending order of the LINE Nos. In FIG. 32, "LINE 2 WIN=50" is displayed again.

Figure 33:
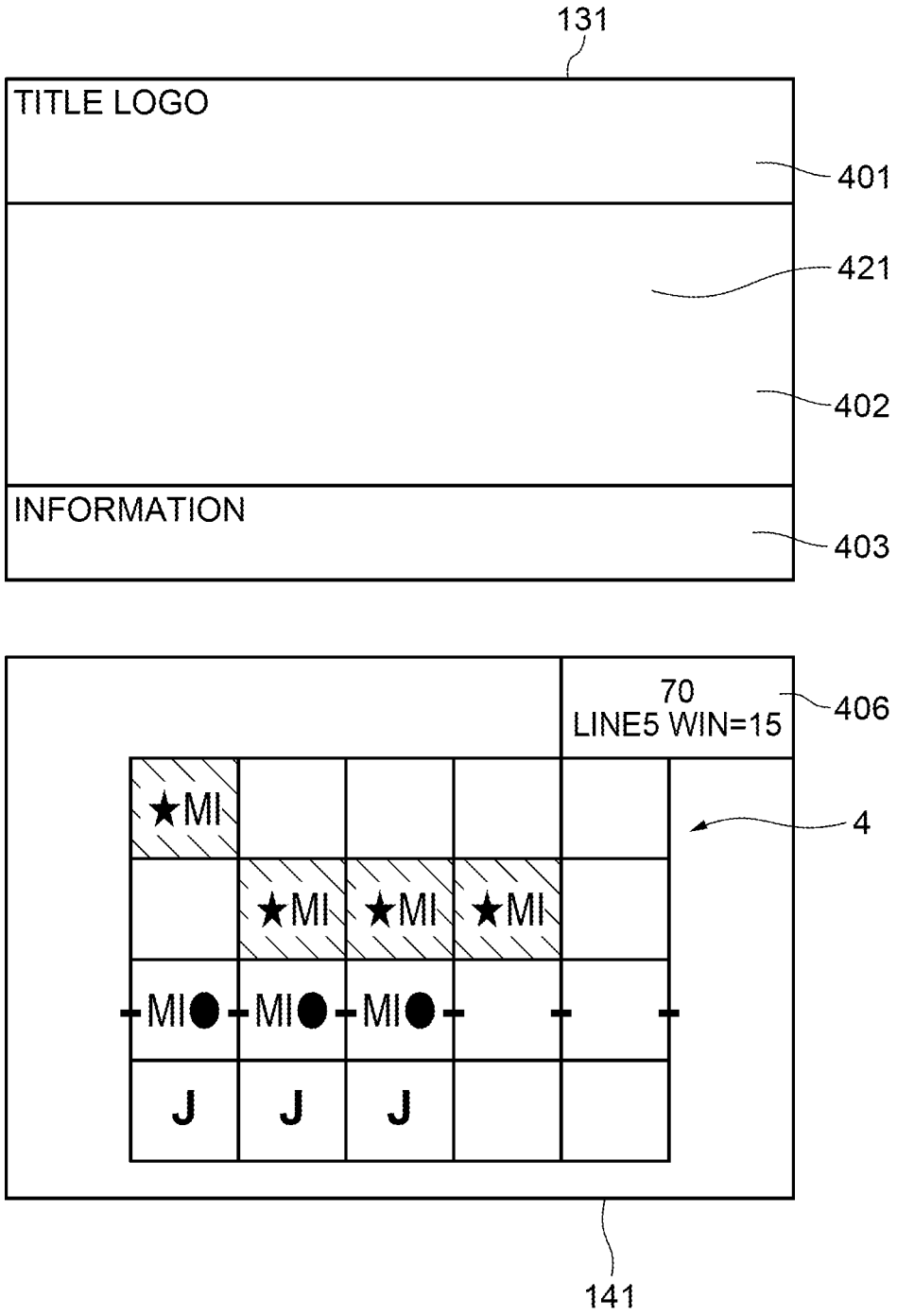
FIG. 33 is a diagram illustrating the flow of the WIN presentation effects in the slot machine according to the embodiment of the present invention.

Thereafter, the display mode shifts from that shown in FIG. 32 to that shown in FIG. 33. However, when GAMBLE is ON, upon finishing GAMBLE or after TAKE WIN, and when GAMBLE is OFF, 5 seconds after finishing the increment display of the WIN gross amount, the display mode shifts from that shown in FIG. 32 to that shown in FIG. 33.

As shown in FIG. 33, in the image 402 on the upper side image display panel 131, the WIN signboard 421 is erased. On the lower side image display panel 141, the loop display is continued to be conducted in ascending order of the LINE Nos. In the WIN meter 406 on the lower side image display panel 141, the total WIN amount is continued to be displayed. In the lower row in which the breakdown is displayed, the loop display is continued to be conducted in ascending order of the LINE Nos. In FIG. 33, "LINE 5 WIN=15" is displayed again.

<WIN Signboard>

Figure 34A:
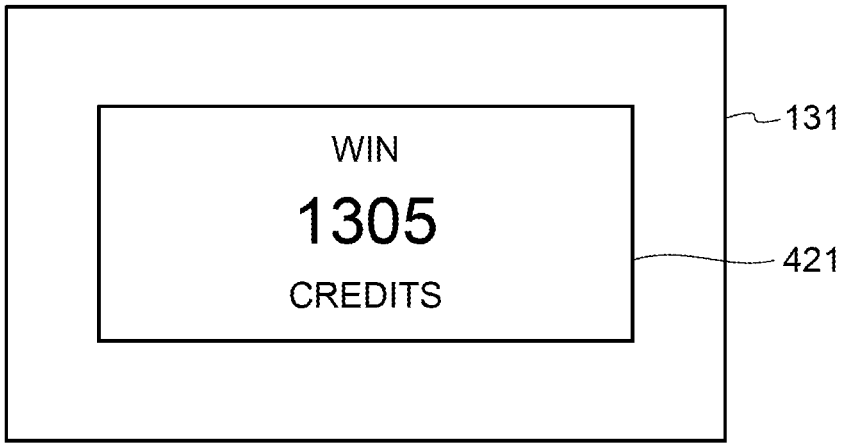
FIG. 34A is a diagram illustrating a WIN signboard in the slot machine according to the embodiment of the present invention.
Figure 34B:
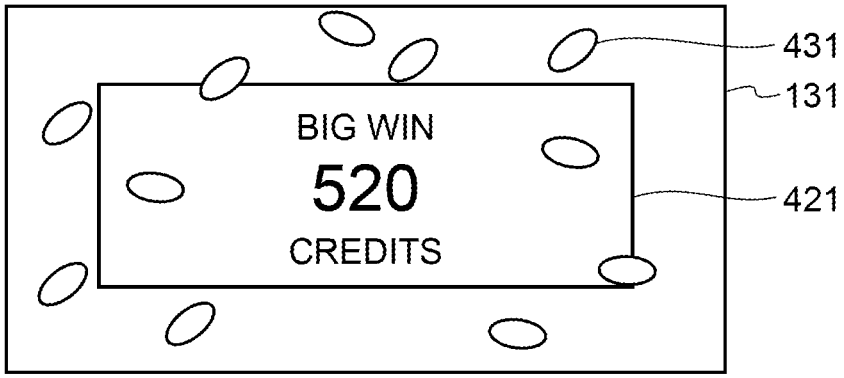
FIG. 34B is a diagram illustrating a WIN signboard in the slot machine according to the embodiment of the present invention.
Figure 34C:
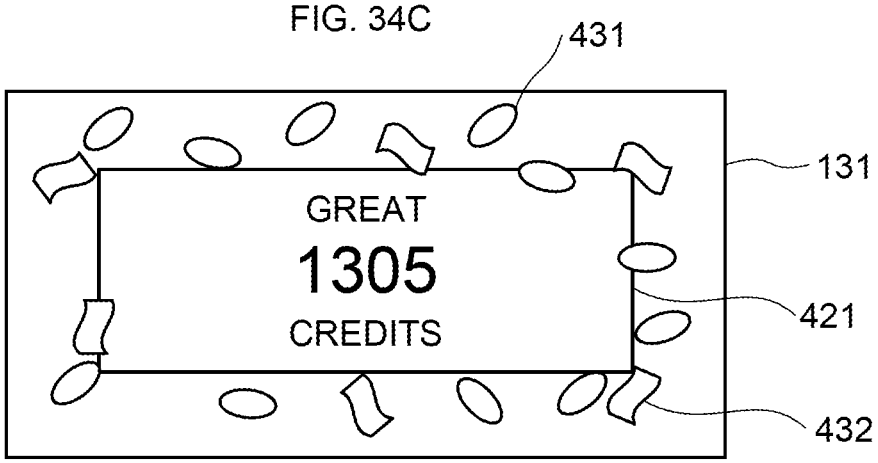
FIG. 34C is a diagram illustrating a WIN signboard in the slot machine according to the embodiment of the present invention.

Here, with reference to FIG. 34A to 34C, the WIN signboard will be described. FIG. 34A to 34C is a diagram illustrating the WIN signboard of the slot machine according to the embodiment of the present invention.

In the embodiment of the present invention, as shown in FIG. 34A to 34C, there are three kinds of WIN signboards 421, which are displayed on the upper side image display panel 131. However, since for each of the three kinds, another version for 1-credit payout is prepared, there are actually six kinds. Because symbols associated with the 1-credit payout are present, only when the display language is English, it is required that the WIN signboards 421 be used differently in a case where the TOTAL WIN amount is one and in a case where the TOTAL WIN amount is two or more.

On a silver signboard 421 shown in FIG. 34A, when a TOTAL WIN amount of that spinning is less than 15 times the BET amount, the TOTAL WIN amount is displayed on the upper side image display panel 131.

On a first gold signboard 421 shown in FIG. 34B, when a TOTAL WIN amount of that spinning is greater than or equal to 15 times and less than 50 times the BET amount, the TOTAL WIN amount is displayed on the upper side image display panel 131. On the first gold signboard 421, presentation effects in which coins 431 are falling are performed.

In contrast to this, when the increment amount exceeds 50 times the BET amount, on the upper side image display panel 131, the first gold signboard 421 shown in FIG. 34B is changed to a second gold signboard 421 shown in FIG. 34C. On the second gold signboard 421, presentation effects in which coins 431 and bills 432 are falling are performed. In other words, on the upper side image display panel 131, the presentation effects in which the coins 431 are falling are first performed on the first gold signboard 421. In accordance with the increment display in the WIN meter 406, the won credit is incremented on the first gold signboard 421. Further, at the time point at which the increment amount exceeds 50 times the BET amount, the first gold signboard 421 shown in FIG. 34B is rewritten to the second gold signboard 421 shown in FIG. 34C. On the second gold signboard 421, the presentation effects in which the coins 431 and the bills 432 are falling are performed.

<Sound Effects Upon Appearance of Three Feature Symbols>

Here, with reference to FIG. 35 to FIG. 37, sound effects upon the appearance of the three feature symbols will be described. Each of FIG. 35 to FIG. 37 is a diagram explaining the sound effects upon the appearance of the three feature symbols of the slot machine according to the embodiment of the present invention.

Upon the appearance of the three feature symbols, dedicated ring-ring sound is reproduced. As the timing thereof, for three seconds from when 30 frames have passed through after the stoppage of all of the reels up to when the increment is started, the sound is reproduced. During the reproduction of the ring-ring sound, the display of symbol animation and LINE WIN and the increment display are halted. Upon retriggering during each of the free games, the same applied thereto. However, after the retriggering has been conducted during that free game, waiting of the 30 frames and the reproduction of the ring-ring sound are not conducted.

Figure 35:
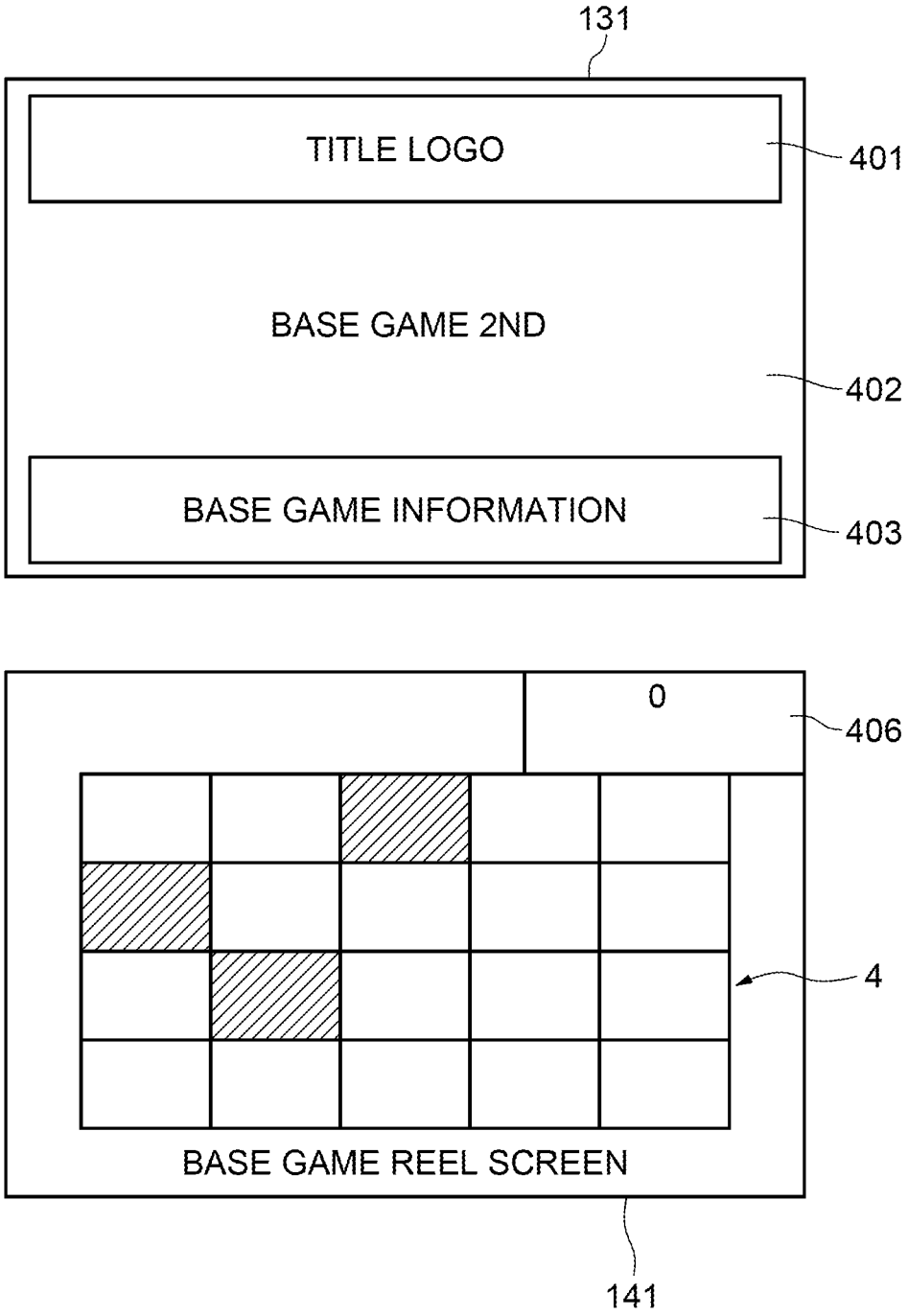
FIG. 35 is a diagram explaining sound effects upon the appearance of three feature symbols in the slot machine according to the embodiment of the present invention.
Figure 36:
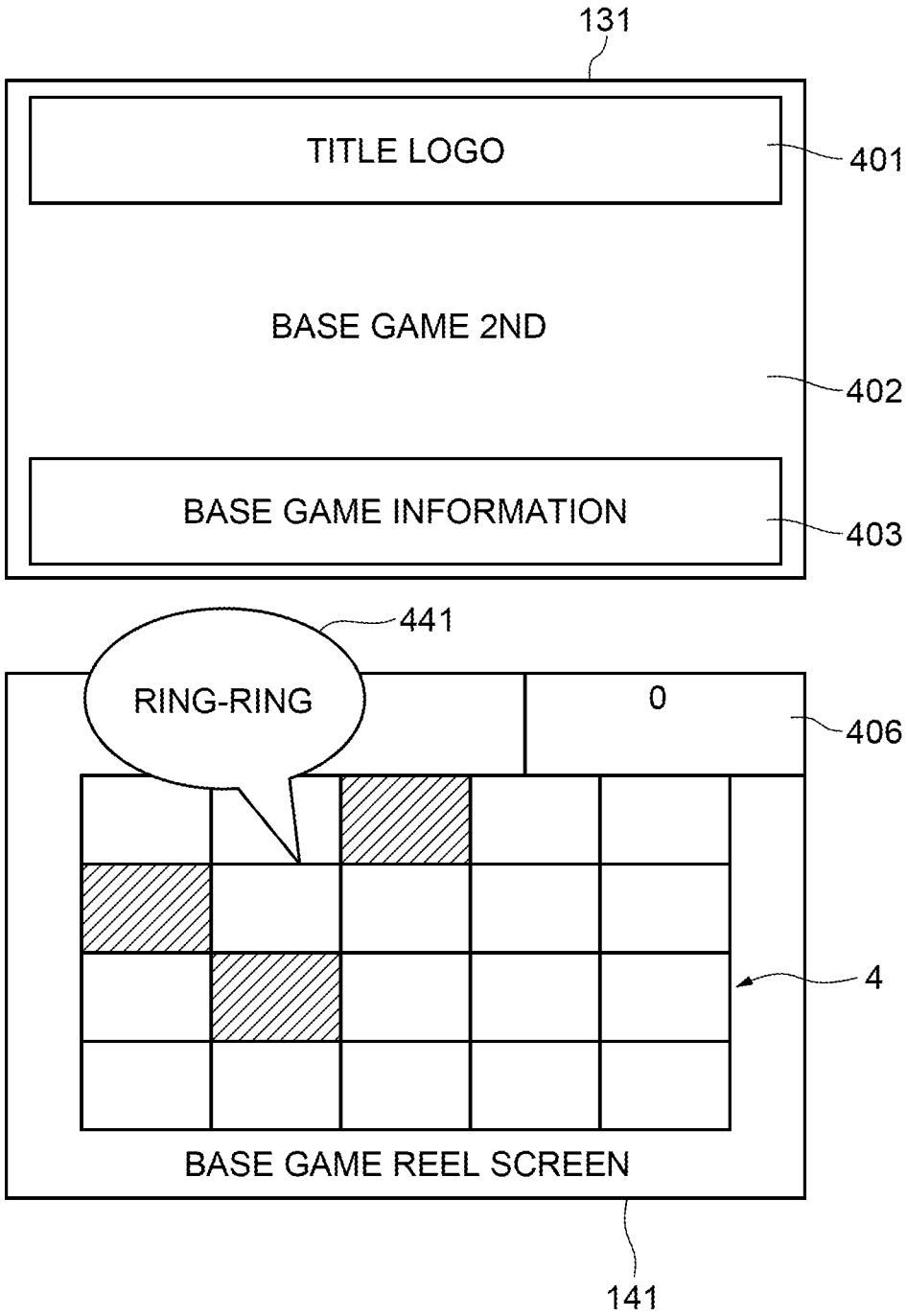
FIG. 36 is a diagram explaining the sound effects upon the appearance of three feature symbols in the slot machine according to the embodiment of the present invention.

In the embodiment of the present invention, as shown in FIG. 35, when in the symbol display area 4 on the lower side image display panel 141, the three feature symbols have appeared upon the stoppage of all of the reels, the waiting time of the 30 frames from then is set. When the waiting time of the 30 frames has passed, as shown in FIG. 36, as the sound effects upon the appearance of the three feature symbols, as indicated by a balloon 441, the ring-ring sound is reproduced for three seconds.

Figure 37:
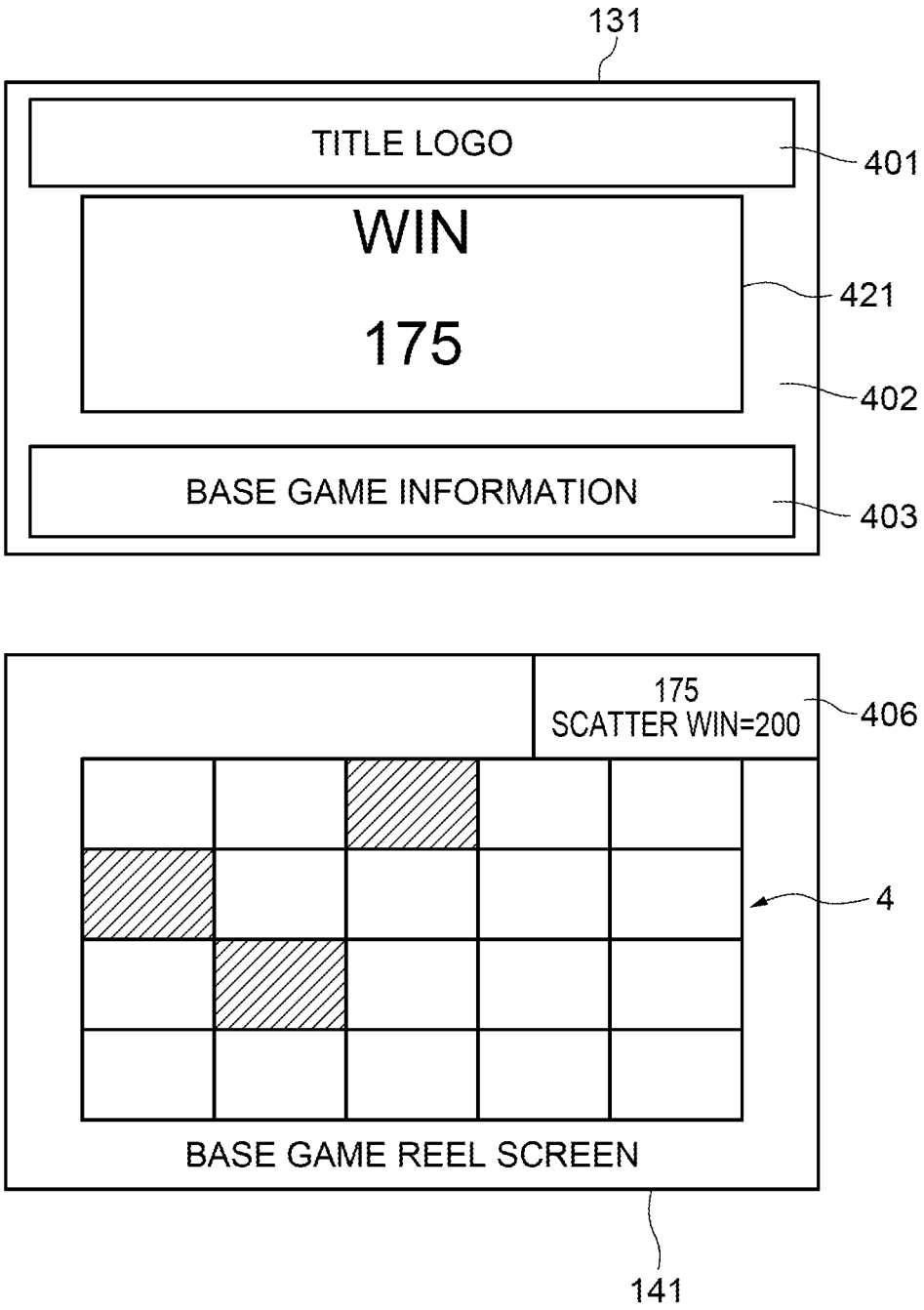
FIG. 37 is a diagram explaining the sound effects upon the appearance of three feature symbols in the slot machine according to the embodiment of the present invention.

When these three seconds have passed, as shown in FIG. 37, in the symbol display area 4 on the lower side image display panel 141, the presentation effects of the LINE WIN is started and the symbol animation is started. In addition, in the image 402 on the upper side image display panel 131, the WIN signboard 421 is displayed. On the WIN signboard 421, the increment display is started. Concurrently, also in the WIN meter 406 on the lower side image display panel 141, the increment display is started. Further, increment sound is started. Thereafter, the processing shifts to the flow of the above-described WIN presentation effects.

<TOTAL WIN Signboard after Free Games>

Figure 38A:
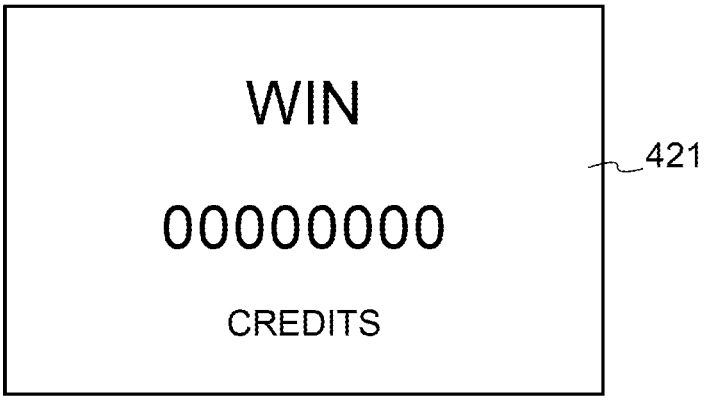
FIG. 38A is a diagram illustrating a TOTAL WIN signboard after free games in the slot machine according to the embodiment of the present invention.
Figure 38B:
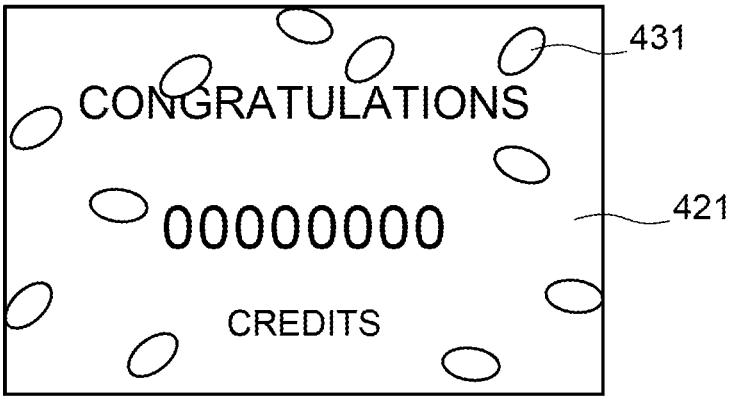
FIG. 38B is a diagram illustrating a TOTAL WIN signboard after free games in the slot machine according to the embodiment of the present invention.
Figure 38C:
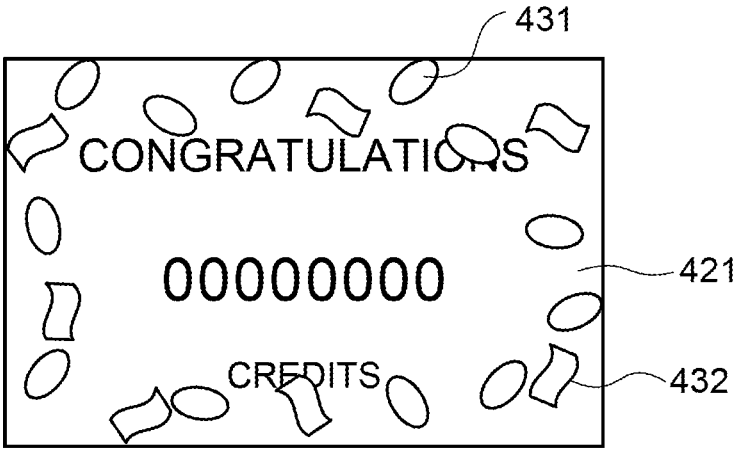
FIG. 38C is a diagram illustrating a TOTAL WIN signboard after free games in the slot machine according to the embodiment of the present invention.

Here, with reference to FIG. 38A to 38C, a TOTAL WIN signboard after the free games will be described. FIG. 38A to 38C is a diagram illustrating the TOTAL WIN signboard after the free games of the slot machine according to the embodiment of the present invention.

After finishing the free games, TOTAL won credits are displayed on the lower side image display panel 141. Depending on an amount of the won credits (by how many times the TOTAL BET is), three kinds of presentation effects are used so as to be associated therewith.

When a value of the TOTAL won credits is less than 20 times as the value of the TOTAL BET, the silver signboard 421 shown in FIG. 38A is displayed on the lower side image display panel 141 for 3.6 seconds. When a value of the TOTAL won credits is greater than or equal to 20 times and less than 50 times the value of the TOTAL BET, the first gold signboard 421 shown in FIG. 38B is displayed on the lower side image display panel 141 for 6 seconds. On the first gold signboard 421, the presentation effects in which the coins 431 are falling are performed. When a value of the TOTAL won credits is greater than or equal to 50 times the value of the TOTAL BET, the second gold signboard 421 shown in FIG. 38C is displayed on the lower side image display panel 141 for 10 seconds. On the second gold signboard 421, the presentation effects in which the coins 431 and the bills 432 are falling are performed.

[Free Game Presentation Effects]

The WIN presentation effects of the slot machine 1 are as described above. Next, with reference to FIG. 39 to FIG. 54, free game presentation effects of the slot machine 1 will be described.

<Presentation Effects Upon Introduction of Free Games>

Here, with reference to FIG. 39 to FIG. 43, presentation effects upon the introduction of the free games will be described. Each of FIG. 39 to FIG. 43 is a diagram illustrating the presentation effects upon the introduction of the free games of the slot machine according to the embodiment of the present invention.

Figure 39:
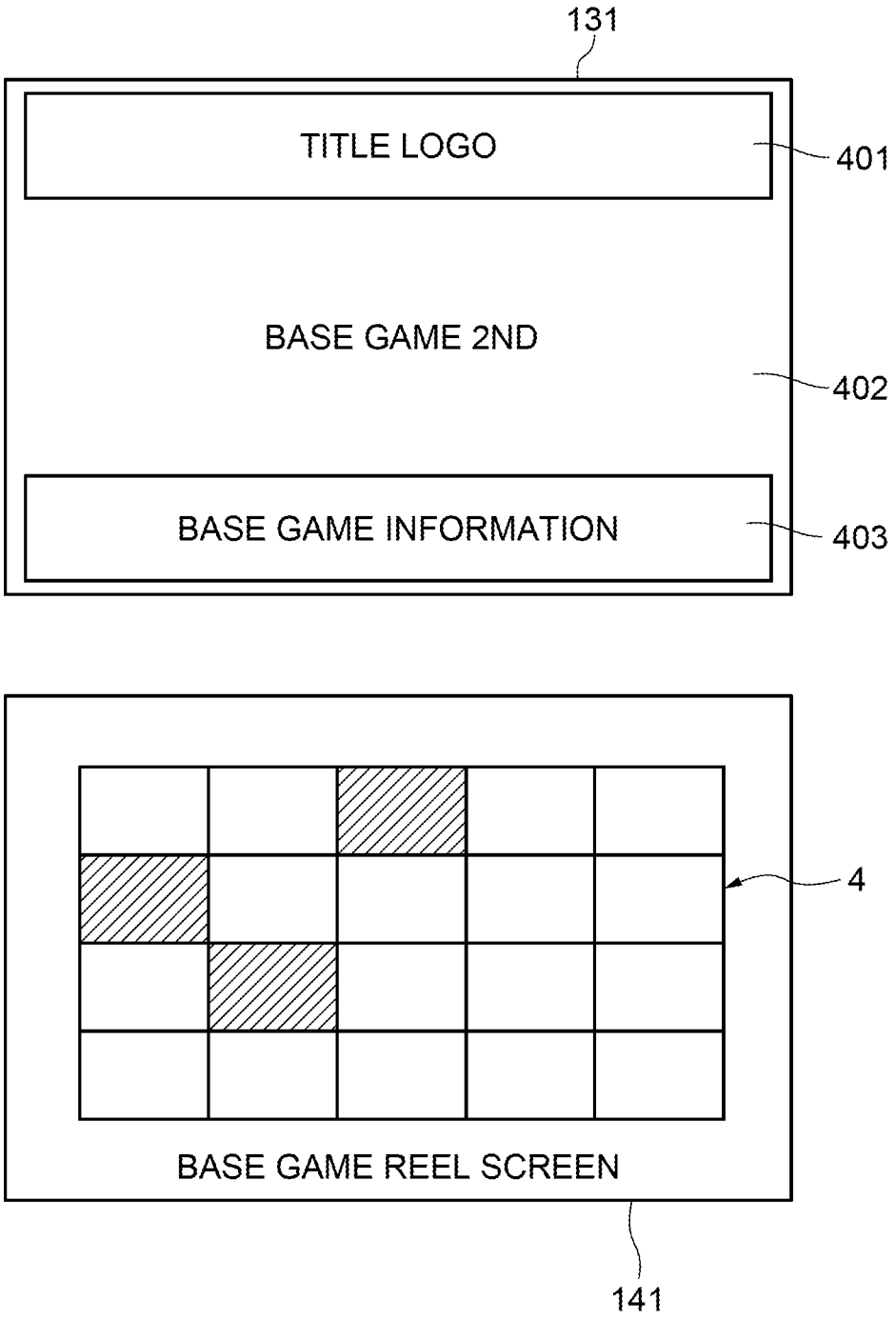
FIG. 39 is a diagram illustrating presentation effects upon the introduction of the free games in the slot machine according to the embodiment of the present invention.
Figure 40:
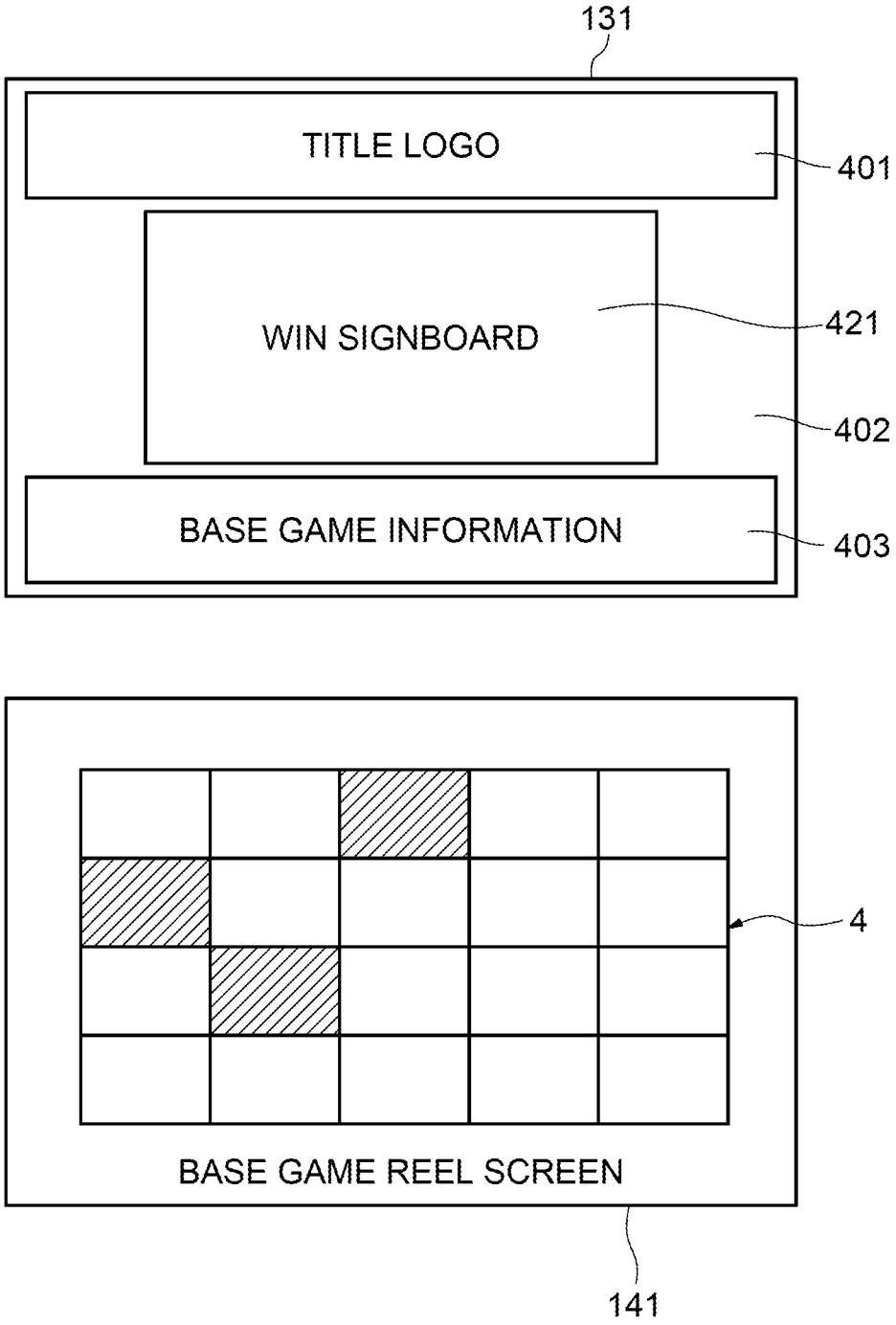
FIG. 40 is a diagram illustrating the presentation effects upon the introduction of the free games in the slot machine according to the embodiment of the present invention.

As shown in FIG. 39, when the three feature symbols (indicated by shaded areas) have appeared in the symbol display area 4 on the lower side image display panel 141, as described above, the ring-ring sound as the sound effects is reproduced. Next, as shown in FIG. 40, the WIN signboard 421 is displayed in the image 402 on the upper side image display panel 131. On the WIN signboard 421, the increment display is conducted.

Figure 41:
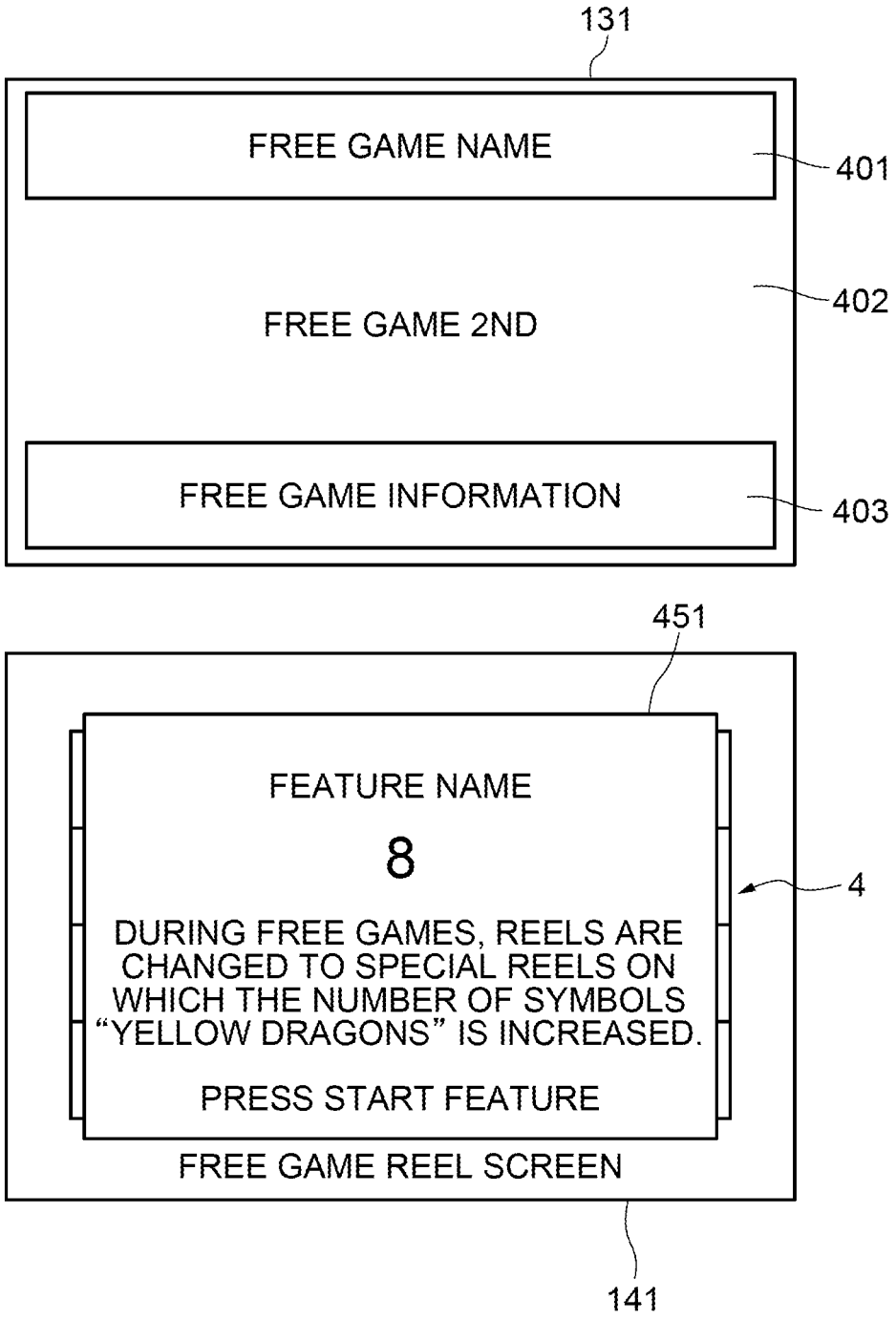
FIG. 41 is a diagram illustrating the presentation effects upon the introduction of the free games in the slot machine according to the embodiment of the present invention.
Figure 42:
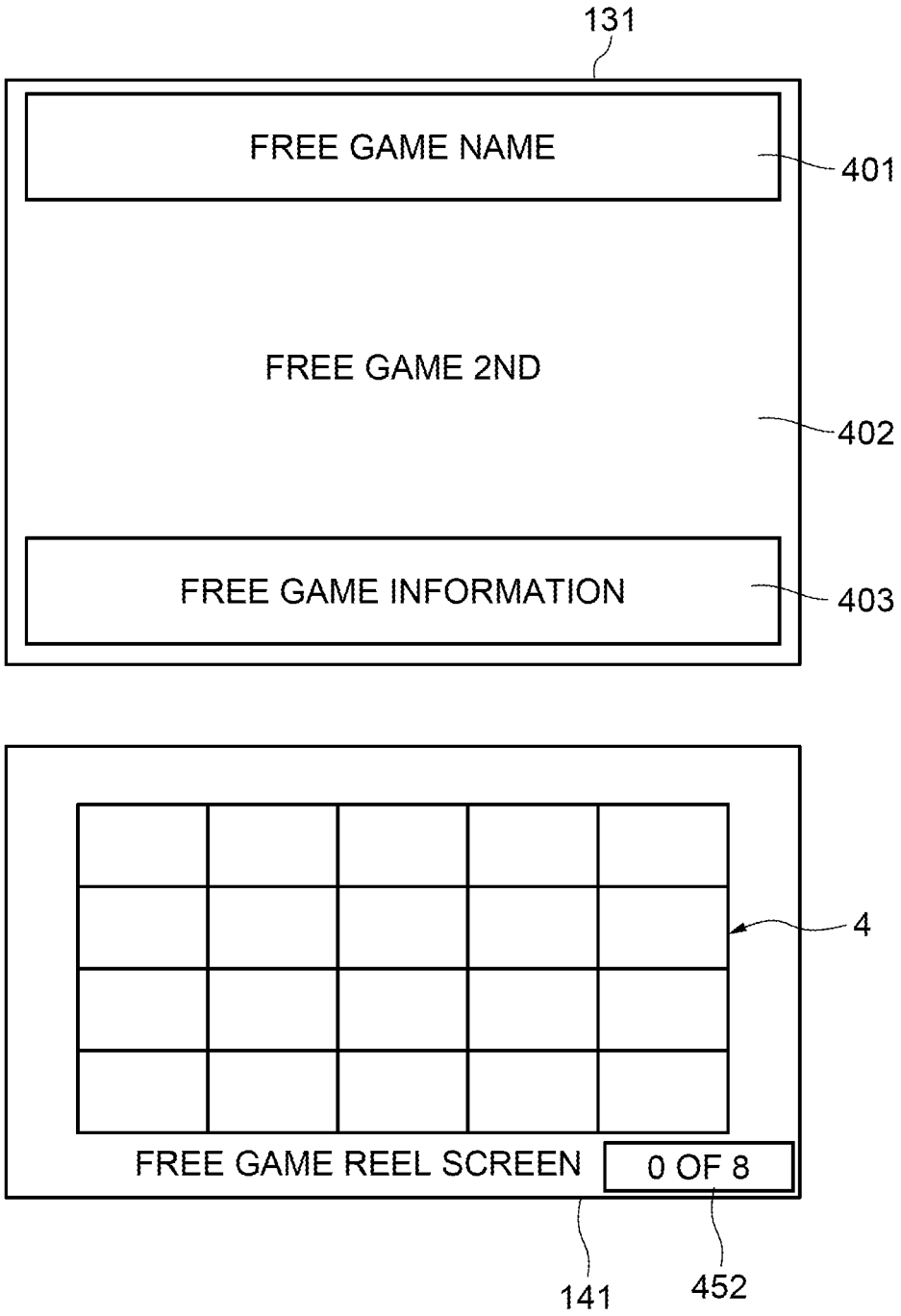
FIG. 42 is a diagram illustrating the presentation effects upon the introduction of the free games in the slot machine according to the embodiment of the present invention.
Figure 43:
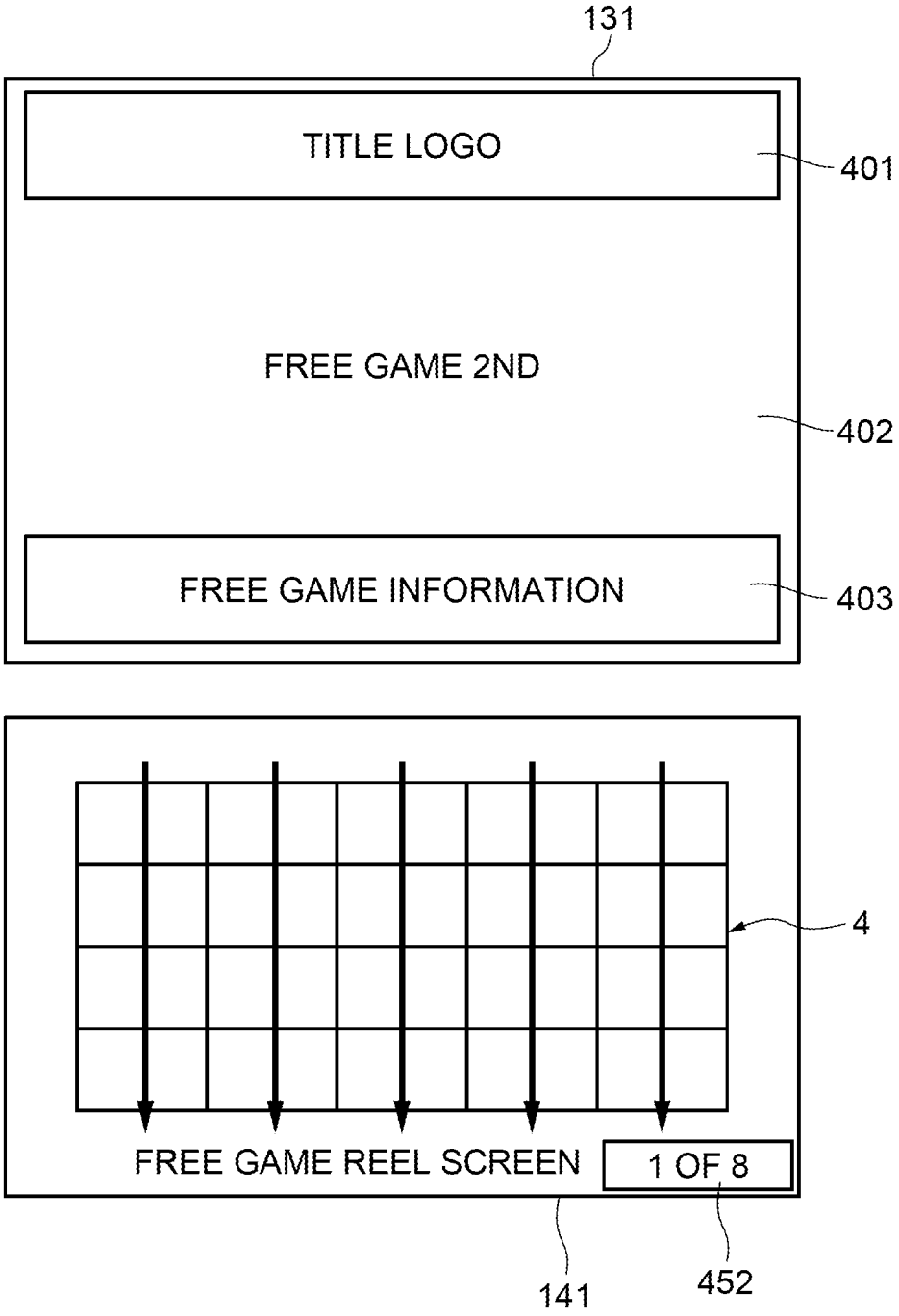
FIG. 43 is a diagram illustrating the presentation effects upon the introduction of the free games in the slot machine according to the embodiment of the present invention.

After the increment display has been finished or skipped, as shown in FIG. 41, in the symbol display area 4 on the lower side image display panel 141, a free game introduction presentation effects board 451 is displayed. On the free game introduction presentation effects board 451, an introduction message is displayed. When a START FEATURE button is pressed, as shown in FIG. 42, the lower side image display panel 141 and the upper side image display panel 131 are switched to screens used during the free games. The information area 403 on the upper side image display panel 131 is switched to an area used for the free games. Below the symbol display area 4 on the lower side image display panel 141, a free game counter 452 is displayed. As shown in FIG. 43, in the symbol display area 4 on the lower side image display panel 141, the rotation of all of the reels is started. On the free game counter 452 on the lower side image display panel 141, "1 of 8" indicating that the first one of the free games is started is displayed.

<Presentation Effects Upon Finishing Free Games>

Figure 44:
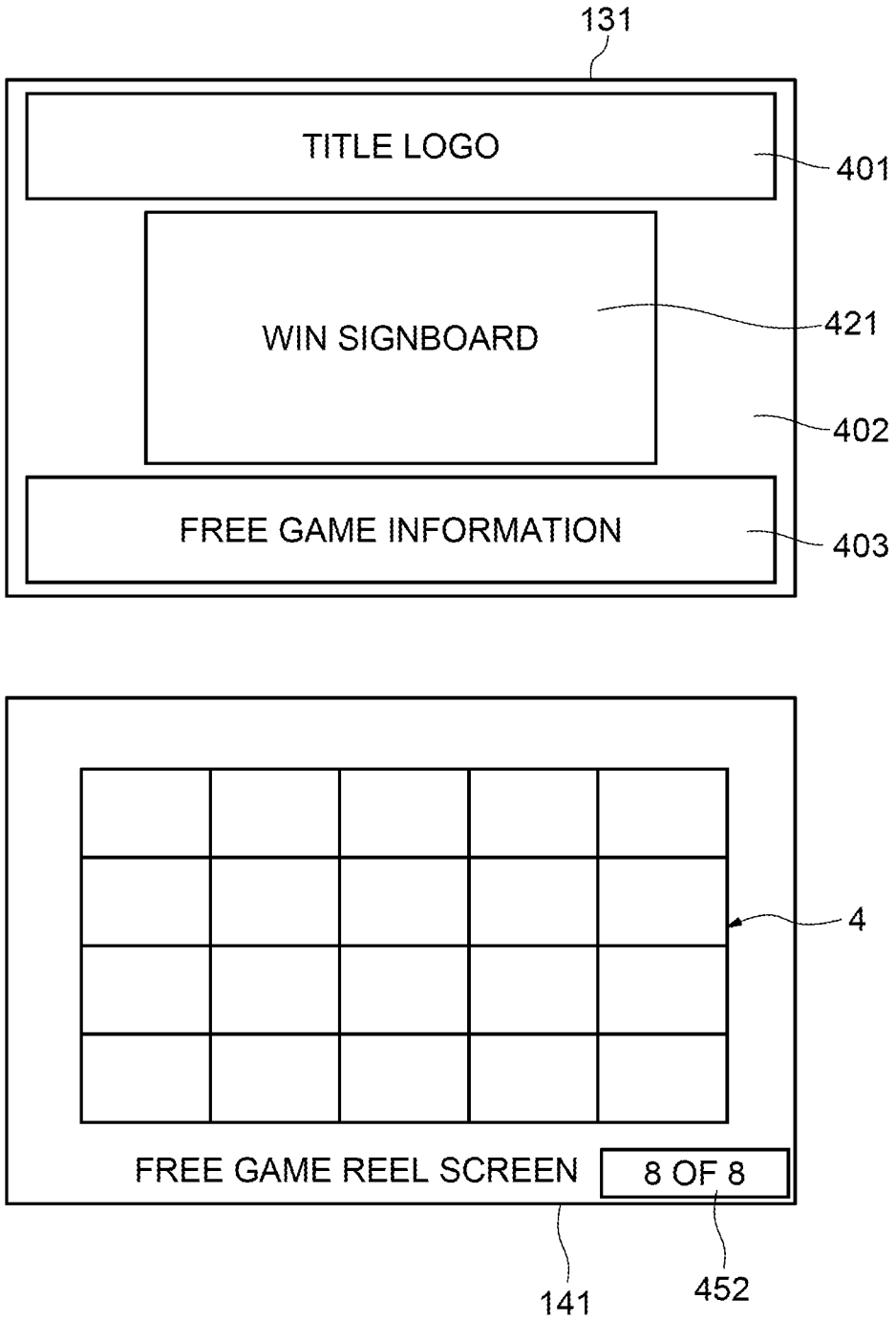
FIG. 44 is a diagram illustrating presentation effects upon finishing the free games in the slot machine according to the embodiment of the present invention.
Figure 45:
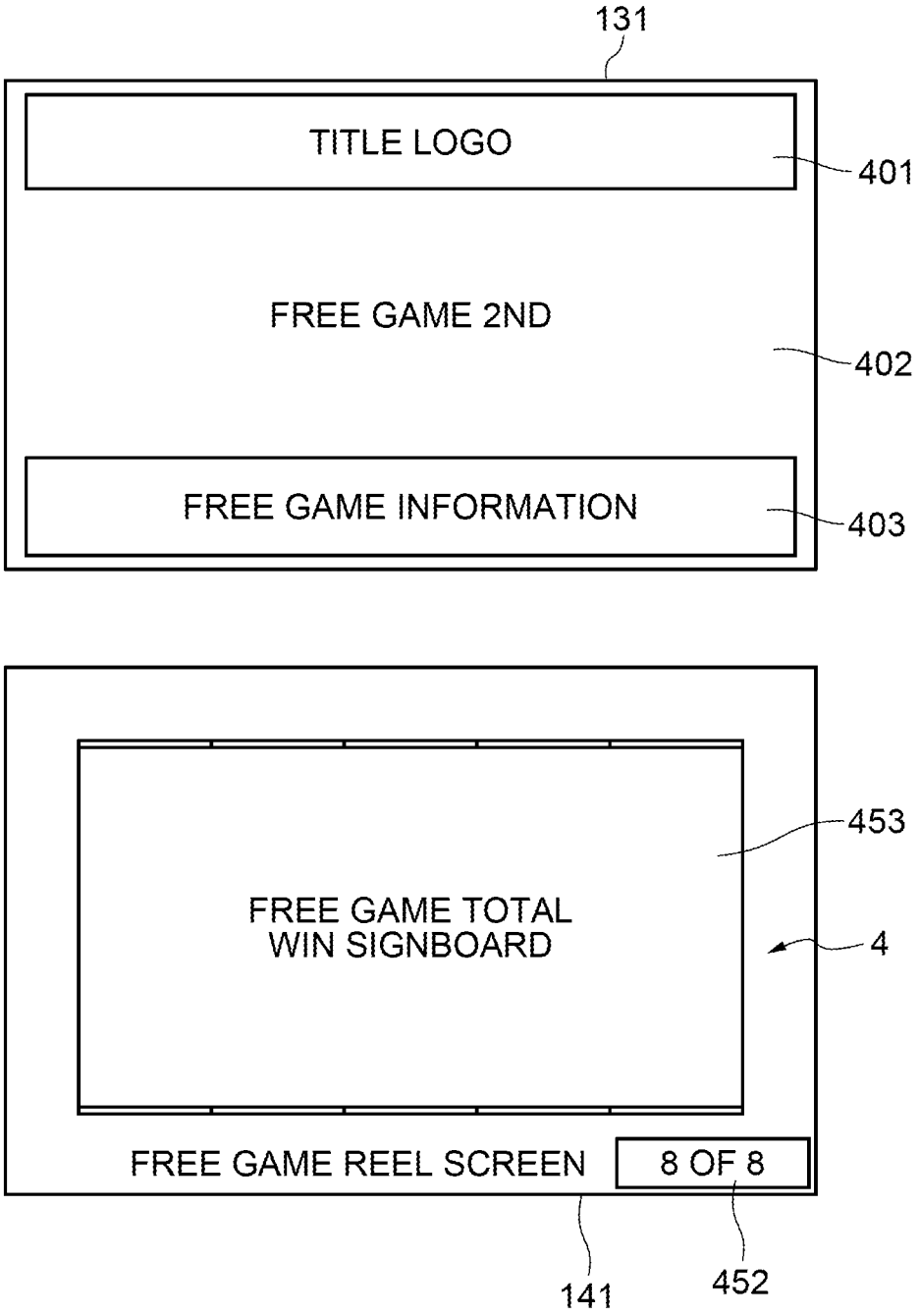
FIG. 45 is a diagram illustrating the presentation effects upon finishing the free games in the slot machine according to the embodiment of the present invention.
Figure 46:
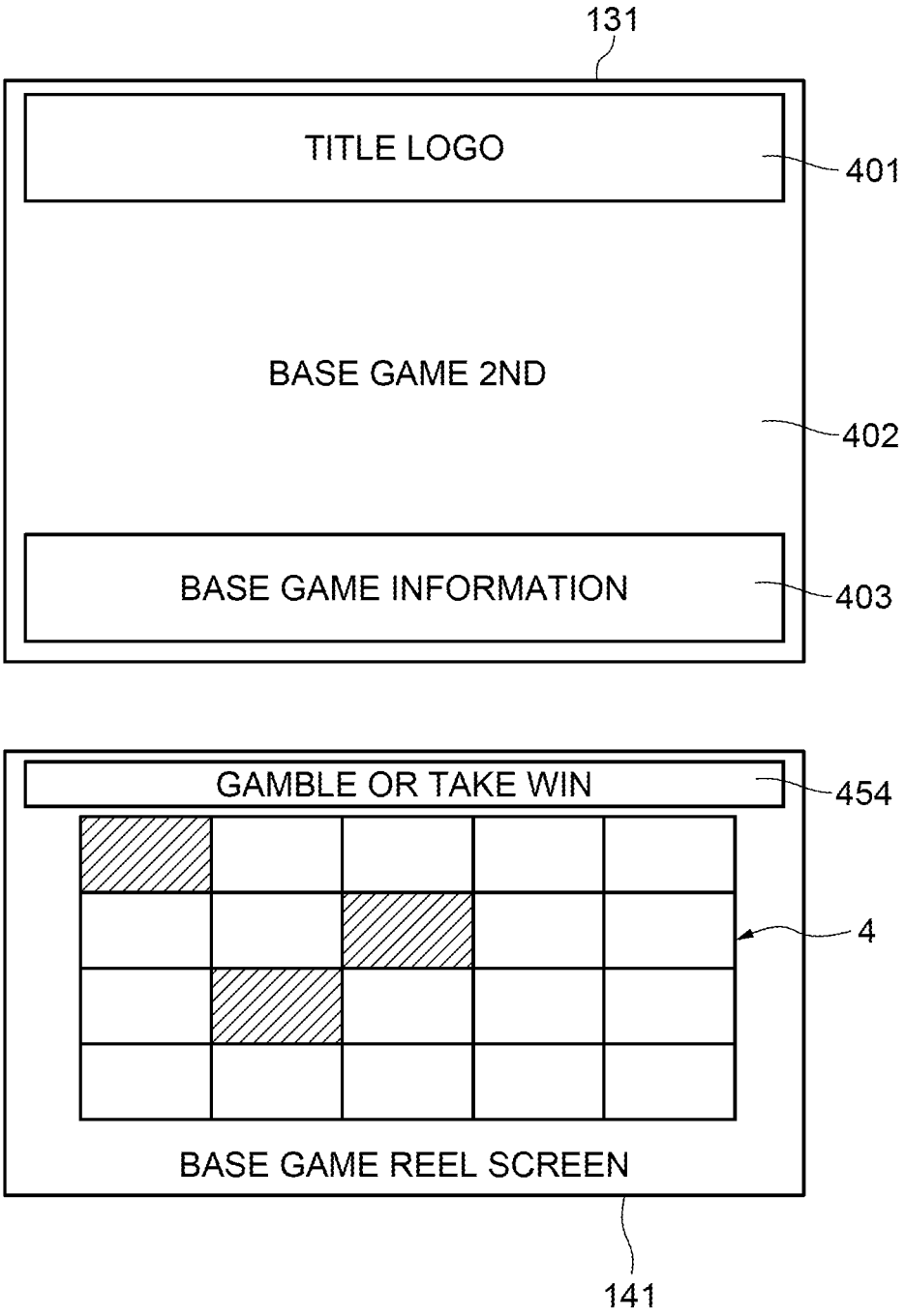
FIG. 46 is a diagram illustrating the presentation effects upon finishing the free games in the slot machine according to the embodiment of the present invention.

Here, with reference to FIG. 44 to FIG. 46, presentation effects upon finishing the free games will be described. Each of FIG. 44 to FIG. 46 is a diagram illustrating the presentation effects upon finishing the free games of the slot machine according to the embodiment of the present invention.

As shown in FIG. 44, when in the symbol display area 4 on the lower side image display panel 141, the final spinning has been finished, on the free game counter 452 on the lower side image display panel 141, "8 of 8" indicating that the free games have been finished is displayed. In the image 402 on the upper side image display panel 131, the WIN signboard 421 is displayed. However, when a value of the won credits is zero, the WIN signboard 421 is not displayed.

When the WIN signboard 421 has disappeared from the image 402 on the upper side image display panel 131, as shown in FIG. 45, in the symbol display area 4 on the lower side image display panel 141, a free game total WIN signboard 453 is displayed. On the free game total WIN signboard 453, the won credits in the free games are displayed. However, when a value of the won credits in the free games is zero, the free game total WIN signboard 453 is not displayed.

When the free game total WIN signboard 453 has disappeared from the symbol display area 4 on the lower side image display panel 141, as shown in FIG. 46, the upper side image display panel 131 and the lower side image display panel 141 are switched to the base game screens. At this time, the video reels 3 are changed to the video reel strips for the base game. A state of the changed video reel strips for the base game is returned to the state upon triggering the free games. In addition, above the symbol display area 4 on the lower side image display panel 141, a display frame 454 in which "GAMBLE OR TAKE WIN" is displayed is provided. When in the symbol display area 4 on the lower side image display panel 141 shown in FIG. 45, the free game total WIN signboard 453 is not displayed, after a lapse of two seconds from when the final spinning was finished, as shown in FIG. 46, the upper side image display panel 131 and the lower side image display panel 141 are switched to the base game screens.

<Presentation Effects Upon Retriggering>

Here, with reference to FIG. 47 to FIG. 50, presentation effects upon retriggering will be described. Each of FIG. 47 to FIG. 50 is a diagram illustrating the presentation effects upon the retriggering in the slot machine according to the embodiment of the present invention.

Figure 47:
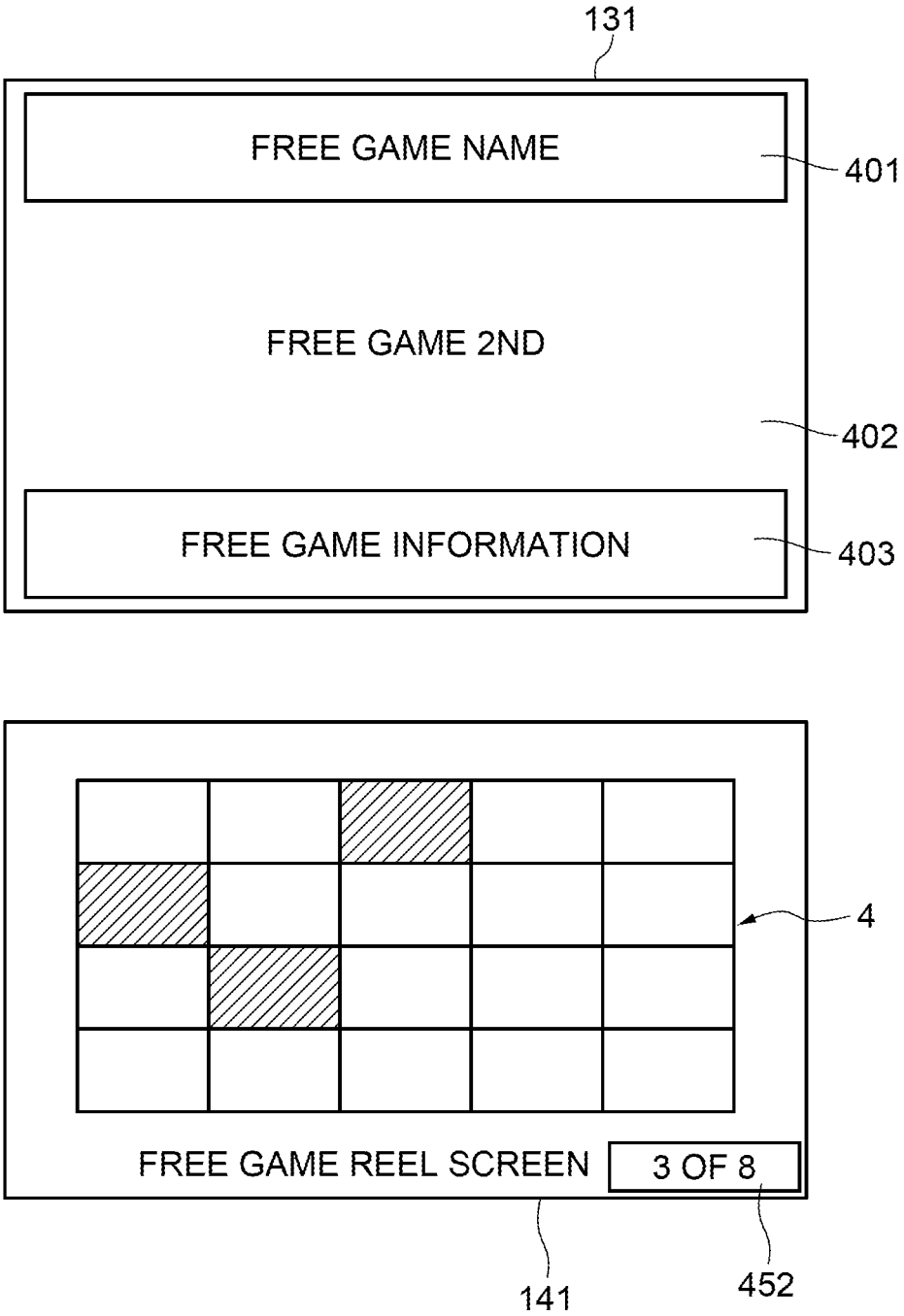
FIG. 47 is a diagram illustrating presentation effects upon the retriggering in the slot machine according to the embodiment of the present invention.

As shown in FIG. 47, when in the symbol display area 4 on the lower side image display panel 141, the three feature symbols (indicated by shaded areas) have appeared, as described above, the ring-ring sound as the sound effects is reproduced. In FIG. 47, since on the free game counter 452 on the lower side image display panel 141, "3 of 8" is displayed, the three feature symbols (indicated by the shaded areas) have appeared in the third one of the free games.

Figure 48:
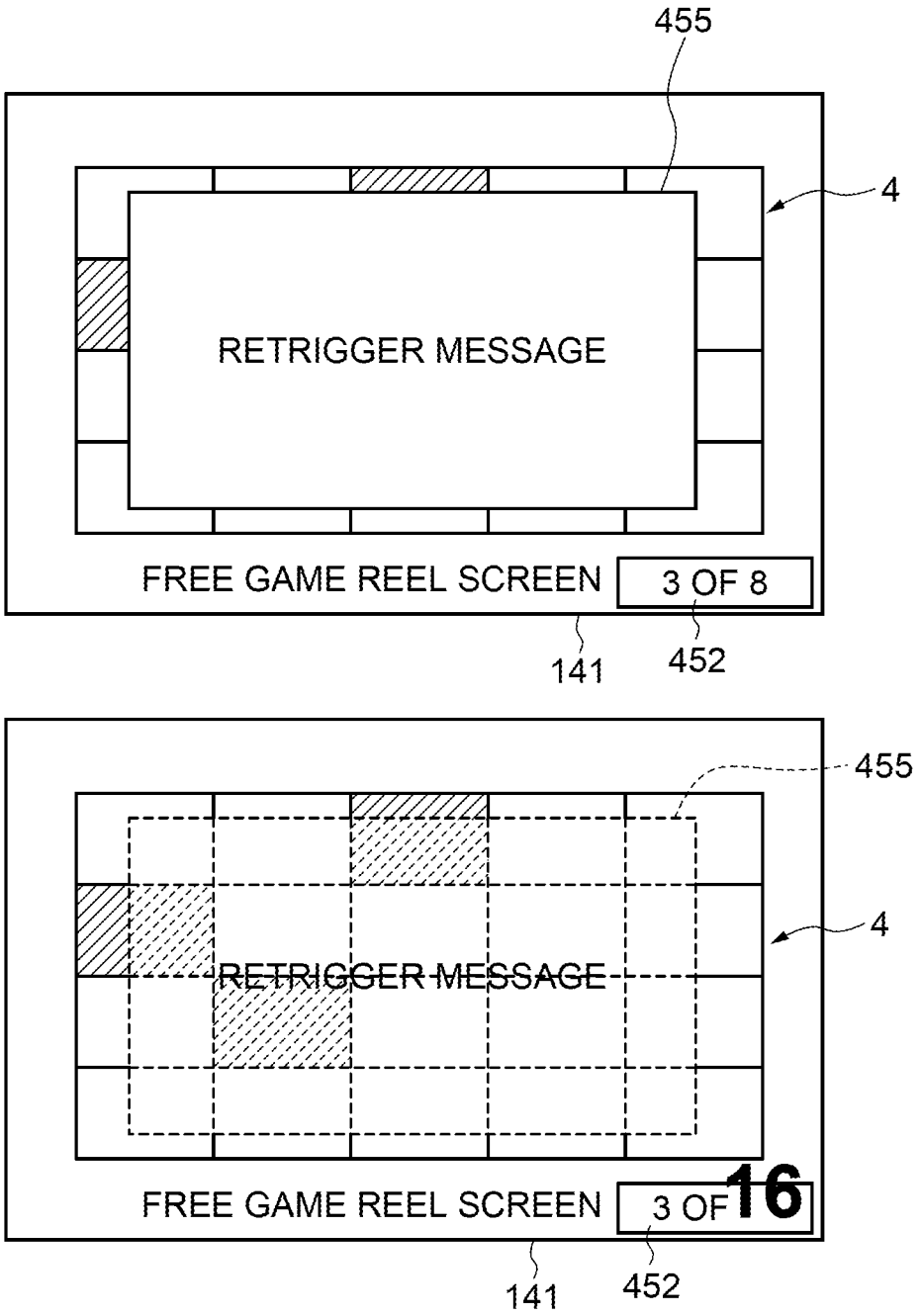
FIG. 48 is a diagram illustrating the presentation effects upon the retriggering in the slot machine according to the embodiment of the present invention.

Next, as shown in the upper row in FIG. 48, in the symbol display area 4 on the lower side image display panel 141, a retrigger message board 455 is displayed. On the retrigger message board 455, a message related to the retriggering is displayed. When the message has disappeared or a button skip is conducted, as shown in a lower area in FIG. 48, the retrigger message board 455 is erased from the symbol display area 4 on the lower side image display panel 141. Added to the total count of the free game counter is "8". In other words, on the free game counter 452 on the lower side image display panel 141, "3 of 16" is displayed. When the lower side image display panel 141 is displayed as shown in an upper area or the lower area in FIG. 48, a state in which the upper side image display panel 131 is as shown in FIG. 47 is maintained.

Figure 49:
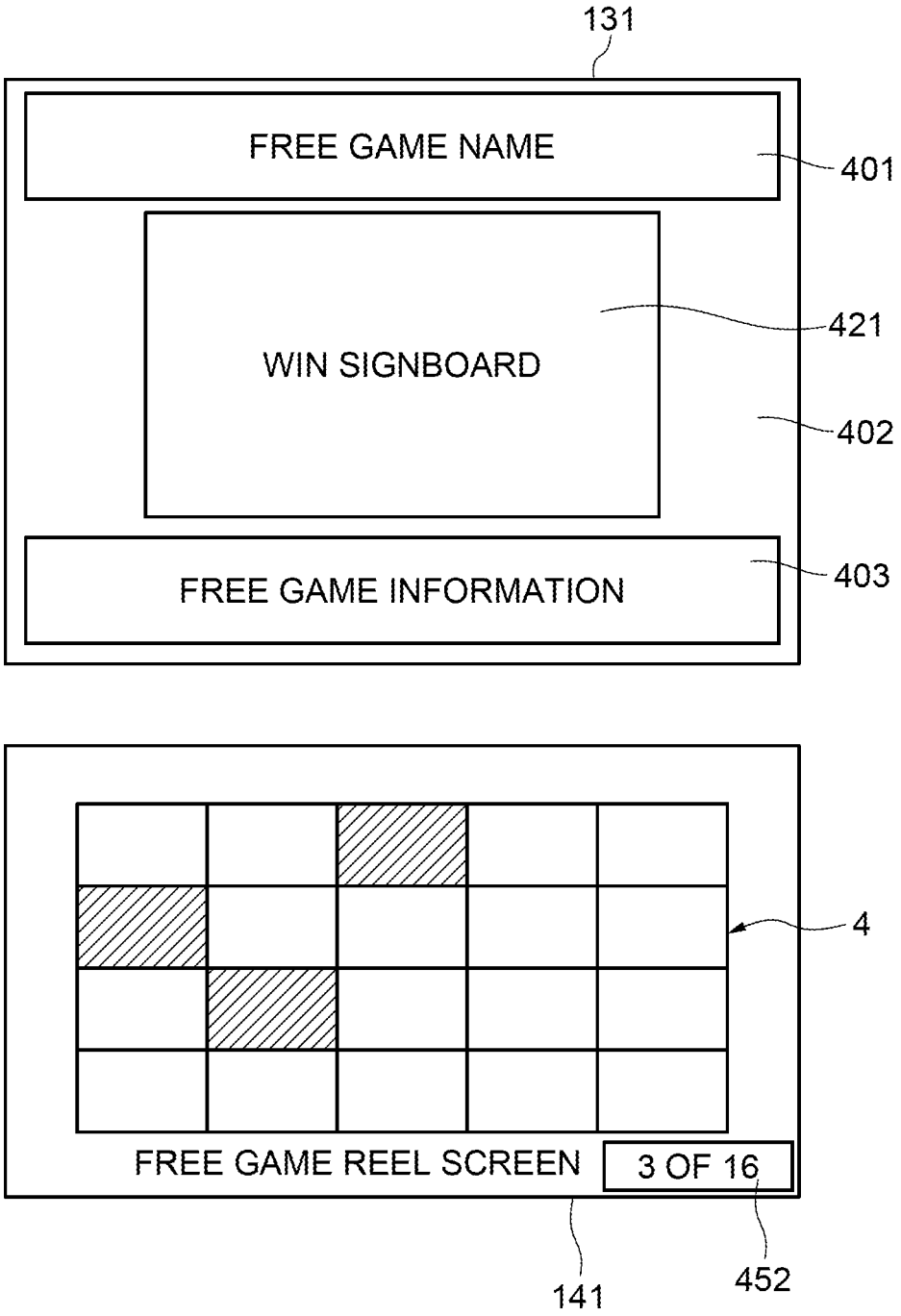
FIG. 49 is a diagram illustrating the presentation effects upon the retriggering in the slot machine according to the embodiment of the present invention.
Figure 50:
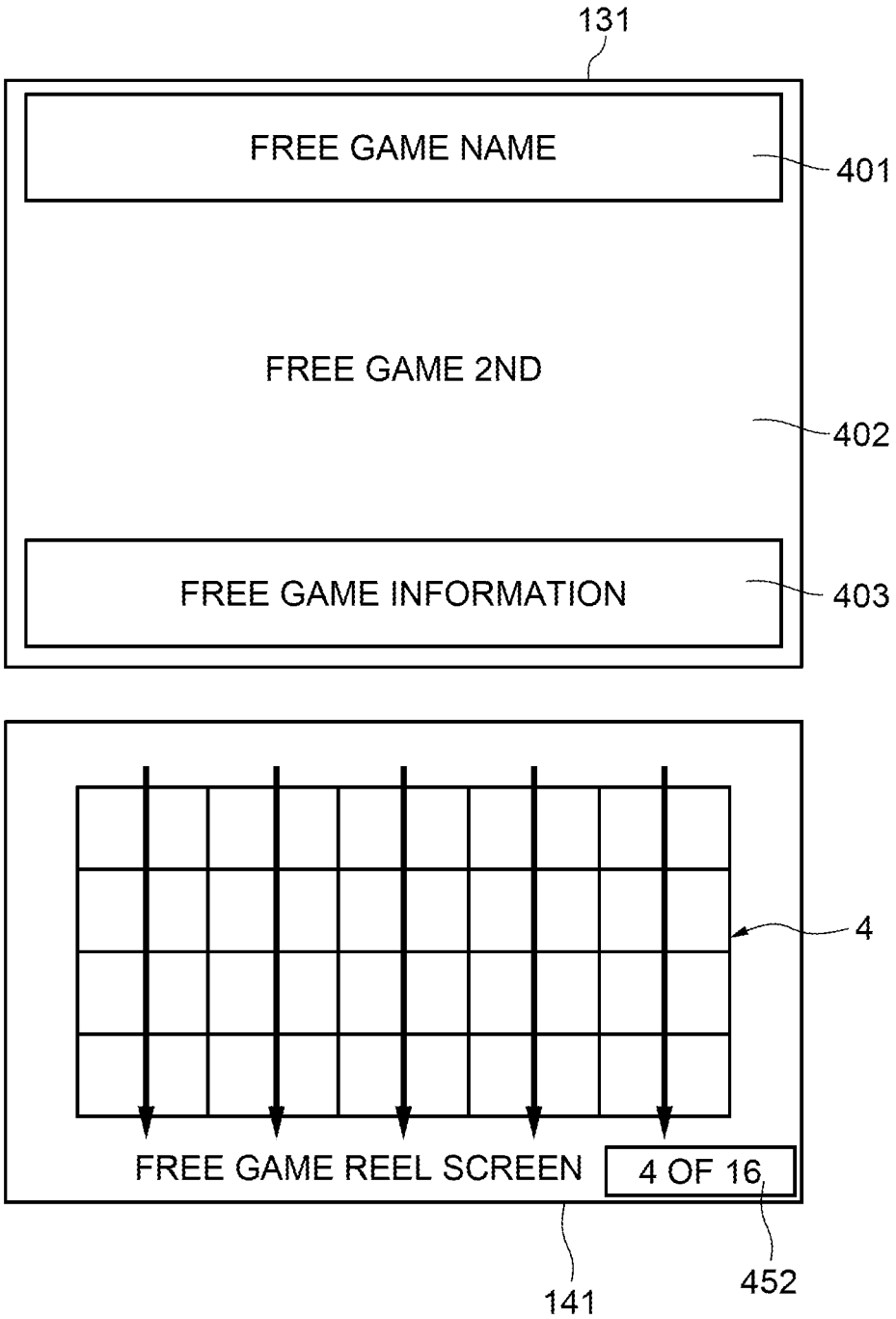
FIG. 50 is a diagram illustrating the presentation effects upon the retriggering in the slot machine according to the embodiment of the present invention.

As shown in FIG. 49, in the image 402 on the upper side image display panel 131, the WIN signboard 421 is displayed. When the increment display on the WIN signboard 421 has been finished or the button skip is conducted, as shown in FIG. 50, the rotation of all of the reels is started in the symbol display area 4 on the lower side image display panel 141. On the free game counter 452 on the lower side image display panel 141, "4 of 16" indicating that the fourth one of the free games is started is displayed.

<Screen During Free Games>

Figure 51:
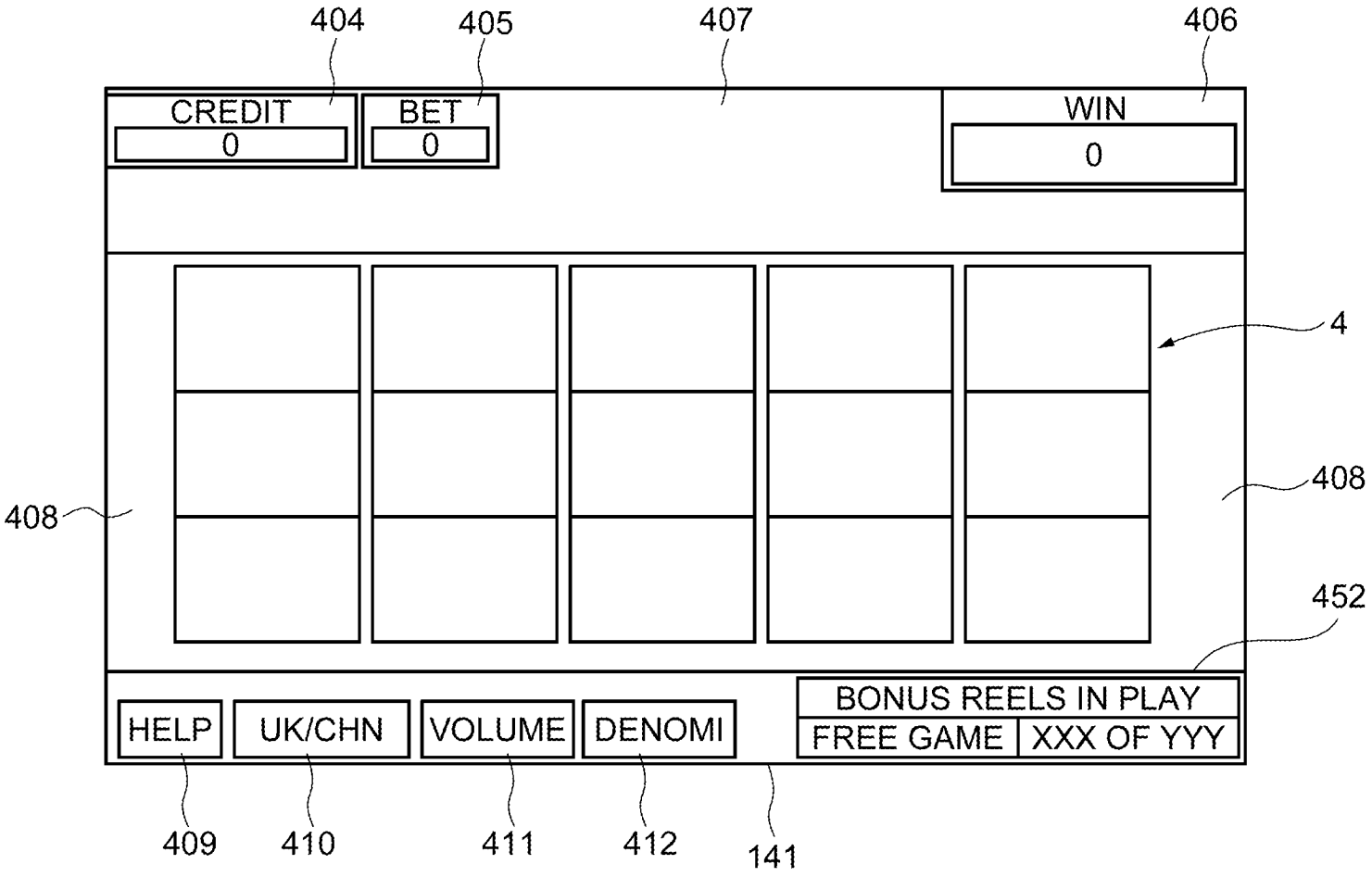
FIG. 51 is a diagram illustrating a screen during the free games in the slot machine according to the embodiment of the present invention.

Here, with reference to FIG. 51, a screen during the free games will be described. FIG. 51 is a diagram illustrating the screen during the free games in the slot machine according to the embodiment of the present invention.

As shown in FIG. 51, as on the lower side image display panel 141 in the base game time shown in FIG. 26, on the lower side image display panel 141 in the free games, in addition to the symbol display area 4, the CREDIT meter 404, the BET meter 405, the WIN meter 406, the display area 407 for displaying the BET information and the game state, the display area 408 for indicating the LINE Nos. the HELP touch button 409, the language switch touch button 410, the sound volume switch touch button 411, and the DENOMI display area 412 are provided.

Further, immediately after the introduction of the free games, in the lower right portion of the symbol display area 4 on the lower side image display panel 141, the free game counter 452 is displayed. On the free game counter 452, words "BONUS REELS IN PLAY" are displayed. In the free games, since the video reel strips which are different from those used in the base game are used, the words "BONUS REELS IN PLAY" are displayed. The words "BONUS REELS IN PLAY" may be hidden by the free game counter 452 or the symbol animation.

On the free game counter 452, a word "FREE" is also displayed. The word "FREE" indicates that each of the free games is being played and, upon starting the spinning in the symbol display area 4 on the lower side image display panel 141, is concurrently expanded to be displayed.

On the free game counter 452, words "xxx OF yyy" are also displayed. On the free game counter 452, a total number of free games and a number of free games which have been currently played are displayed. Upon starting the spinning in the symbol display area 4 on the lower side image display panel 141, the portion of "xxx" is concurrently expanded to be displayed. Further, the portion of "xxx" notifies a player that each of the free games is played on a one-by-one basis. Prior to starting the free games, in the portion of "xxx", "0" is displayed. Concurrently with the starting of the rotation of the reels in the symbol display area 4 on the lower side image display panel 141, in the portion of "xxx", "+1" is counted and, concurrently with outputting of a voice, the number is expanded to be displayed. In a portion of "yyy", the total number of free games is displayed. A maximum number of digits displayed in each of "x" and "y" is one.

On the lower side image display panel 141 during the free games, as performed during the base game, the WIN presentation effects upon the occurrence of any WIN, the increment process, and the LINE presentation effects are performed. With respect to the LINE and BET during the free games, the LINE number and the BET number upon the occurrence of the free games are carried over. A value of the WINs during the free games is added to a value in the WIN meter in an upper right portion of the lower side image display panel 141.

<Appeal Rewriting Upon Starting Spinning During Free Games>

Here, with reference to FIG. 52 to FIG. 54, appeal rewriting upon starting the spinning during the free games will be described. Each of FIG. 52 to FIG. 54 is a diagram explaining the appeal rewriting upon starting the spinning during the free games in the slot machine according to the embodiment of the present invention.

Figure 52:
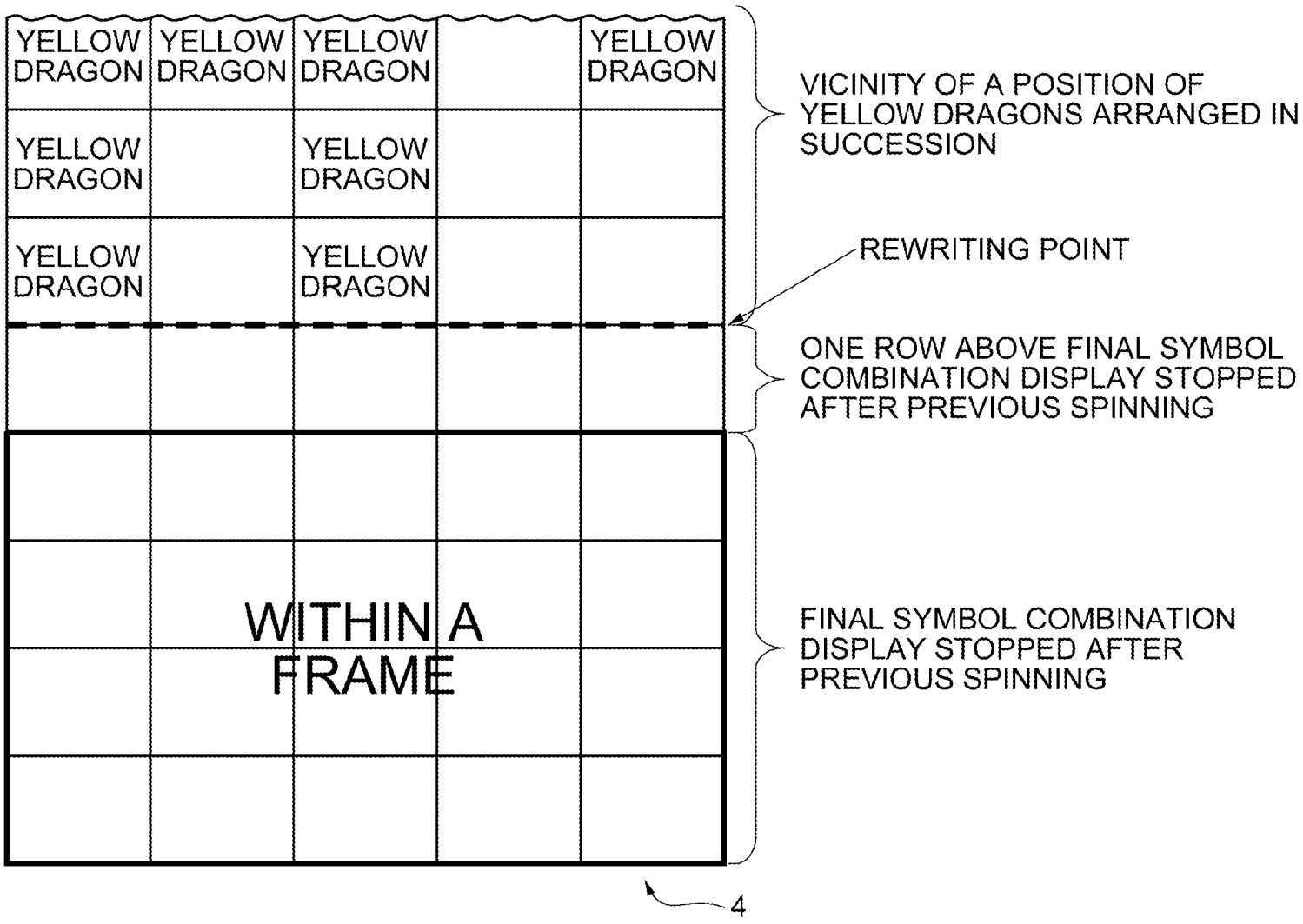
FIG. 52 is a diagram explaining appeal rewriting upon starting spinning during the free games in the slot machine according to the embodiment of the present invention.

In the embodiment of the present invention, as shown in FIG. 52, during the free games, the symbols "GOLD" are replaced with symbols "Yellow Dragon", and in order to make an appeal indicating that displayed are advantageous reel strips in which the number of the symbols "Yellow Dragon" as the top symbols is increased, a mechanism in which clusters of the symbols "Yellow Dragon" are displayed upon starting the rotation of the reels in the symbol display area 4 is incorporated. With respect to each of the Reel 1 to Reel 5, a drawing for appeal rewriting is individually conducted, and any reel which has won in the drawing is started in the vicinity of the clusters of the symbols "Yellow Dragon" in the frames in the symbol display area 4 upon starting the rotation. Here, the reason why the word "vicinity" of the clusters is used is that in order to avoid arranging the clusters in a straight line each time, a position at which the rewriting is conducted is randomly selected from three positions in the vicinity of the beginnings of the symbols "Yellow Dragon" arranged in succession. However, since the drawing for the rewriting is individually conducted with respect to each of the 1 to 5 reels, in reality, there is also some reel which is not started in the vicinity of the symbols "Yellow Dragon". FIG. 53 shows start positions after rewriting upon the winning in the drawing for the appeal rewriting. FIG. 54 shows presence or absence of the appeal rewriting and drawings for the rewriting positions.

[Button Look-Ahead Specification]

Figure 55:
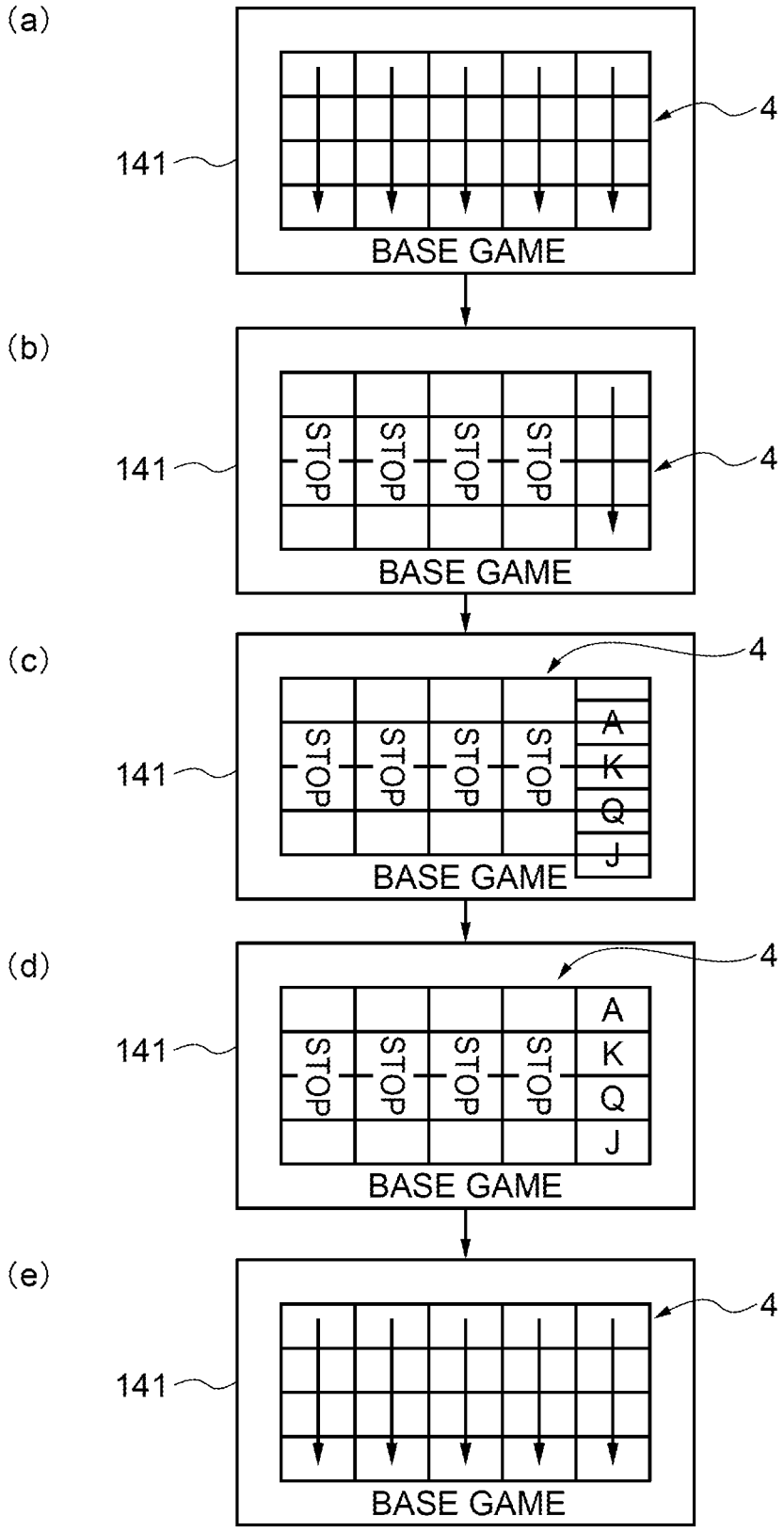
FIG. 55 is a diagram explaining a button look-ahead specification in the slot machine according to the embodiment of the present invention.

The free game presentation effects in the slot machine 1 are as described above. Next, with reference to FIG. 55, a button look-ahead specification in the slot machine 1 will be described. FIG. 55 is a diagram explaining the button look-ahead specification in the slot machine according to the embodiment of the present invention. The button look-ahead specification is a specification related to a function with which during the base game, inputting of the SPIN or the MAX BET buttons for the next game is accepted immediately before the finishing of the rotation of the reels, thereby enabling the next game to be smoothly started.

In the button look-ahead function, the symbol display area 4 on the lower side image display panel 141 is changed in manners shown in part (a) to part (e) of FIG. 55. First, as shown in part (a) of FIG. 55, all of the reels are rotated in the symbol display area 4 on the lower side image display panel 141. Then, as shown in part (b) of FIG. 55, while all of the reels are being rotated, the four reels of all of the reels are stopped in the symbol display area 4 on the lower side image display panel 141. Next, as shown in part (c) of FIG. 55, it is assumed that, in a period of time from when the fifth reel was completely sunk down up to when the spinning was finished in the symbol display area 4 on the lower side image display panel 141, the SPIN button or the MAX BET button is pressed by a player. Then, at the time point at which as shown in part (d) of FIG. 55, the fifth reel was stopped in the symbol display area 4 on the lower side image display panel 141, as shown in part (e) of FIG. 55, the spinning of all of the reels is started at the fastest speed for the next game in the symbol display area 4 on the lower side image display panel 141. In the base game, only in the game in which no WIN occurs, the button look-ahead function is made active. In addition, by making a setting on the AUDIT MENU, whether the button look-ahead function is active or inactive is changed.

[WIN Meter Information Display]

Figure 56:
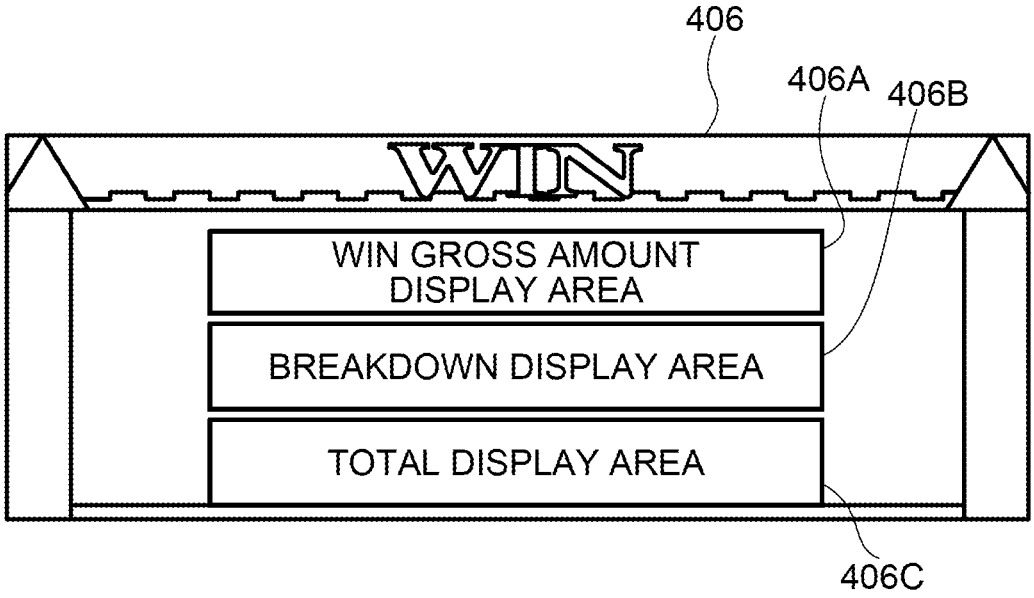
FIG. 56 is a diagram explaining a WIN meter information display in the slot machine according to the embodiment of the present invention.

The button look-ahead specification in the slot machine 1 is as described above. Next, with reference to FIG. 56, a WIN meter information display in the slot machine 1 will be described. FIG. 56 is a diagram explaining the WIN meter information display in the slot machine according to the embodiment of the present invention.

As shown in FIG. 56, on the WIN meter 406, a WIN gross amount display area 406A, a breakdown display area 406B, and a total display area 406C are provided.

In the WIN gross amount display area 406A, a WIN credit and a money amount are displayed. When the increment is displayed, such increment complies with criteria in a win increment speed sheet. In other words, in the WIN gross amount display area 406A, the number of credits won during the current game cycle (or the previous game cycle) is displayed. When a plurality of credits are won during one game cycle, the credits are sequentially added. For example, when the triggering of the free games occurs during the base game and a player obtains LINE WIN 20 and SCATTER WIN 100, an increment display is conducted from "0" to "120". Thereafter, when a player obtains a payout of "200" during the free games, the increment display is conducted from "120" to "320". When the next game cycle is started or losing in the GAMBLE occurs, "0" is displayed. On the other hand, when winning occurs in the GAMBLE, the increment display is not conducted and a doubled amount is instantaneously displayed.

The breakdown display area 406B is related to WIN during the base game and the free games. After the fifth REEL has been stopped, the No. of WIN LINE and a WIN credit are displayed. When a plurality of LINE payouts concurrently occur, displaying is conducted by changing every 0.5 second. The LINE payout is displayed in ascending order of the LINE Nos. and after the LINE payout having the largest WIN LINE No. has been displayed, the LINE payout is displayed again in ascending order of the LINE Nos. In other words, in the breakdown display area 406, a breakdown of the credits won in the spinning conducted this time is displayed. When there are a plurality of elements (different lines or SCATTER), displaying is conducted by changing the display time unit to a unit of 0.5 second. The order of changing the display time unit is from the SCATTER payout to the LINE payout (in ascending order of the LINE Nos.).

In the total display area 406C, upon the completion of the increment in the WIN gross amount display area 406A, a total in the breakdown display area 406B is displayed. However, until after the completion of the increment in the WIN gross amount display area 406A, no value is displayed in the total display area 406C. In other words, in the total display area 406C, the total of the credits won in the spinning conducted this time is displayed. After having finishing the increment in the WIN gross amount display area 406A, a total value is displayed therein.

[One Example of Control Panel]

Figure 57:
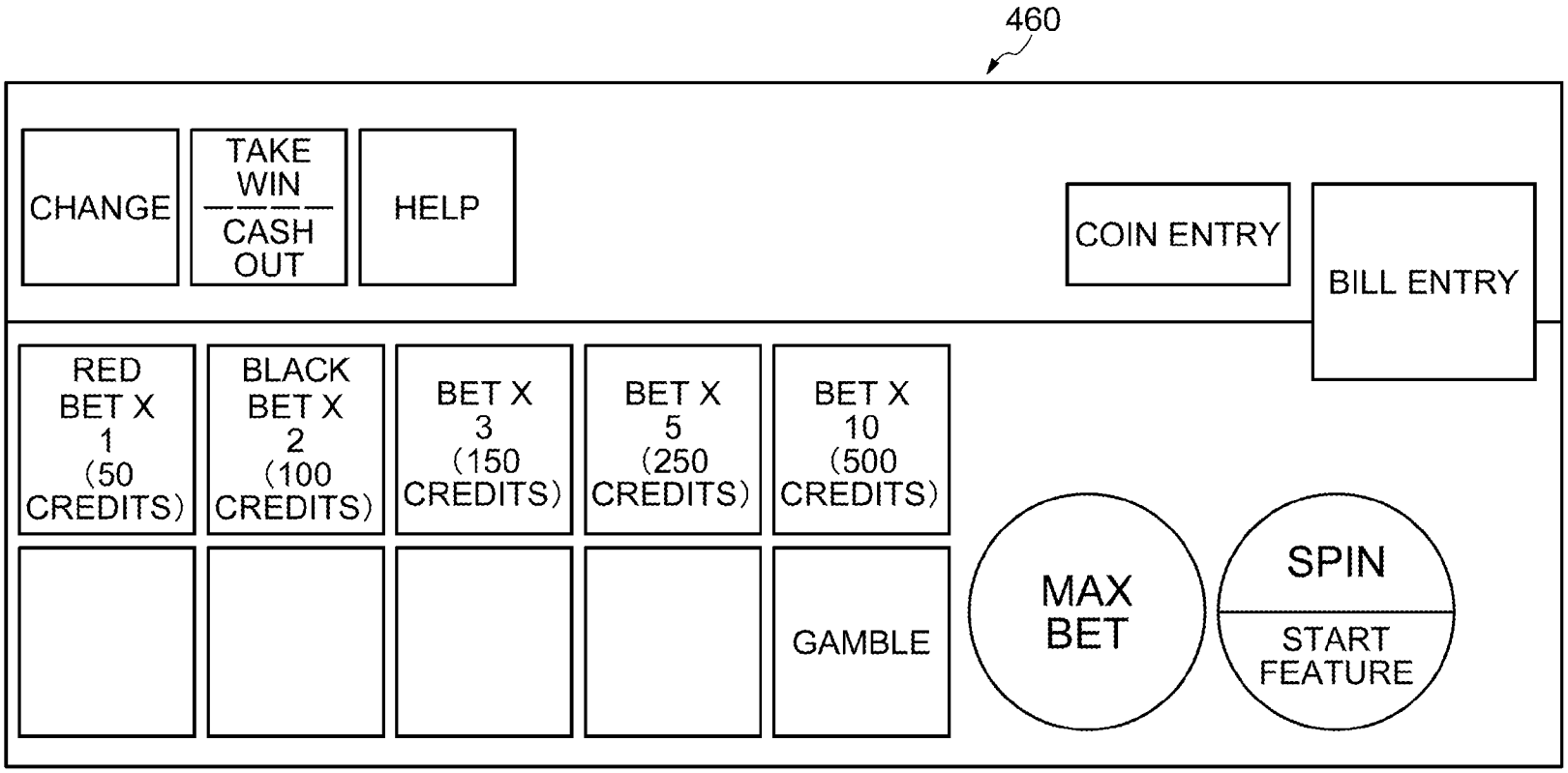
FIG. 57 is a diagram illustrating one example of a control panel specification in the slot machine according to the embodiment of the present invention.

The WIN meter information display in the slot machine 1 is as described above. Next, with reference to FIG. 57, one example of a control panel specification in the slot machine 1 will be described. FIG. 57 is a diagram illustrating the one example of the control panel specification in the slot machine according to the embodiment of the present invention. In the slot machine according to the embodiment of the present invention 1, instead of the control panel shown in FIG. 4, a control panel 460 shown in FIG. 57 may be provided.

[GAMBLE Specification]

Figure 58:
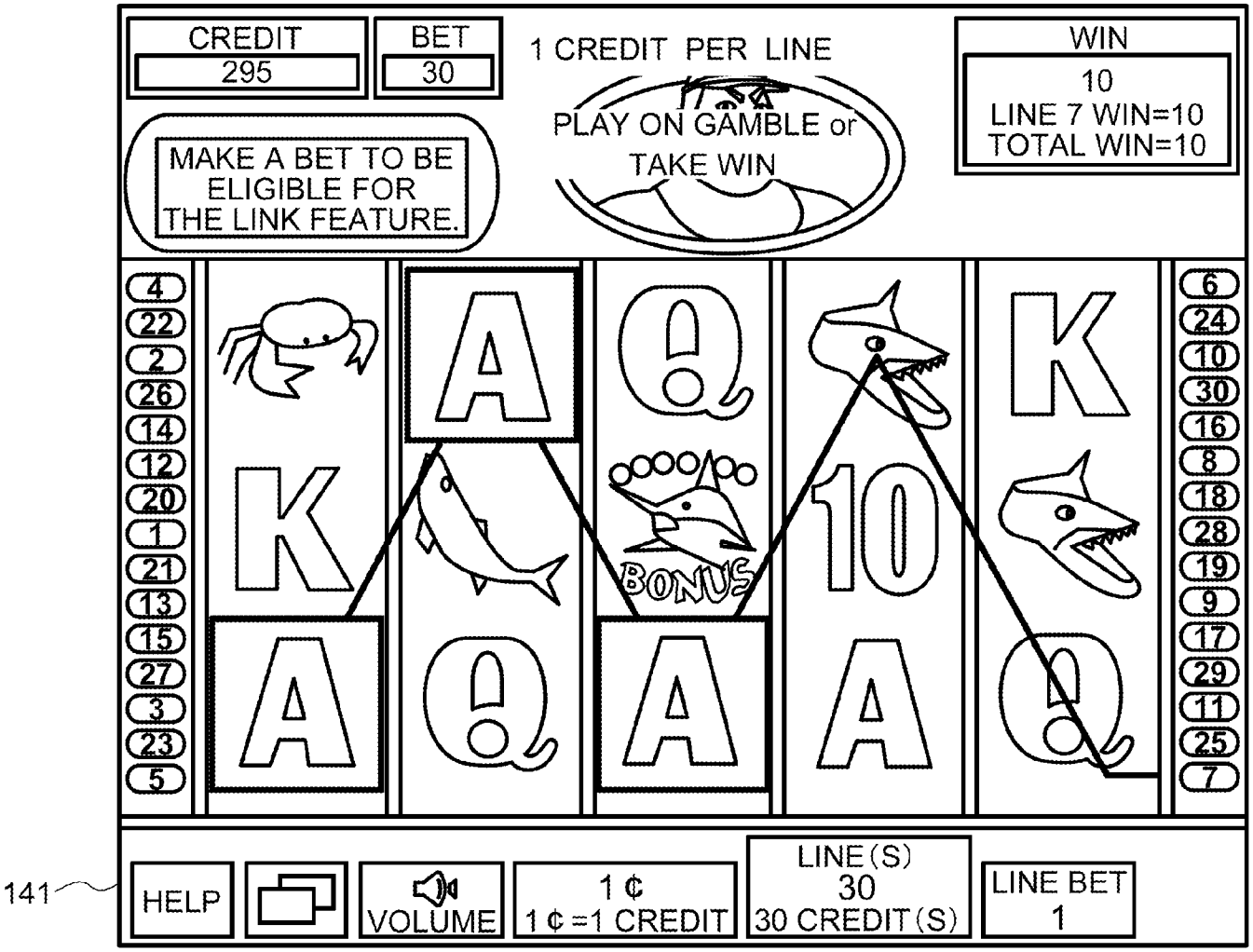
FIG. 58 is a diagram explaining a GAMBLE specification in the slot machine according to the embodiment of the present invention.

The one example of the control panel specification in the slot machine 1 is as described above. Next, with reference to FIGS. 58 to 64, a GAMBLE specification in the slot machine 1 will be described. FIG. 58 is a diagram explaining the GAMBLE specification in the slot machine according to the embodiment of the present invention.

Figure 59:
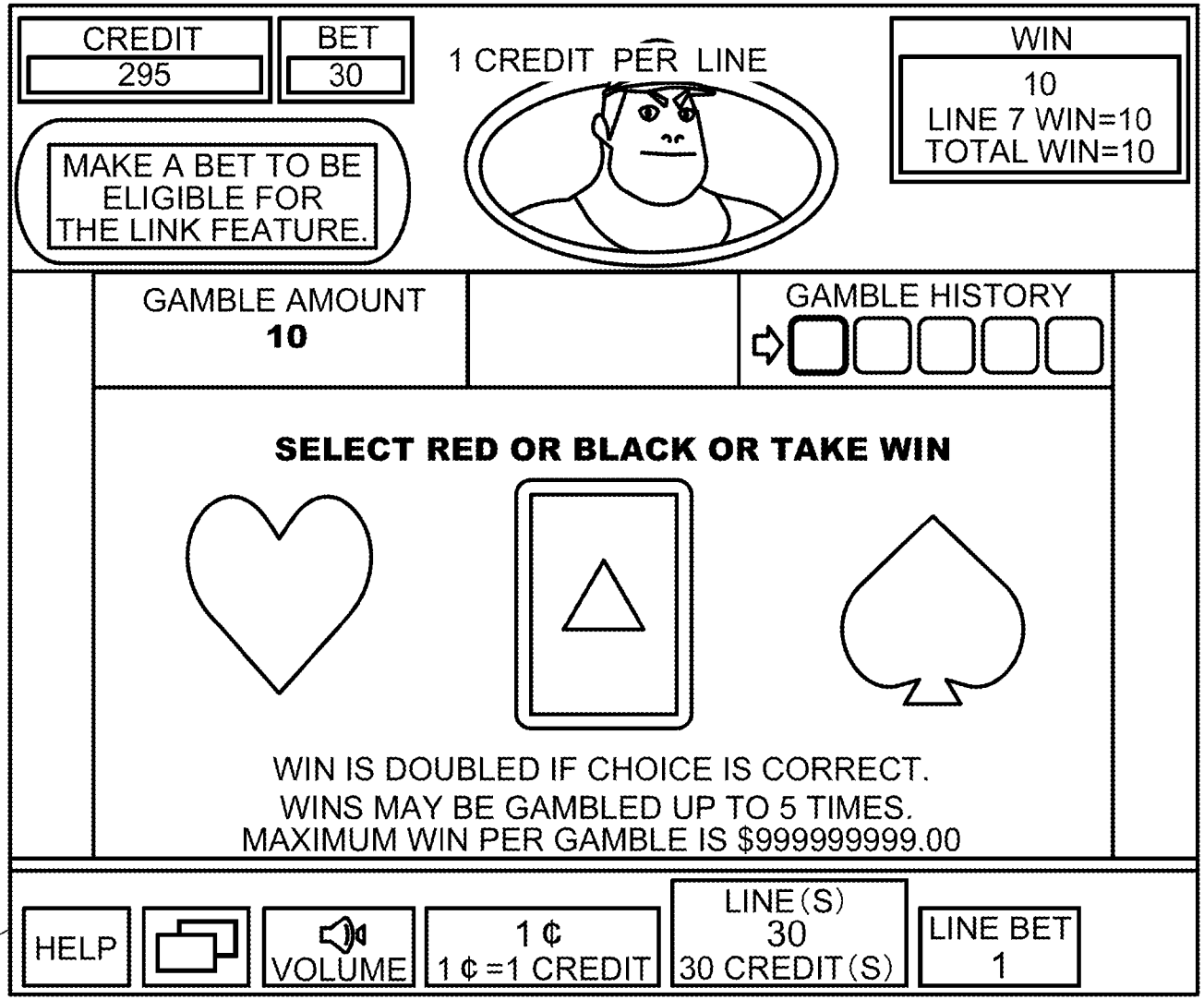
FIG. 59 is a diagram explaining a GAMBLE specification in the slot machine according to the embodiment of the present invention.

First, when WIN occurs, the lower side image display panel 141 shown in FIG. 58 is changed to the lower side image display panel 141 shown in FIG. 59. In other words, a GAMBLE screen is displayed, and a message "PLAY ON, GAMBLE or TAKE WIN" is erased. On the other hand, a message "SELECT RED OR BLACK OR TAKE WIN is displayed on the lower side image display panel 141.

Figure 60:
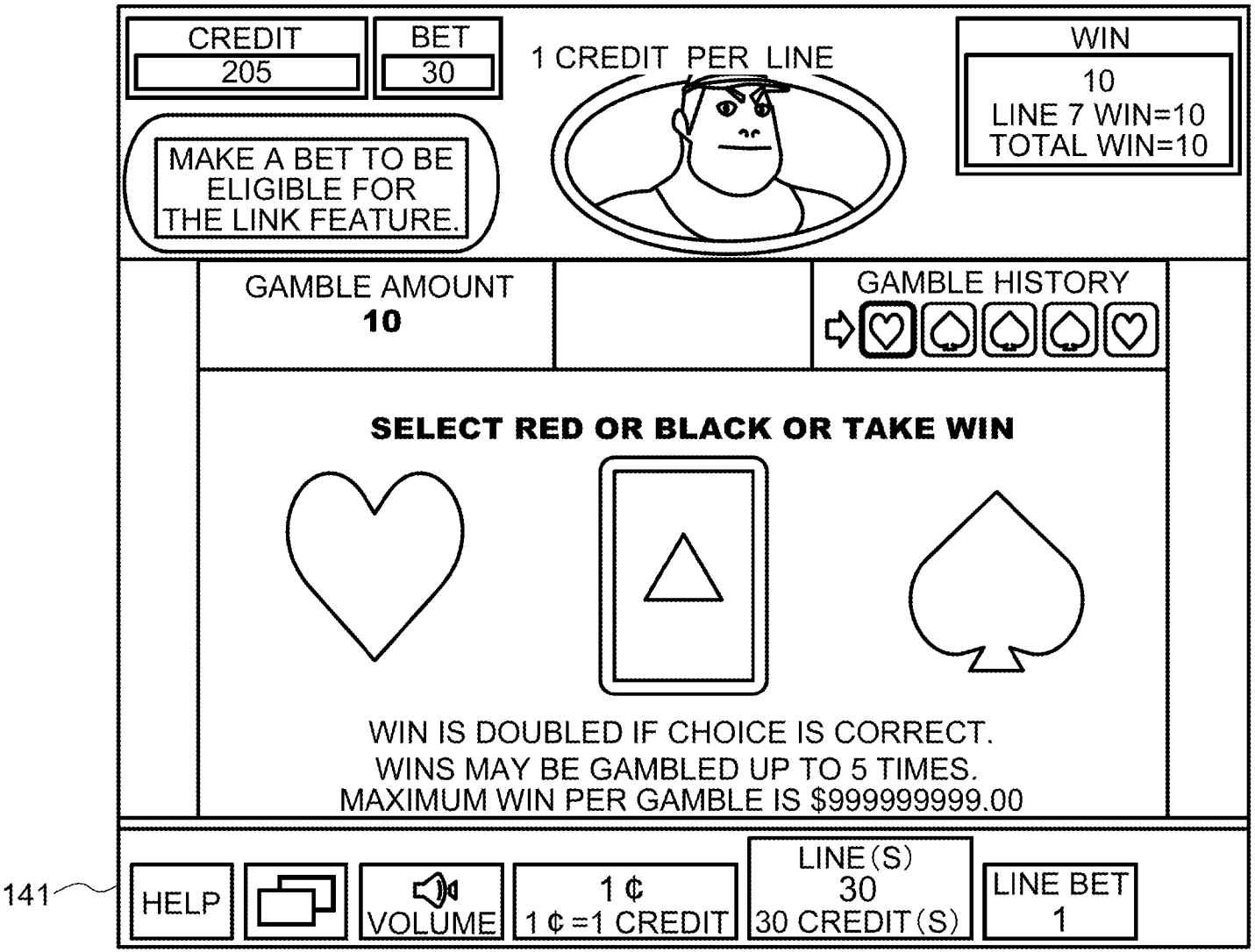
FIG. 60 is a diagram explaining the GAMBLE specification in the slot machine according to the embodiment of the present invention.

Next, on the lower side image display panel 141 shown in FIG. 60, a bet amount as a "GAMBLE AMOUNT" is displayed on the lower side image display panel 141. Here, a player selects "RED" or "BLACK". When this selection is successful, the lower side image display panel 141 is changed to the lower side image display panel 141 shown in FIG. 63 described later. In contrast to this, when this selection is unsuccessful, the lower side image display panel 141 is changed to the lower side image display panel 141 shown in FIG. 61. When a player selects "TAKE WIN", on the lower side image display panel 141, a WIN value is immediately added to the credit, and an idling state returns.

Figure 61:
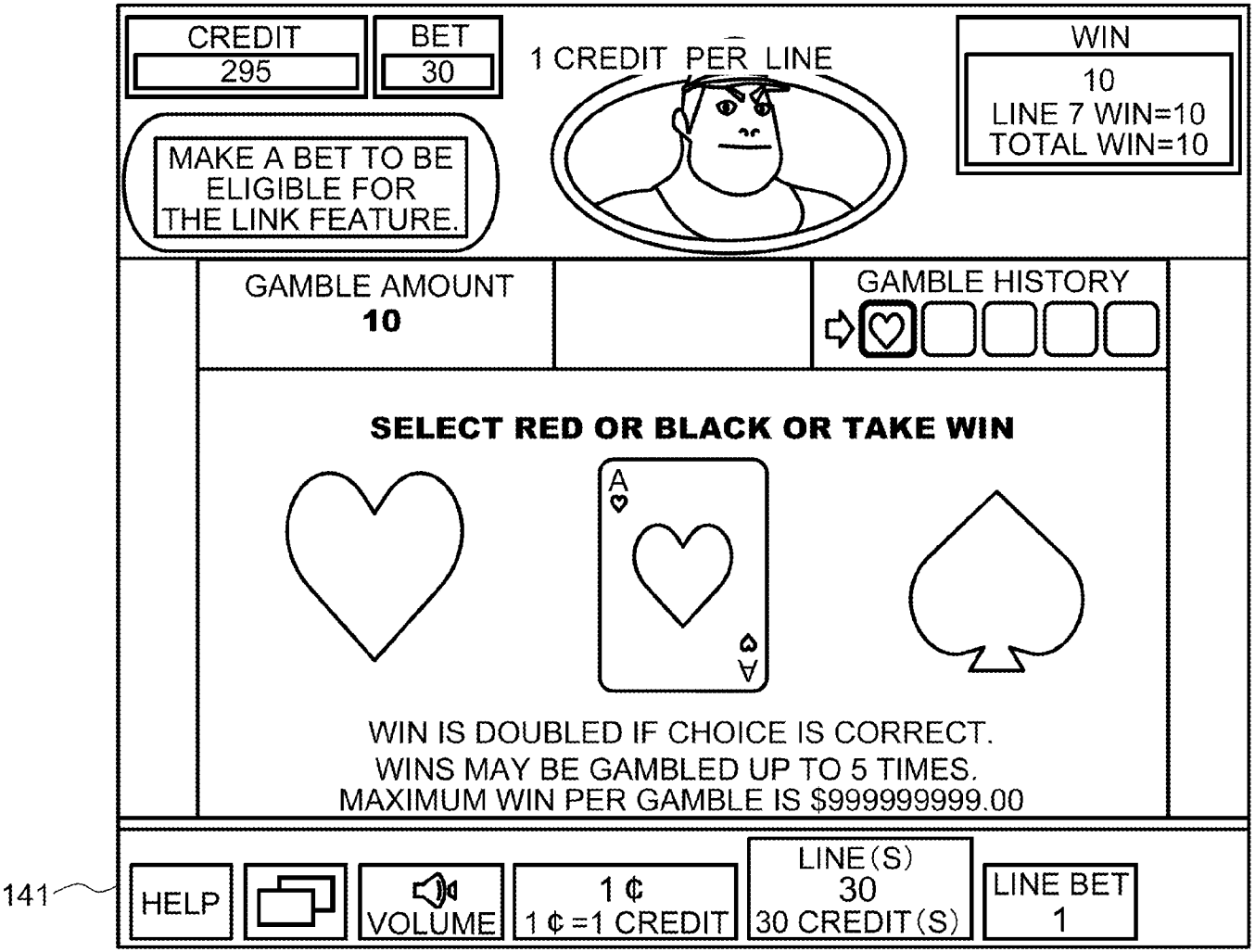
FIG. 61 is a diagram explaining the GAMBLE specification in the slot machine according to the embodiment of the present invention.
Figure 62:
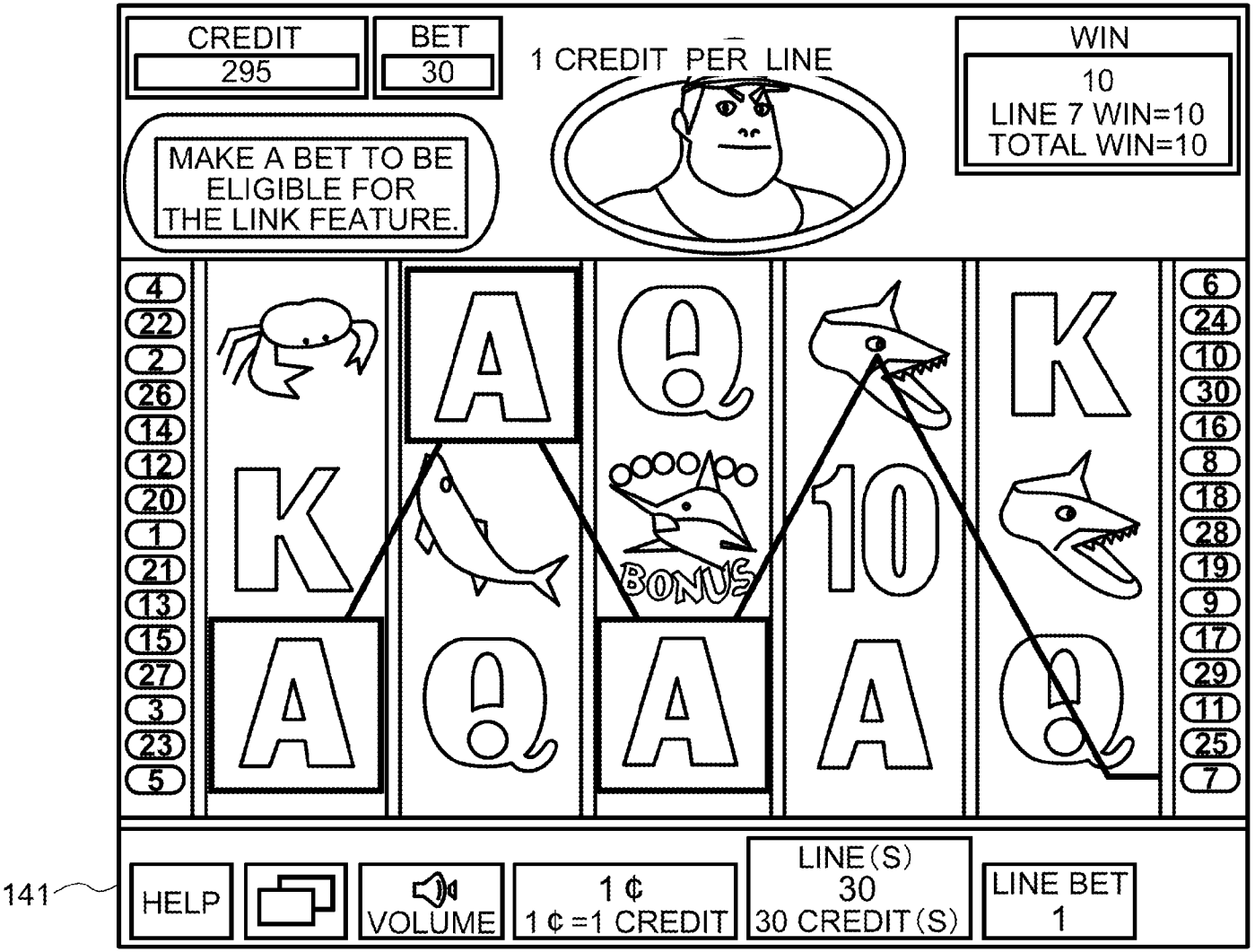
FIG. 62 is a diagram explaining the GAMBLE specification in the slot machine according to the embodiment of the present invention.

When the player's selection is unsuccessful, on the lower side image display panel 141 shown in FIG. 61, a selection choice ("RED" or "BLACK") which has not been selected becomes dark. In addition, on the lower side image display panel 141 shown in FIG. 61, on a leftmost portion of a "GAMBLE HISTORY" section, a history of the selected card is immediately displayed. When there is a history of the previously selected card, the history of the previously selected card is shifted to the right by one space to be displayed. For a trajectory of this shifting, the display is conducted with no animation, and rewriting is immediately conducted. Further, a result of the central card is immediately displayed. At this time point, however, the WIN meter and the GAMBLE AMOUNT meter do not change. Thereafter, chagrin sound is outputted, and 1.2 second after the outputting of the chagrin sound, as shown in FIG. 62, the lower side image display panel 141 is switched to a MAIN GAME screen. Upon switching to the MAIN GAME screen, concurrently, "0 is displayed in the WIN meter.

Figure 63:
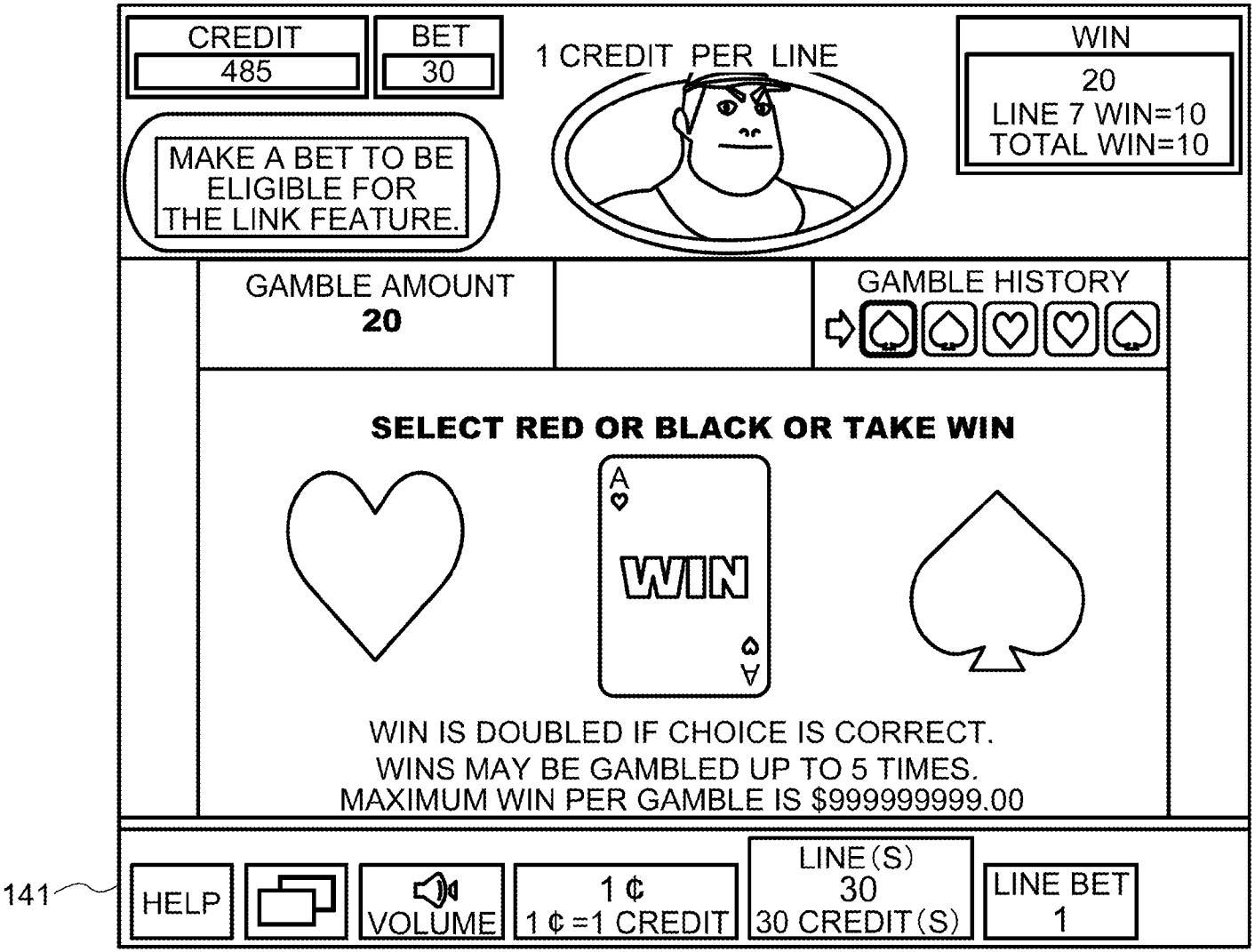
FIG. 63 is a diagram explaining the GAMBLE specification in the slot machine according to the embodiment of the present invention.
Figure 64:
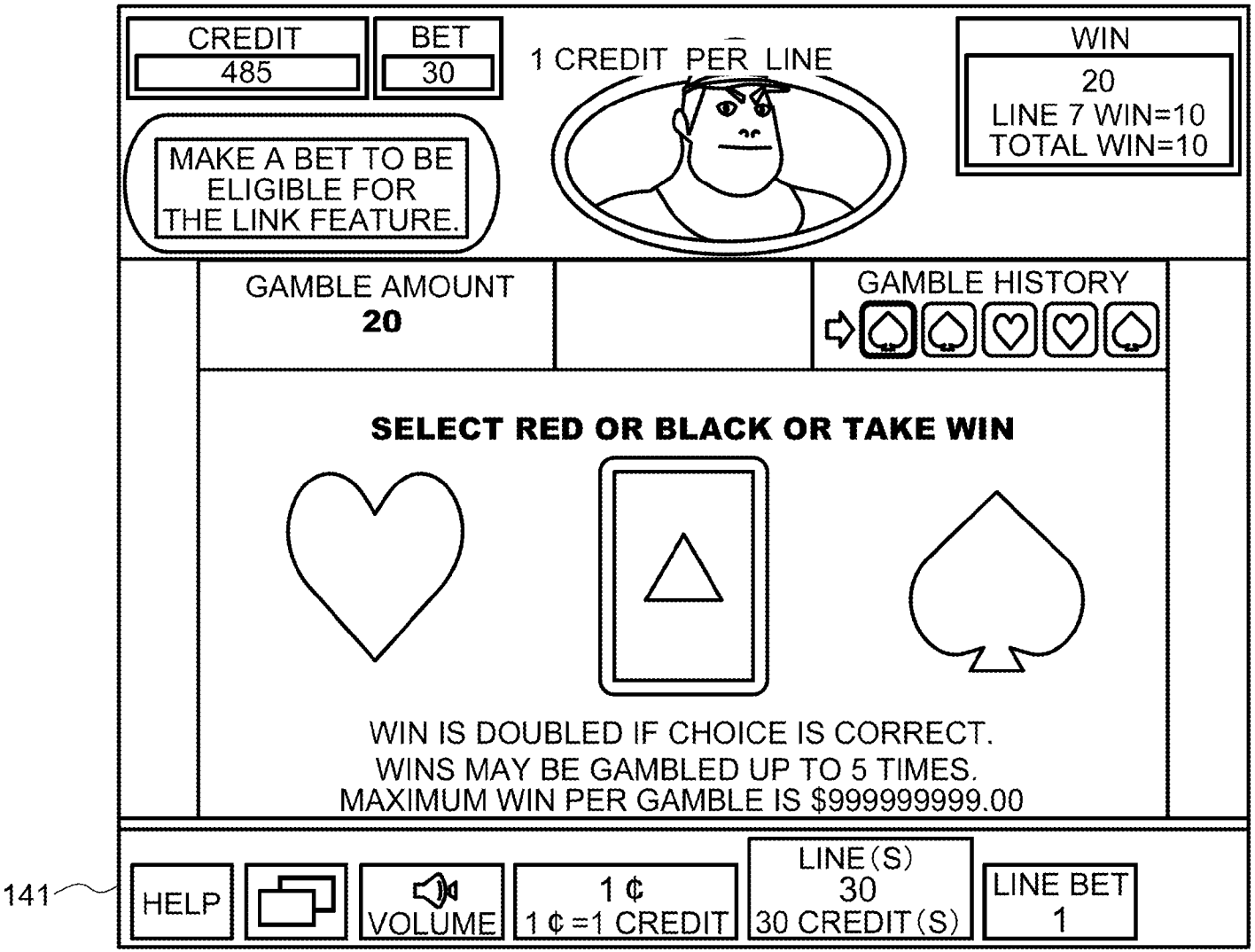
FIG. 64 is a diagram explaining the GAMBLE specification in the slot machine according to the embodiment of the present invention.

When the player's selection is successful, on the lower side image display panel 141 shown in FIG. 63, a selection choice ("RED" or "BLACK") which has not been selected becomes dark. In addition, on the lower side image display panel 141 shown in FIG. 63, on a leftmost portion of a "GAMBLE HISTORY" section, a history of the selected card is immediately displayed. When there is a history of the previously selected card, the history of the previously selected card is shifted to the right by one space to be displayed. For a trajectory of this shifting, the display is conducted with no animation, and rewriting is immediately conducted. Further, as a central card, a normal card and a card having a word WIN are alternately displayed on a one frame-by-one frame basis, and success sound is outputted for 1.2 second. On the WIN meter, a value increased by the GAMBLE result is immediately added. At this point, however, the GAMBLE AMOUNT meter does not change.

Here, when the GAMBLE has been played at the upper limit number of times, a WIN value is immediately added to the credit, and the idling state returns. In contrast to this, when the GAMBLE has not been played at the upper limit number of times, the lower side image display panel 141 is changed to the lower side image display panel 141 shown in FIG. 64. On the lower side image display panel 141 shown in FIG. 64, the central card is displayed face down. Thereafter, the lower side image display panel 141 is changed to the lower side image display panel 141 shown in FIG. 60.

On the MAIN GAME screen on the lower side image display panel 141 shown in FIG. 58 and FIG. 62, to facilitate understanding, symbols which are different from the above-described symbols are also displayed.

[Residual Gamble]

Figure 65:
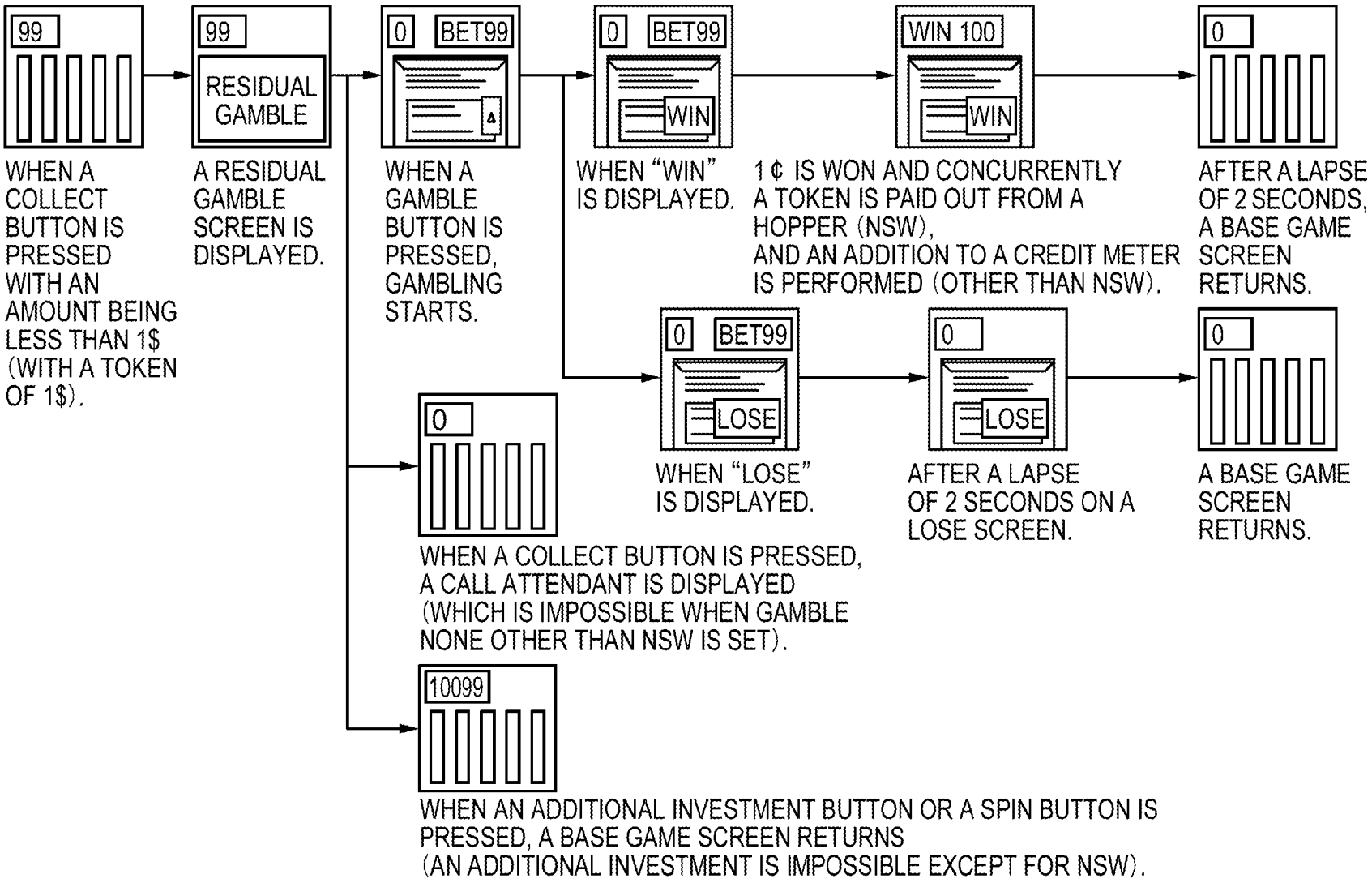
FIG. 65 is a diagram explaining RESIDUAL GAMBLE in the slot machine according to the embodiment of the present invention.
Figure 67:
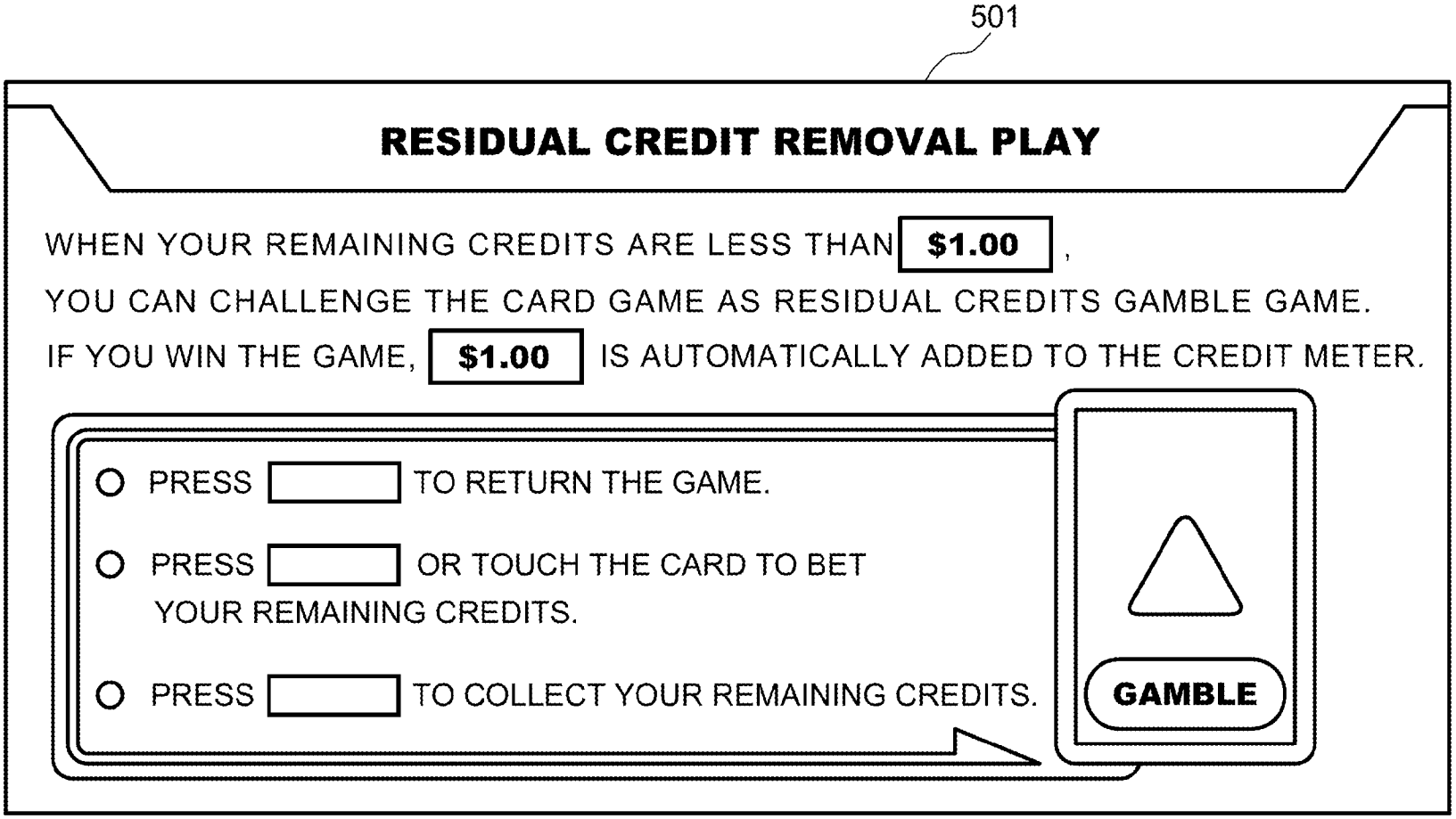
FIG. 67 is a diagram explaining the RESIDUAL GAMBLE in the slot machine according to the embodiment of the present invention.

The GAMBLE specification in the slot machine 1 is as described above. Next, with reference to FIG. 65 to FIG. 67, RESIDUAL GAMBLE in the slot machine 1 will be described. Each of FIG. 65 to FIG. 67 is a diagram explaining the RESIDUAL GAMBLE in the slot machine according to the embodiment of the present invention. The RESIDUAL GAMBLE is conducted along a flow shown in FIG. 65 by using a table shown in FIG. 66. At this time, in one scene of the RESIDUAL GAMBLE, on the lower side image display panel 141, an image 501 shown in FIG. 67 is displayed.

[System Font Display Area]

Figure 68:
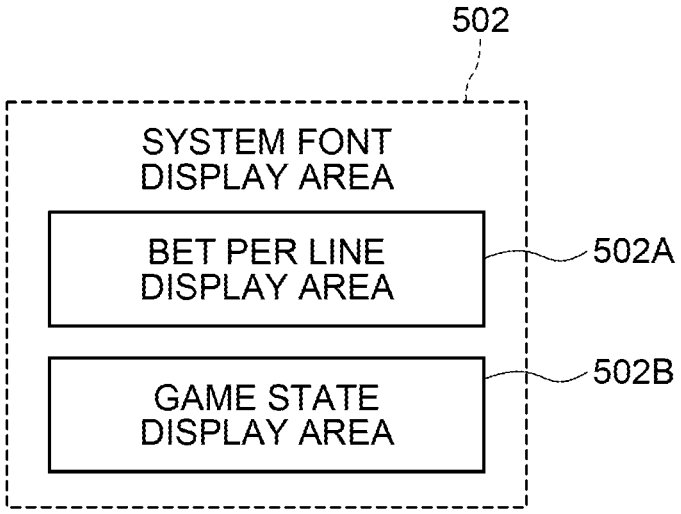
FIG. 68 is a diagram illustrating a system font display area in the slot machine according to the embodiment of the present invention.

The RESIDUAL GAMBLE in the slot machine 1 is as described above. Next, with reference to FIG. 68, a system font display area in the slot machine 1 will be described. FIG. 68 is a diagram illustrating the system font display area in the slot machine according to the embodiment of the present invention. In the system font display area 502 shown in FIG. 68, a display area 502A of BET PER LINE and a display area 502B of a GAME state are provided. The system font display area 502 is allocated in the display area 407 for displaying the BET information and the game state on the lower side image display panel 141 (refer to FIG. 26).

[HELP Specification]

Figure 69:
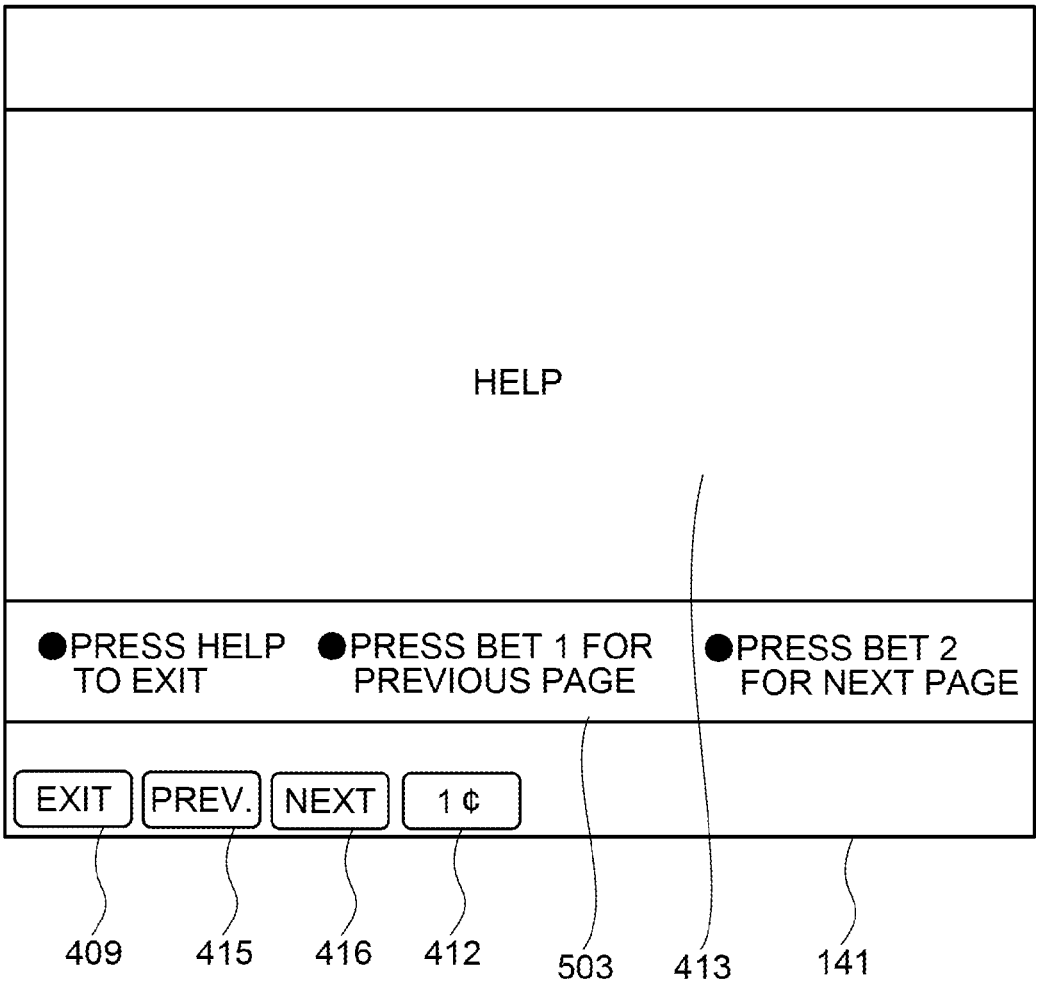
FIG. 69 is a diagram explaining a HELP specification in the slot machine according to the embodiment of the present invention.

The system font display area in the slot machine 1 is as described above. Next, with reference to FIG. 69 and FIG. 70, a HELP specification in the slot machine 1 will be described. Each of FIG. 69 and FIG. 70 is a diagram explaining the HELP specification in the slot machine according to the embodiment of the present invention. As shown in FIG. 69, on the lower side image display panel 141 in the HELP specification, the HELP screen 413 and a message area 503 are secured, and the EXIT touch button 414, the PREV. touch button 415, the NEXT touch button 416, and the DENOMI display area 412 are displayed.

In the message area 503, the display is conducted in the system font. In addition, the message area 503 is linked with the control panel 30 or the control panel 460. Accordingly, even when bet patterns are changed and values are changed, switching to appropriate displays in accordance therewith is conducted.

As shown in the table in FIG. 70, when a player touches or presses down the EXIT touch button 414 or the HELP button on the control panel, the lower side image display panel 141 in the HELP specification shifts to the base game screen. When a player touches or presses down the PREV. touch button 415 or a BET×1 button on the control panel, the lower side image display panel 141 in the HELP specification shifts to the previous HELP page. When a player touches or presses down the NEXT touch button 416 or a BET×2 button on the control panel, the lower side image display panel 141 in the HELP specification shifts to the next HELP page.

[Placement of Screen Touch Buttons]

The HELP specification in the slot machine 1 is as described above. Next, with reference to FIG. 71A to FIG. 73, placement of the screen touch buttons in the slot machine 1 will be described. Each of FIG. 71A to FIG. 73 is a diagram explaining the placement of the screen touch buttons in the slot machine according to the embodiment of the present invention.

Figure 71A:
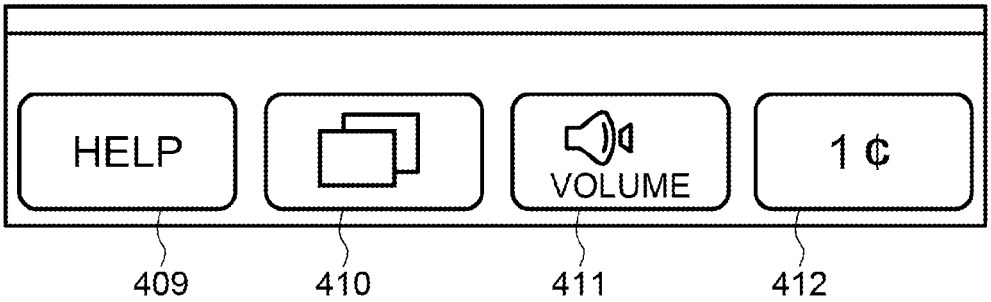
FIG. 71A is a diagram explaining the placement of screen touch buttons in the slot machine according to the embodiment of the present invention.
Figure 71B:
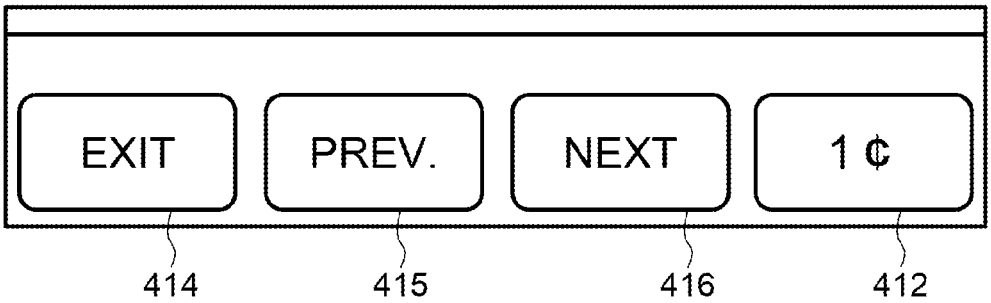
FIG. 71B is a diagram explaining the placement of screen touch buttons in the slot machine according to the embodiment of the present invention.
Figure 71C:
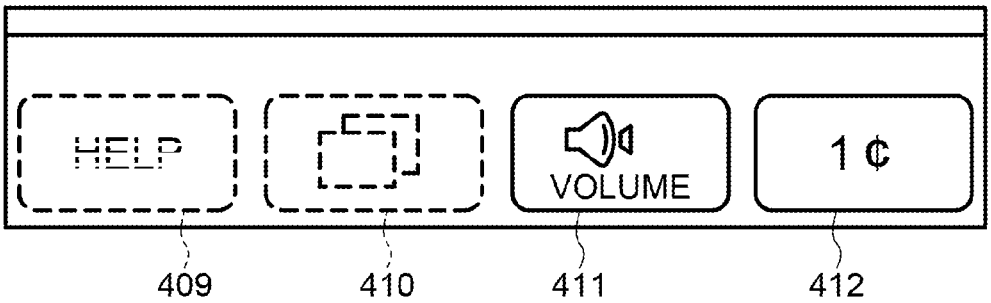
FIG. 71C is a diagram explaining the placement of screen touch buttons in the slot machine according to the embodiment of the present invention.
Figure 71D:
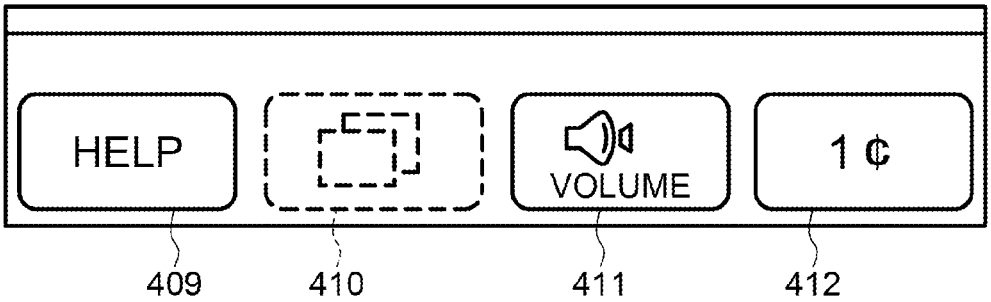
FIG. 71D is a diagram explaining the placement of screen touch buttons in the slot machine according to the embodiment of the present invention.
Figure 72A:
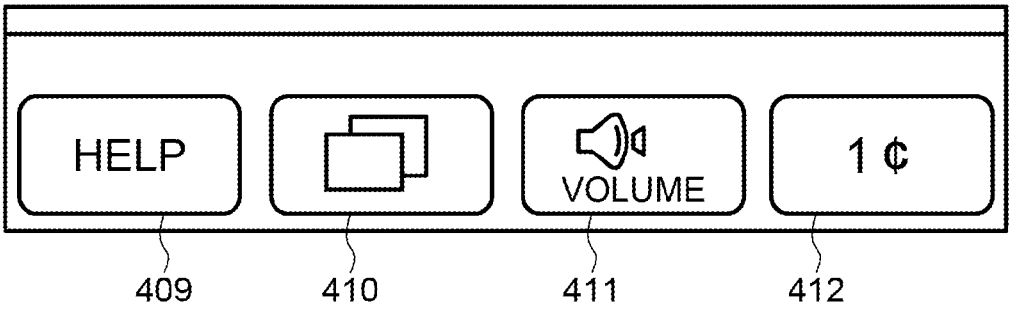
FIG. 72A is a diagram explaining the placement of the screen touch buttons in the slot machine according to the embodiment of the present invention.
Figure 72B:
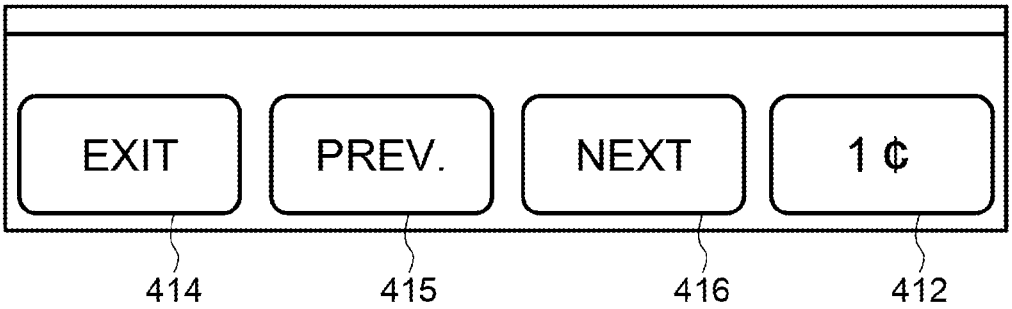
FIG. 72B is a diagram explaining the placement of the screen touch buttons in the slot machine according to the embodiment of the present invention.
Figure 72C:
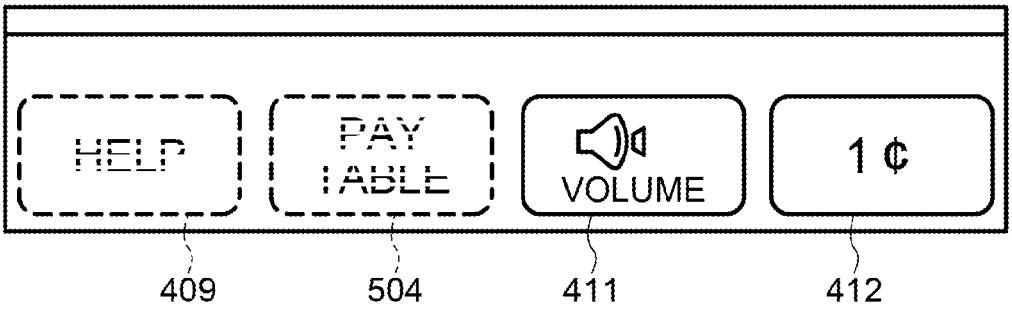
FIG. 72C is a diagram explaining the placement of the screen touch buttons in the slot machine according to the embodiment of the present invention.
Figure 72D:
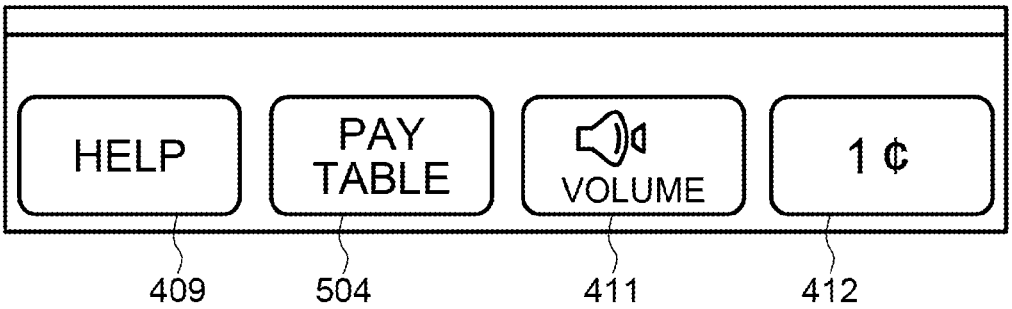
FIG. 72D is a diagram explaining the placement of the screen touch buttons in the slot machine according to the embodiment of the present invention.

FIG. 71A shows the placement of the screen touch buttons during IDLE. FIG. 71B shows the placement of the screen touch buttons during HELP. FIG. 71C shows the placement of the screen touch buttons during a game. FIG. 71D shows the placement of the screen touch buttons in a state of GAMBLE or TAKE WIN. FIG. 72A shows the placement of the screen touch buttons during IDLE (with the language switch being inactive). FIG. 72B shows the placement of the screen touch buttons during HELP (with the language switch being inactive). FIG. 72C shows the placement of the screen touch buttons during a game (with the language switch being inactive). FIG. 72D shows the placement of the screen touch buttons in a state of GAMBLE or TAKE WIN (the state in which the language switch is inactive).

In the placement of the screen touch buttons in the slot machine 1, the HELP touch button 409, the language switch touch button 410, the sound volume switch touch button 411, the DENOMI display area 412, the EXIT touch button 414, the PREV. touch button 415, and the NEXT touch button 416 are placed. In particular, in the state in which the language switch is inactive, during the game or in the state of GAMBLE or TAKE WIN, as shown in FIGS. 72C and 72D, a PAY TABLE touch button 504 is placed. As shown in FIG. 73, these touch buttons are active when being lit up and inactive when lit down.

[Sound Volume Switch Touch Button]

Figure 74:
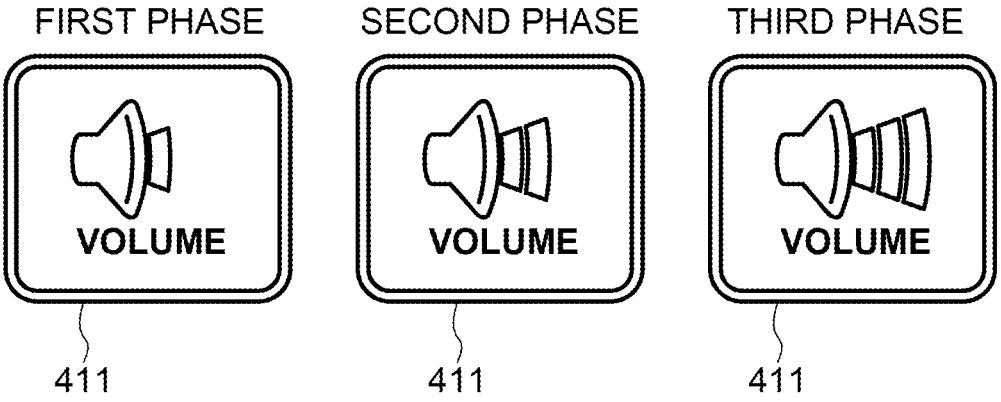
FIG. 74 is a diagram explaining a sound volume switch touch button in the slot machine according to the embodiment of the present invention.
Figure 75:
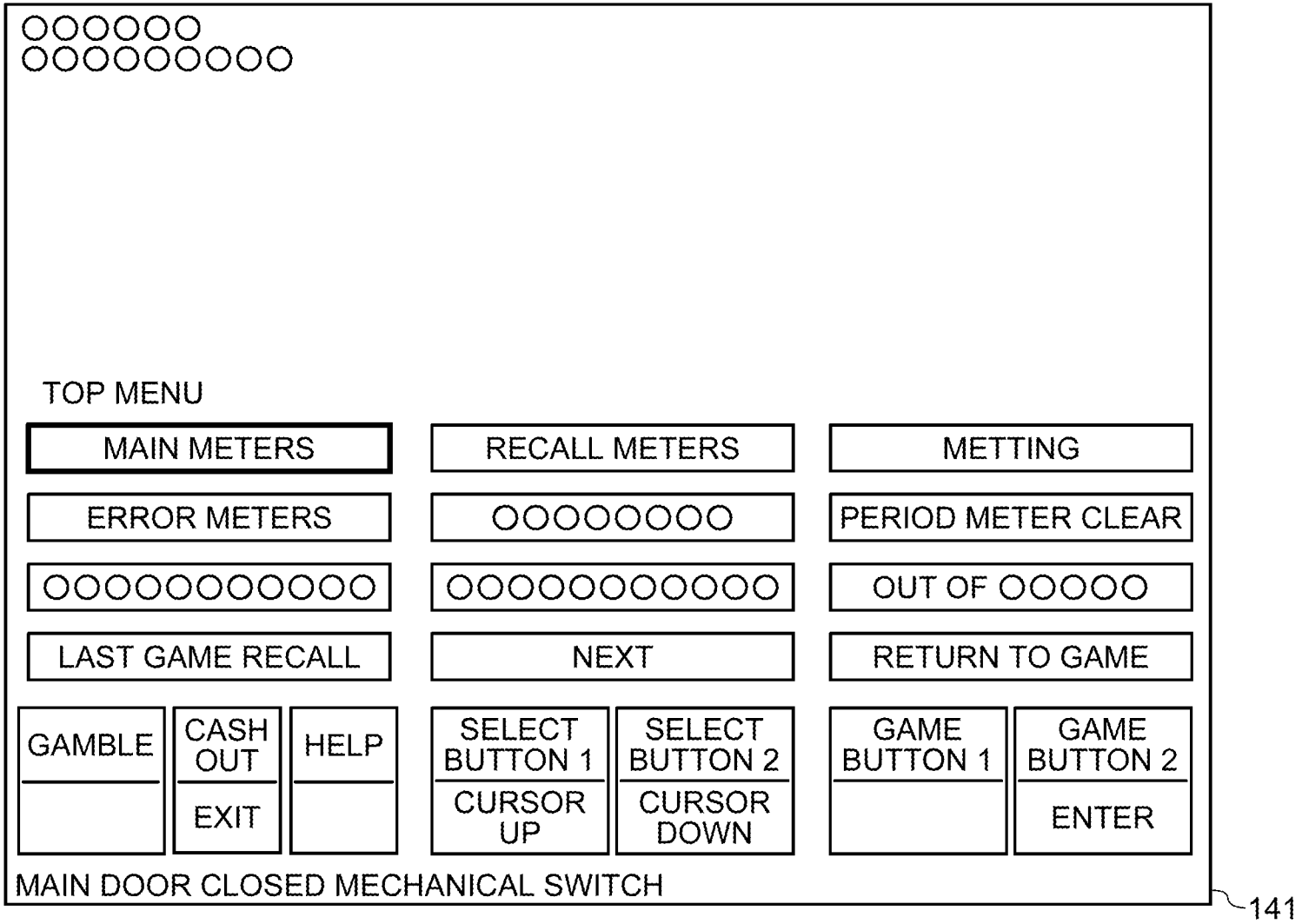
FIG. 75 is a diagram explaining an AUDIT national flag switch setting specification in the slot machine according to the embodiment of the present invention.
Figure 76:
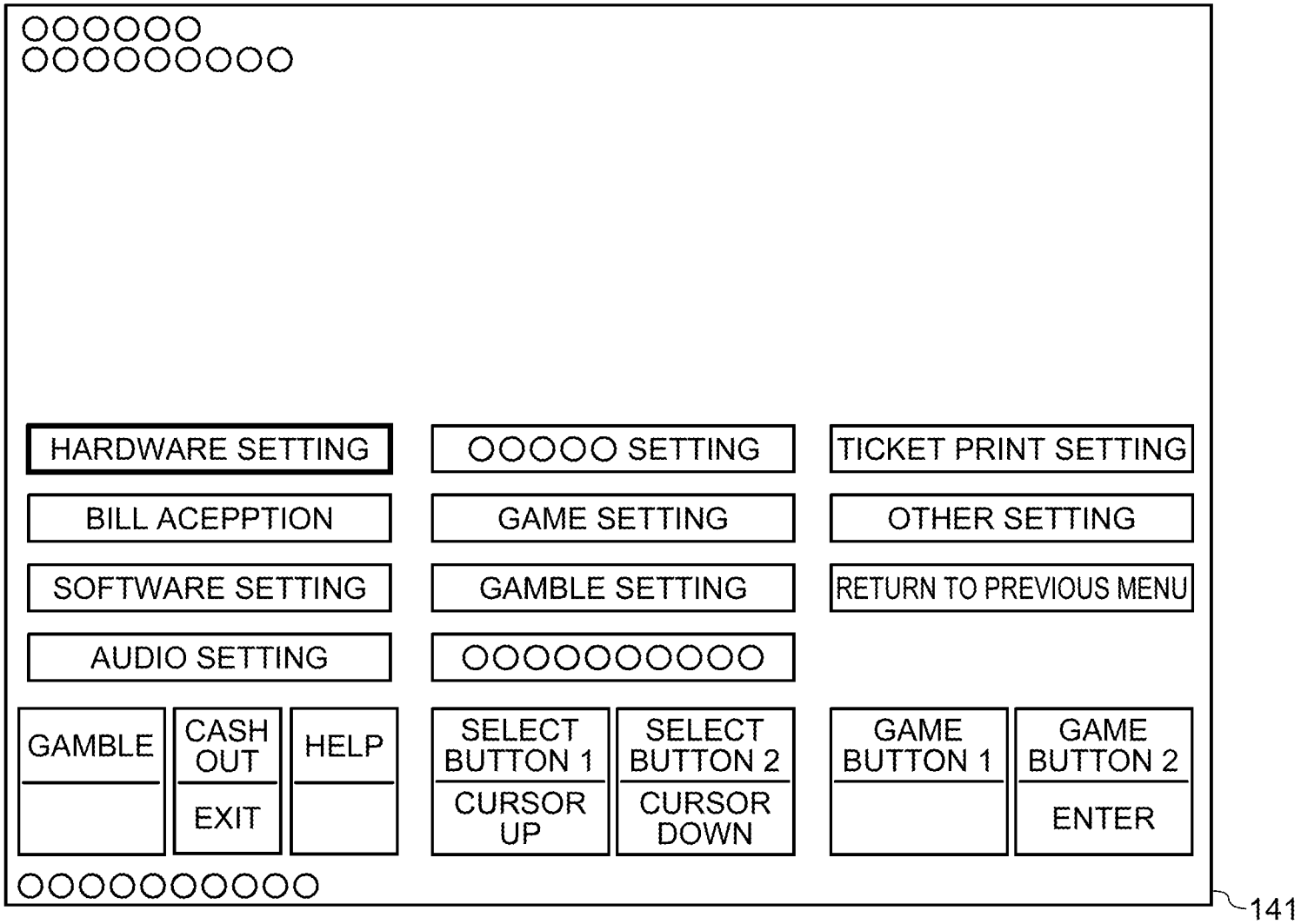
FIG. 76 is a diagram explaining the AUDIT national flag switch setting specification in the slot machine according to the embodiment of the present invention.
Figure 77:
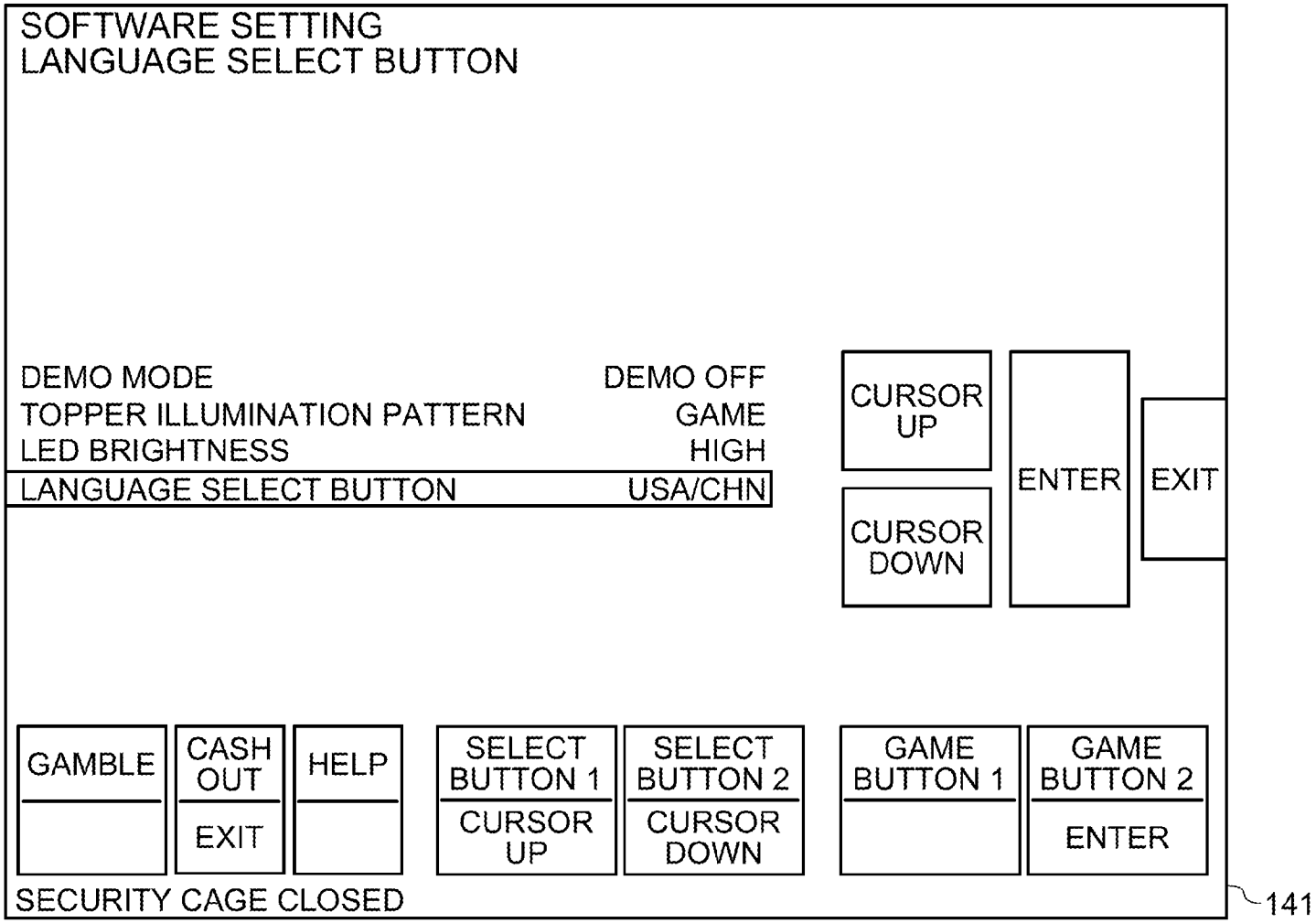
FIG. 77 is a diagram explaining the AUDIT national flag switch setting specification in the slot machine according to the embodiment of the present invention.
Figure 78:
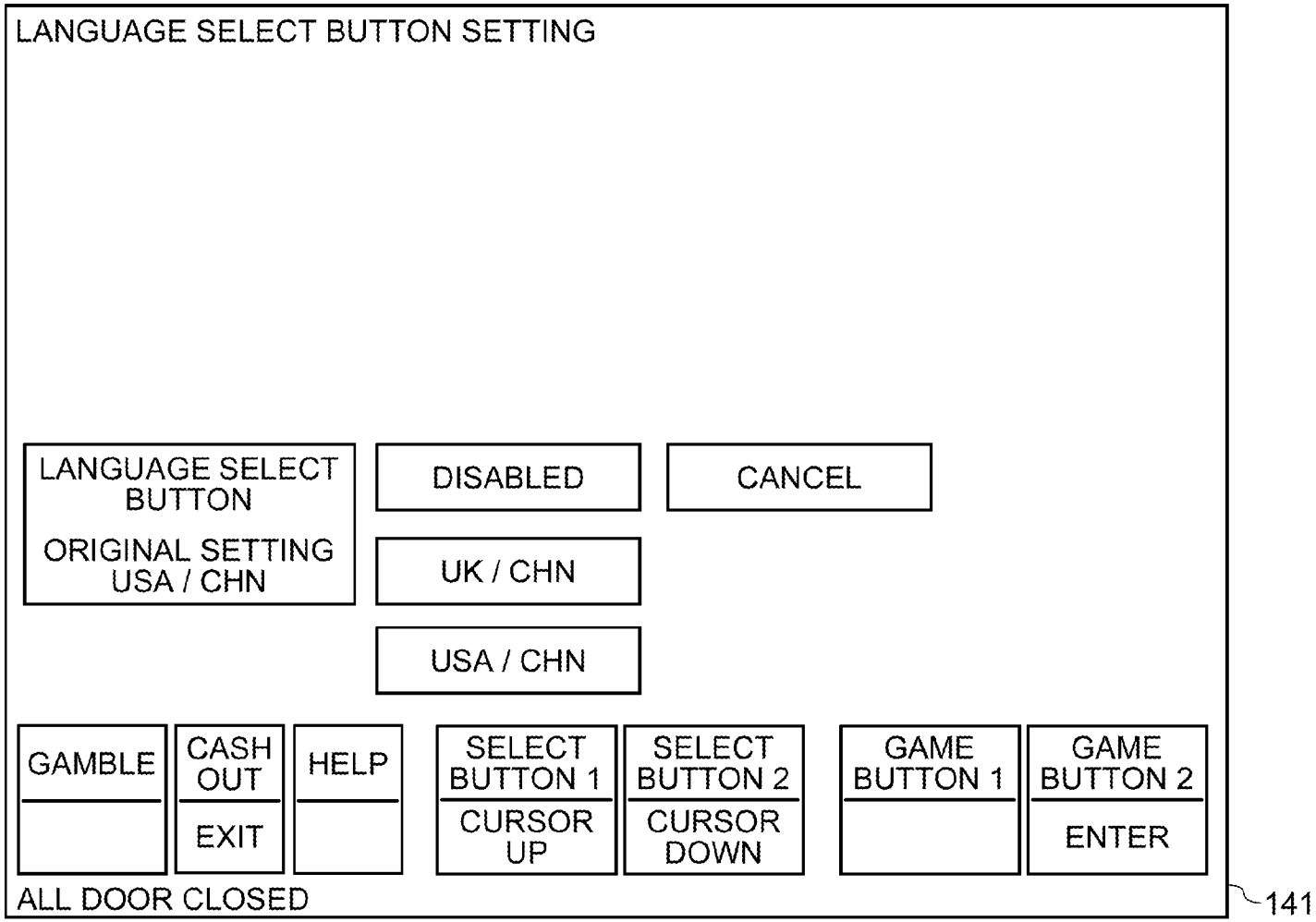
FIG. 78 is a diagram explaining the AUDIT national flag switch setting specification in the slot machine according to the embodiment of the present invention.

The placement of the screen touch buttons in the slot machine 1 is as described above. Next, with reference to FIG. 74, the sound volume switch touch button 411 in the slot machine 1 will be described. FIG. 74 is a diagram explaining the volume switch touch button in the slot machine according to the embodiment of the present invention. As shown in FIG. 74, the sound volume switch touch button 411 has three adjustment phases: in the first phase, a minimum sound volume is applied; in the second phase, a middle sound volume is applied; and in the third phase, a maximum sound volume is applied. A default setting among the phases is the minimum sound volume in the first phase. Each of the phases is shifted in a looped manner such that each time a player touches the sound volume switch touch button 411, the middle sound volume in the second phase is applied; then, the maximum sound volume in the third phase is applied; then, the minimum sound volume in the first phase is applied; then, the middle sound volume in the second phase is applied; then, . . . .

[AUDIT National Flag Switch Setting Specification]

The sound volume switch touch button in the slot machine 1 is as described above. Next, with reference to FIG. 75 to FIG. 78, an AUDIT national flag switch setting specification in the slot machine 1 will be described. Each of FIG. 75 to FIG. 78 is a diagram explaining the AUDIT national flag switch setting specification in the slot machine according to the embodiment of the present invention. In the AUDIT national flag switch setting specification in the slot machine according to the embodiment of the present invention, the designation of "national flag" displayed on the language switch touch button 410 upon switching a language can be conducted by making a setting on the AUDIT MENU on the lower side image display panel 141 shown in FIG. 75 to FIG. 78. As the "national flag" displayed on the language switch touch button 410, there are national flags of US, UK, and CHN.

REFERENCE SIGNS LIST

1: slot machine
3: video reels
3*a*: first video reel ("Reel 1")
3*b*: second video reel ("Reel 2")
3*c*: third video reel ("Reel 3")
3*d*: fourth video reel ("Reel 4")
3*e*: fifth video reel ("Reel 5")
4: symbol display area
141: lower side image display panel

What is claimed is:

1. A slot machine comprising:

a display for displaying a part of a plurality of video reel strips having different kinds of symbols arranged thereon;

a value-addition mechanism by which a player is able to add to the slot machine gaming media to be bet;

an award payout mechanism by which gaming media can be paid out to the player or credited to current credits of the player as an outcome of a slot game; and a processor for causing the slot game including a base game and free games to proceed on the display, the processor being programmed to execute, as a result of the player having bet gaming media, processes (A) to (B) described below.

(A) A process in which upon causing the base game to proceed, used are base game reel strips on which on all of the plurality of video reel strips, symbols whose each kind is the same are arranged in succession.

(B) A process in which upon causing the free games to proceed, used are free game reel strips on which on all of the plurality of video reel strips, the symbols whose each kind is the same are arranged in succession and only in a case of top symbols whose payout is the highest under the same condition, the top symbols whose number is larger than the number of top symbols displayed on the base game reel strips are arranged in succession.

2. A slot machine comprising:

a display for displaying a part of a plurality of video reel strips on which a plurality of kinds of symbols including wild symbols, feature symbols, and top symbols enabling a larger award to be obtained than an award obtained by a combination of other symbols when the award is obtained;

a value-addition mechanism by which a player is able to add to the slot machine gaming media to be bet;

an award payout mechanism by which gaming media can be paid out to the player or credited to current credits of the player as an outcome of a slot game; and a processor for causing the slot game to proceed on the display, the slot game including a base game and free games triggered when in the base game, a predetermined combination of the feature symbols is displayed on the display, the processor being programmed to execute, as a result of the player having bet gaming media, processes (A) to (B) described below.

(A) A process in which upon causing the base game to proceed, used are base game reel strips on which the wild symbols and the feature symbols are arranged and other symbols than the feature symbols are arranged in succession, so as to avoid an award occurring by replacing the wild symbols with the feature symbols or avoid an award occurring by the feature symbols on all of the plurality of video reel strips.

(B) A process in which upon causing the free games to proceeds, used are free game reel strips on which symbols whose each kind is the same are arranged in succession and only in a case of top symbols whose payout is the highest under the same condition, the top symbols whose number is larger than the number of top symbols displayed on the base game reel strips are arranged in succession.

3. The slot machine according to claim 2, wherein the processor (C) extracts the same payout table in the base game and the feature games based on a display result of a plurality of video reel strips displayed on the display, and (D) determines the payout based on a value by which an amount of one bet is multiplied and based on an amount of bets actually placed, the value being predetermined by the payout table.

4. The slot machine according to claim 2, wherein the processor (E) causes a prize enabling shifting to a feature game to occur when a number of feature symbols displayed on the display reaches a predetermined number or more or when a total of the number of said feature symbols and a number of the wild symbols reaches a predetermined number or more, and (F) causes a prize, when predetermined symbols other than the feature symbols are arranged, on the display, on a winning line which is set over a plurality of reels, based on a number of the arranged symbols to occur, on the base game reel strips defined to be used as the respective plurality of video reel strips, the wild symbols and the feature symbols, included in symbols arranged on a single reel of the base game reel strips and displayed on the display, are arranged such that each of a total of the number of the feature symbols and a number of newly resulting feature symbols with which the wild symbols are replaced and the number of only the feature symbols not including the wild symbols is less than a predetermined set succession number of other symbols whose kind is one kind and which are arranged in succession, and on the base game reel strips, symbols which differ from the feature symbols triggering the feature game and cause a prize to occur based on a kind of a combination of the symbols displayed on the winning line and whose number is the predetermined set succession number or more are arranged in succession.

5. The slot machine according to claim 4, wherein when the single reel of the base game reel strips has been stopped, the wild symbols and the feature symbols are arranged on the single reel of the base game reel strips such that when symbols displayed on the display include the wild symbols and the feature symbols, the total of the feature symbols and the newly resulting feature symbols with which the wild symbols are replaced is less than the predetermined set succession number, and when the symbols displayed on the display do not include the wild symbols, a number of the feature symbols displayed on the display is less than the predetermined set succession number.

* * * * *